US005118112A

United States Patent [19]

Bregman et al.

[11] Patent Number: 5,118,112

[45] Date of Patent: Jun. 2, 1992

[54] GOLF SWING BALANCE ANALYZER

[75] Inventors: Walter Bregman, Del Mar; Robert A. Lentz, Encinitas; Angus R. Colson, Jr., Jamul; Jan Schultz; Michael Cavanaugh, both of La Jolla, all of Calif.

[73] Assignee: S & B Enterprises, Inc., Del Mar, Calif.

[21] Appl. No.: 633,321

[22] Filed: Dec. 24, 1990

[51] Int. Cl.[5] ..... A63B 69/36

[52] U.S. Cl. ..... 273/183 A; 273/187 R; 273/183 R; 273/195 R; 273/186 C; 434/252

[58] Field of Search ..... 273/195 R, 187 B, 187 R, 273/186 C, 186 R, 184 R, 183 B, 183 A, 183 R, 35 R, 327, 449, 440; 434/247, 252, 258; 128/779; 73/172

[56] References Cited

U.S. PATENT DOCUMENTS

| | | | |
|---|---|---|---|
| 3,169,022 | 2/1965 | Kretsinger | 273/183 B |
| 3,352,559 | 11/1967 | Larsen | 273/187 R |
| 3,413,006 | 11/1968 | Beston | 273/187 R |
| 3,639,923 | 2/1972 | Stewart | 273/187 R |
| 3,994,501 | 11/1976 | O'Donnell | 273/183 A |
| 4,023,810 | 5/1977 | Lorang | 273/187 B |
| 4,037,847 | 7/1977 | Lorang | 273/187 B |
| 4,304,406 | 12/1981 | Cromarty | 273/186 R |
| 4,577,868 | 3/1986 | Kiyonaga | 273/183 A |

*Primary Examiner*—Edward M. Coven
*Assistant Examiner*—Jessica J. Harrison
*Attorney, Agent, or Firm*—Frank D. Gilliam

[57] ABSTRACT

A system for analyzing the balance of a golfer during a golf swing and to determine weight shifts from one foot to the other and between the heel and toe of each foot during a golf swing. Basically the system comprises two foot pads capable of measuring weight on each pad and on the front and rear portions of each pad, a display for displaying weight information in digital and/or graphical form, a sound sensor for sensing the impact of a golf club against a golf ball and a microprocessor system for receiving information from the pads and generating the display. In use, a golfer positions the foot pads where his feet would be in his normal golf stance, arranges the display in front of the pads a safe distance away, positions the cable between footpads and display out of the way and places a normal golf ball on a tee or on the ground the appropriate distance from the footpads. The unit is turned on and parameters are set, the golfer stands on the footpads and then takes his normal swing at the golf ball. Typically, the display will show the weight on the pads at full backswing, at impact (as triggered by the sound of club hitting ball) and at full follow through. The readings may be compared to ideal readings or be saved for comparison among swings by the golfer. The results may be used by the golfer to adjust his swing toward the optimum.

36 Claims, 3 Drawing Sheets

GOLF SWING BALANCE ANALYZER

APPENDIX

The appendix hereto consists of the program listing for the microprocessor as used in this invention. The Appendix is identified as "Control Program for S&B Electronics' Golf Weight Shifter Prototype" Version 4.0 lb.

BACKGROUND OF THE INVENTION

This invention relates in general to devices for improving golf swings and, more particularly, to a device for measuring and analyzing balance shifts and weight shifts during a golf swing.

A wide variety of teaching and training aids have been designed over the years to aid individuals in developing a golf swing of optimum power and accuracy. These devices have purposes such as improving stance, backswing, hand or head position, follow through and the like. In an optimum golf swing for most right-handed persons, weight which is initially evenly divided between the feet when the ball is addressed, shifts to the right foot during the backswing, then during the downswing is returned to the left foot at impact and continues to shift to the left foot during follow through. For most golfers, the ideal combination of power and accuracy has been found to occur when weight is shifting to the left foot at the instant of impact.

It is, of course, difficult if not impossible, for either the golfer or an observer, such as a golf teaching professional, to determine whether correct weight shift has occurred during a swing. Also, undesirable shifts of weight between the golfer's heels and toes may occur during the swing which, again, is difficult for a golfer or observer to recognize.

Attempts have been made to provide devices which indicate weight shift in a visible manner. For example, Kretsinger in U.S. Pat. No. 3,169,022 describes a system in which the golfer stands on two pads and swings a club at a simulated golf ball. Each pad contains a weight responsive variable capacitor which sends a signal to a display in the form of a row of indicator lamps. Lamps will light from the center to each side in accordance with the weight on each pad. A sound responsive pick-up device freezes the light display at the moment of club impact with the ball. The display only shows the degree of weight imbalance between the feet at moment of impact and does not show weight shift at backswing or follow through. The indication cannot be saved for convenient comparison to the results with other swings. Since results are affected by the user's weight, it must be readjusted for different users and will probably be inconsistent from one use to the next by the same person. The device is incapable of analyzing an entire swing and of measuring toe to heel weight shifts. Further the device does not provide digital information and does not supply "quantifiable" data.

Another golf swing practice device is described by O'Donnell in U.S. Pat. No. 3,994,501. Two opposed blades are hinged at a midpoint and extend in opposite directions, with the distal ends elevated by compression springs. A golfer stands with one heel on each raised end. A switch turns on a light when the blade is depressed by the golfer's weight. When a right-handed golfer swings, if the swing is correct and left heel is raised during the backswing and weight has returned to the left heel at impact a light will turn on. While possibly of some use, this crude indication does not indicate correctness of the follow through and does not analyze the entire swing. No indication of swing quality is saved for comparison with later swings or ideal swings.

Thus, there is a continuing need for systems for fully analyzing golf swing from the backswing, through impact, to the follow through. For effective teaching, there is a need for a way to compare the results of each swing with earlier and later swings.

SUMMARY OF THE INVENTION

An object of this invention, therefore, is to provide a device for analyzing a golf swing which overcomes the above-noted problems. Another object is to provide a device which measures and displays weight shift between the feet and/or between the heel and toe of each foot during a golf swing. A further object of this invention is to provide a device which allows analysis of weight balance during a golf swing at the top of the backswing, at impact with a golf ball and at the top of the foreswing or follow-through. Still another object is to provide a device in which a displayed sequence of weight shift during a golf swing may be replayed for analysis.

The above objects, and others, are accomplished in accordance with this invention by a device which basically includes a pair of foot pads sized to support a golfer with one foot on each pad, each pad including weight measuring means for measuring total weight on each pad and the distribution of weight between the front (toe) end and the rear (heel) end and a display unit including a variety of system control switches, most of which are operable by a golfer using the head of a golf club, and a display which selectively displays, in numerical and/or graphical form, weight shift information generated during a swing.

BRIEF DESCRIPTION OF THE DRAWING

Details of the invention, and preferred embodiments thereof, will be further understood upon reference to the drawing, wherein.

DETAILED DESCRIPTION OF PREFERRED EMBODIMENTS

Figure 1:
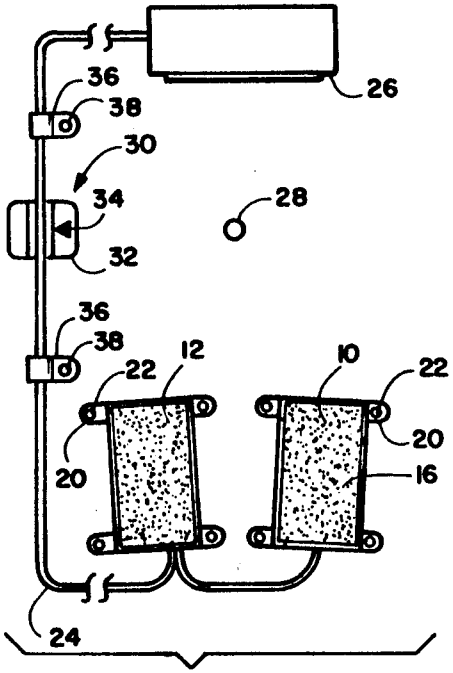
FIG. 1 is a schematic plan view of the overall swing analyzer system of this invention.

Referring now to FIG. 1, there is seen a plan view of the overall arrangement of the golf swing analyzer of this invention. Two foot pads, a right foot pad 10 and left pad 12 are sized to support the feet of a golfer in his normal stance. Typically, each pad may be about 8 inches by 14 inches, with a thickness of about 0.75 inch. The pads may be designed to fold or may include clips to secure the two pads together for convenience in transporting and storing them. Pad bases 14 may be formed from any suitable plastic or rigidized rubber. Inside each base is transducer in the form of a conventional flexible printed circuit (not shown, but seen in FIGS. 5 and 6) including weight-to-electric signal transducers which transmits signals corresponding to weight imposed in selected areas. Typical such flex circuits are available from Tekscan, Inc. The upper surface preferably has a layer of synthetic grass or carpet-like material 16 to provide a non-slip, turf-like surface, with sufficient thickness to cushion golf shoe spikes from penetrating to the flex circuit below. Between the base and material 16 is preferably located an additional protective sheet which may typically be an aluminum plate.

If desired, small loops 20 may be secured to each pad 10 and 12 along the edges, so that pins such as conventional golf tees 22 may be inserted into the loops and into the ground to prevent the pads from slipping during use. Alternatively, the lower surface of pads 10 and 12 may be rough or include molded downwardly extending pins or nubs to reduce pad slippage.

A conventional electrical cable 24 connects pads 10 and 12 to a control and display box 26, as described in detail below. Cable 14 has sufficient length to be out of the way (and permit box 26 to be placed at an easily viewed location) when a golfer stands on pads 10 and 12 and swings at conventional golf ball 28. If desired, a reference target may be provided to aid the golfer in lining up his swing. Target 30 is a small plastic sheet 32, with suitable indicia such as an arrow 34, which clips on cable 24 and is slidable therealong. Further, clips 36 may be provided along cable 24 with openings adapted to receive pins such as conventional golf tees 38 to hold cable 24 in the selected position between the pads and display box 26.

Figure 1A:
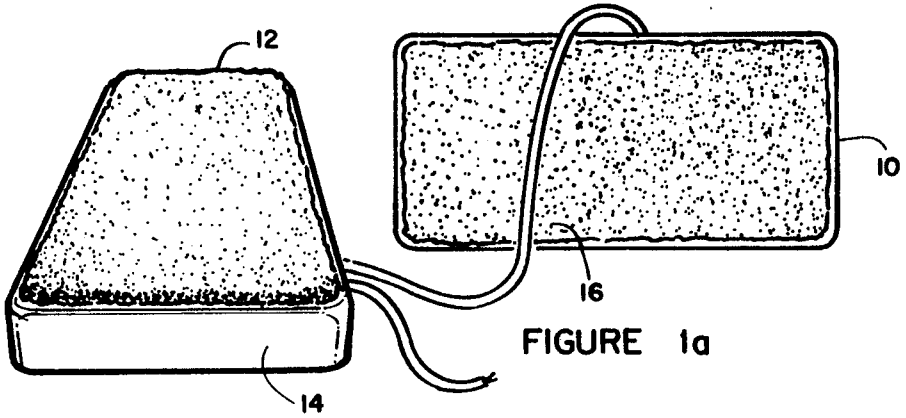
FIG. 1*a* is a showing of right and left foot pads of the invention.
Figure 2:
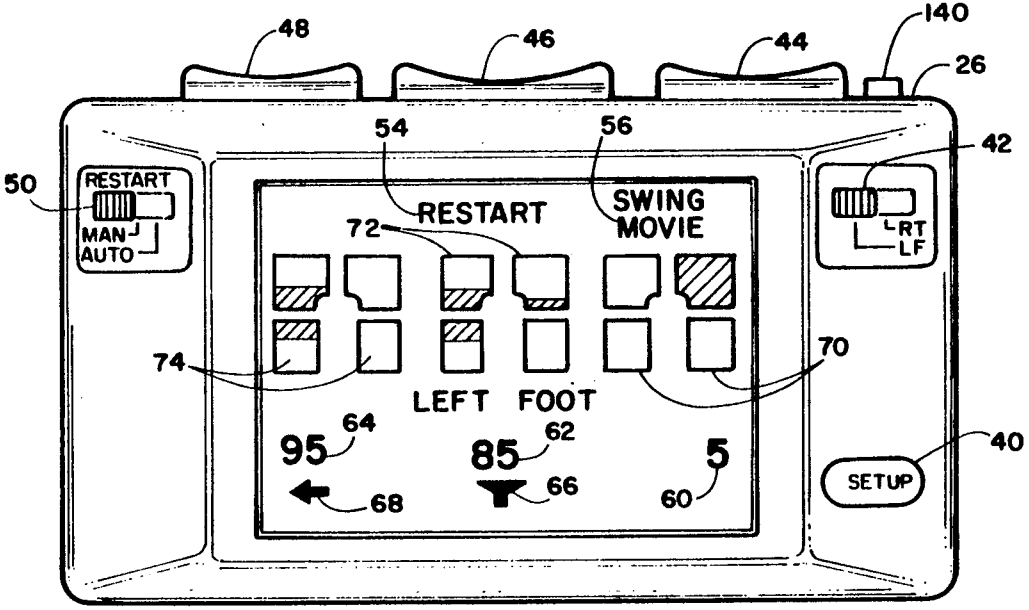
FIG. 2 is a plan view of the display and control box.

FIG. 2 shows a plan view in detail of control and display box 26. A "setup" button 40 is provided to turn the unit on and to initiate a setup sequence during which the golfer sets certain system parameters, as discussed in detail in conjunction with the description of FIG. 3. A "right-left" switch 42 is set to correspond with the direction of the swing, right-to-left or left-to-right. Three large switches are provided along the top of the unit which can be operated by hand or by a golf club head when the golfer has taken his stance. Display switch 44 steps the display through the sequence of deferent displays available, e.g., numerical and graphical displays. Reset button 46 is used to manually reset the system for another swing, after the golfer has had time to evaluate the results of a prior swing, compare the results of the last swing to some prior swing, etc. Reciprocal switch 48 toggles the display between showing weight shift to the left foot (as shown on the FIG. 2 display) to showing weight shift from the right foot. These weight percentage numbers are always reciprocals, e.g. a left foot reading of 95 will equate to a right foot reading of 5, always summing to 100. Which foot weight is displayed is selected by the golfer in accordance with his personal preference. A restart selection switch 50 permits the golfer to select between an automatic, timed, restart or a manual restart selected by switch 46. As described below, the automatic restart delay period can be selected during system setup.

A display panel 52, typically a conventional liquid crystal display, shows the results of a swing in several different modes, including numerical and graphical displays. The display shown is a summary display at the completion of a swing. An indication of the point in the operating sequence is shown at 54. An indication of the next screen which would be displayed upon pressing display switch 44 is provided in the upper right corner; here, "swing movie" indicating that pressing switch 4 will cause the display to go through the swing sequence, showing in a movie-like manner the weight shift sequence of the golfer's last swing. As discussed below, other information will be displayed across the top of the display at particular points in the operating sequence.

The lower portion of display 52 shows the percentage of the golfer's weight on his left foot (as indicated at 58) at three points in the swing, at the peak of the backswing 60, at impact 62 and at peak foreswing or follow-through 64. A golf tee symbol 66 is provided to indicate the moment of impact and an arrow symbol 68 shows that the swing is to the left, i.e., a right-handed golfer.

A display showing heel and toe weight distribution at the corresponding points in the swing is shown in graphical form across the upper portion of display 52. The backswing display 70 shows a pair of shoes with the toes uppermost. As indicated here, substantially 100% of the golfer's weight is on his right toe at the backswing peak. Then, at impact as indicated at 72, most weight is on the left foot, fairly balanced between heel and toe, with a small amount of weight remaining on the right toe. Finally, at the completion of the foreswing, weight has entirely shifted to his left foot, with just over 50% on his heel. This display is easily understood and conveys a great deal of information in this simple graphical form. If desired, other displays could be used, such as bar graphs or the like. However, that shown is strongly preferred.

The sequence of displays presented on display screen 52 is illustrated in FIGS. 3*a–h*, in conjunction with the control switches shown in FIG. 2. When the system is turned on by pressing setup switch 40 (FIG. 2), an introductory screen (not shown) is usually displayed, welcoming the user, providing a copyright notice, etc. After a few seconds this automatically sequences to the initial setup screen shown in FIG. 3*a*. The three switches 44, 46 and 48 act as setup selection buttons in this mode. As shown on the screen of FIG. 3*a*, the golfer selects. generally by pressing the appropriate adjacent switch with his club head, one of the "restart delay", "contrast" or "takeaway weight" (which is the weight distribution as the golfer addresses the ball, prior to starting his swing). If the golfer was the last to use the system, his prior choices were saved, so he can retain those by indicating "done" by pressing the setup button 40 (FIG. 2).

Figure 3A:
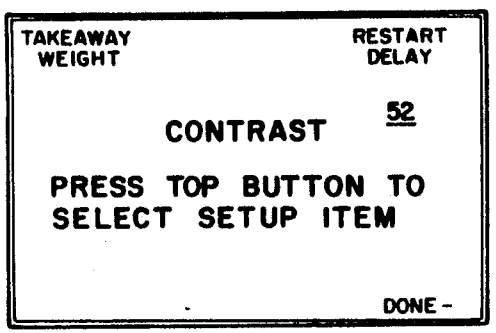
FIG. 3*a* is a plan view of the display screen at the start of setup.
Figure 3B:
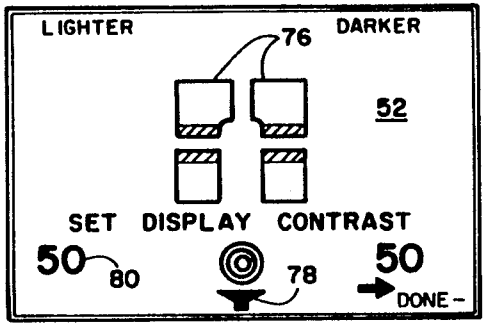
FIG. 3*b* is a plan view of the display screen at the "set contrast" point.

Setting of display contrast is illustrated in FIG. 3*b*. While the display numerals and representations are of a size easily read from up to about 6 feet away, depending on the brightness of the location, it may be desirable to set the contrast of screen 52. After the golfer has pressed switch 46 (FIG. 2) in the mode of FIG. 3*a*, the screen of FIG. 3*b* appears. One set of graphical shoe indicators 76, a golf ball on a tee symbol 78 and typical numerals 80 are provided so that the golfer can evaluate display readability. Contrast is incrementally changed towards lighter or darker by pressing switches 48 or 44, respectively. When optimum contrast is set for the conditions, switch 40 is pressed, returning the display to that shown in FIG. 3*a*.

Figure 3C:
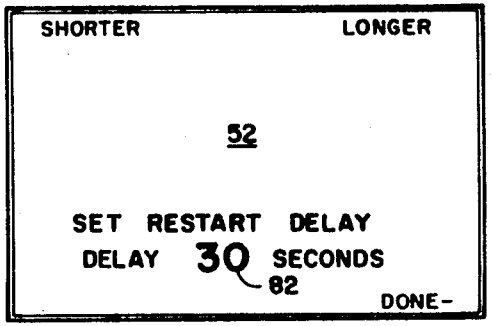
FIG. 3*c* is a plan view of the display screen at the "set restart delay" point.

To set the automatic restart delay period, the golfer presses switch 44 in the FIG. 3*a* mode, changing the display to that shown in FIG. 3*c*. The delay period last set is shown at 82. If he wishes to change the reset delay, he taps switch 44 or 48 for longer or shorter delay periods, respective. Each tap will change the number at 82 by one second. When the desired delay is set, he presses switch 40 to return the display to the screen shown in FIG. 3*a*. If the golfer plans to use manual, rather than automatic, reset as discussed above, he can skip this step.

Figure 3D:
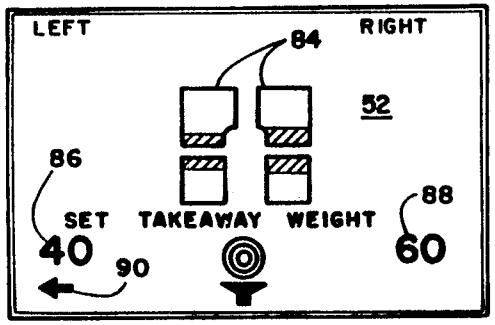
FIG. 3*d* is a plan view of the display screen at the "set weight" point.
Figure 3E:
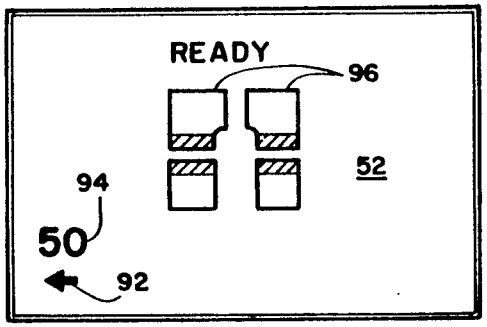
FIG. 3*e* is a plan view of the display screen at the "ready" point.

To set the takeaway weight, generally by balancing the weight between the feet and between heels and toes at address, the golfer presses switch 48 in the mode of FIG. 3*a*, which changes the screen to that shown in FIG. 3*d*. Initial weight distribution between the left and right feet is indicated by numerals 86 and 88 and the left and right shoe illustrations 84, respectively. The golfer moves his feet on the pads to get an even distribution of weight between heels and toes as shown in the illustration at 84. If the right and left foot weight distribution is not to the golfer's liking, he taps switch 44 or 48 to increase the percentage assigned to the right or left foot, respectively. An arrow 90 is provided to indicate whether a right-to-left swing (as indicated here) or a left-to-right swing is intended. If the arrow direction is incorrect for this golfer, switch 42 is reversed, as discussed above. When the weight distribution indication is set to the golfer's satisfaction, he presses button 40 to return to the screen of FIG. 3*a*. If all parameters have been set or approved, button 40 is pressed to indicate "done" and the screen changes to the screen shown in FIG. 3*e*.

Screen 3*e* shows the initial weight on the left foot, here an indicated 50% shown at 94. If the golfer prefers that the right foot weight be displayed, he can press switch 48 which, in this mode, will move the weight distribution numerals 94 to the right side of the screen and show right foot weight percentage throughout the sequence. As graphically indicated at 96, weight is even between heels and toes. Arrow 92 indicates a right-to-left swing is planned. The golfer then begins his swing.

Figure 3F:
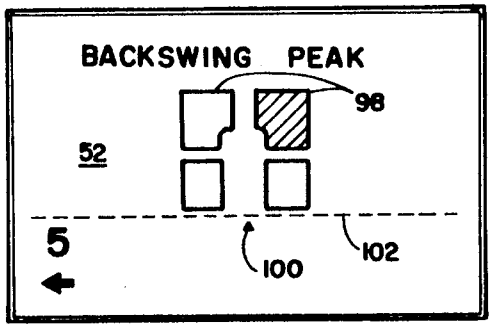
FIG. 3*f* is a plan view of the display screen at the peak of the backswing.

When the golfer reaches the peak of his backswing, the display will show the screen shown in FIG. 3*f*. The weight sensing system determines the peak backswing point by measuring the maximum weight shift to the right foot, at which point the downswing begins. The display indicates that only 5% of the golfer's weight remains on the left foot at peak backswing and that essentially all right foot weight is on the toe, as indicated at 98. An arrow 100 and line 102 graphically illustrate the point in time currently being displayed by the feet and time from 1 second before impact to 1 second after impact, respectively. The display at peak backswing is saved for later display, as discussed below.

Figure 3G:
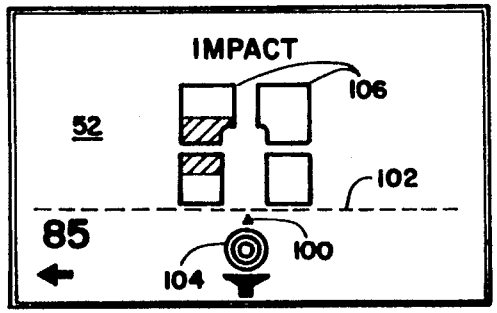
FIG. 3*g* is a plan view of the display screen at the point of impact.

As the swing progresses, the moment of impact is reached, as illustrated in the screen of FIG. 3*g*. Impact is indicated by a ball and tee symbol 104. A microphone 140 included in control and display box 26 detects the sound of club impact on golf ball 28 (FIG. 1) and freezes the weight shift display at that point. Here, 85% of the weight is on the left foot at impact and most of the weight is evenly balanced between heel and toe of the left foot has shown at 106. Line 102 and arrow 100 indicate time and weight shift to the left foot. For later analysis, this screen is saved.

Figure 3H:
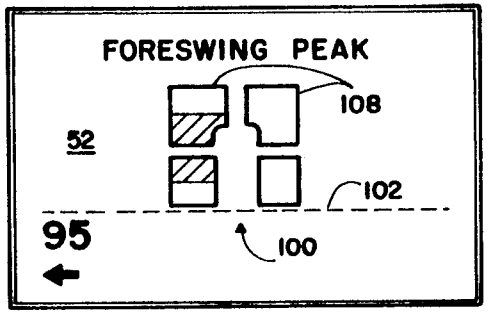
FIG. 3*h* is a plan view of the display screen at the foreswing peak.

As foreswing or follow through continues to a peak as detected as maximum weight shift to the left foot, the display changes to the screen shown in FIG. 3*h*. As indicated, 95% of the weight is now on the left foot, with an even balance between the heel and toe of the left foot, as indicated at 108. Line 102 and arrow 100 indicate time and weight shift, respectively. This screen is saved for later use, as discussed below.

Upon completion of the swing, the golfer can press switch 44, acting to change the display in this mode, to bring up the analysis screen shown in FIG. 2. In comparing this screen to those of FIGS. 3*f*, 3*g* and 3*h*, one can see that data for the entire swing is combined in one screen in a way which permits easy analysis and evaluation of the entire swing. By pressing display switch 44, a movie-like display in which the sequence shown in FIGS. 3*f*, 3*g* and 3*h* is repeated can be brought up. Pressing switch 44 toggles back to the screen of FIG. 2. The display will be automatically reset to the "ready" screen of FIG. 3*e* when the golfer presses reset switch 46 or, in the automatic restart mode, when the restart delay period expires.

Figure 4:
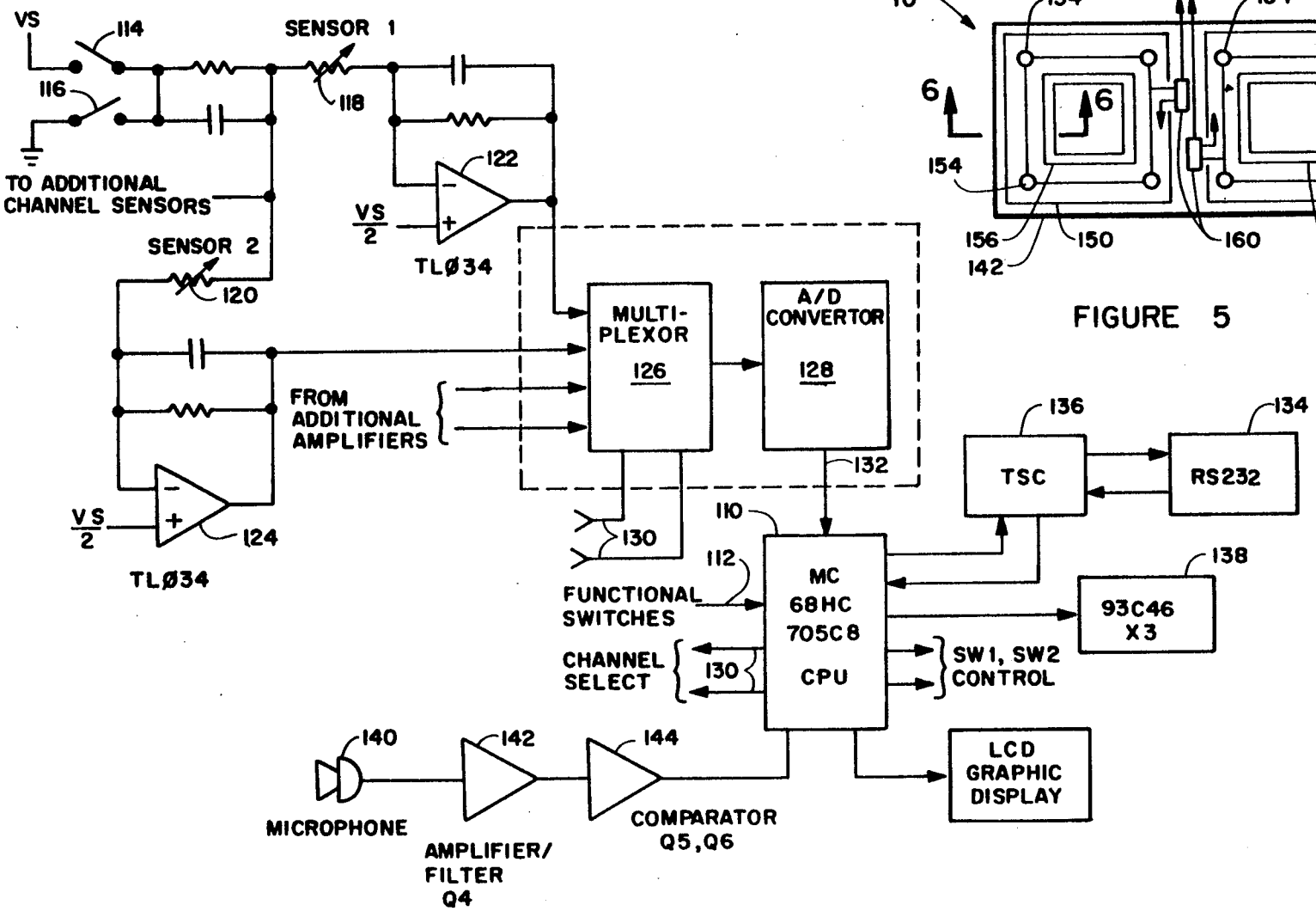
FIG. 4 is a block diagram of the electronic components contained within the display and control box.

FIG. 4 is a schematic block diagram illustrating the components for receiving weight information from pads 10 and 12 and generating the displays discussed above.

The heart of this system is the central processing unit, microprocessor 110, typically a 68HC705C8 from Motorola. Microprocessor 110 is programmed in accordance with the program provided in the Appendix to this disclosure. The function switches described above, switches 40–50, control microprocessor 110 through lines schematically indicated at 112. The receipt of data from the sensors in pads 10 and 12 by microprocessor 110 is controlled by switches 114 and 116 under the control of the microprocessor.

Sensor 1 and sensor 2 are schematically represented as variable resistors 118 and 120 which might, for example, represent the heel and toe sensors in right pad 10. A similar pair of sensors, not shown for clarity, provide heel and toe signals for pad 12. The sensor signals are amplified in amplifiers 122 and 124, typically TL034 amplifiers from Texas Instruments. The amplified signals pass to a multiplexor 126 and analog to digital converter 128, typically combined in a 145041 from Motorola. Channel selection signals from microprocessor 110 are received by multiplexor 126 at 130. The digitized signal from the A/D converter 128 pass to microprocessor 110 through line 132.

An RS-232 level converter 134, typically a TSC232 from Teledyne Semiconductor is provided for test and calibration of the system in a conventional manner. A non-volatile memory array 136, typically three 93C46 units from SGS Thompson, is provided to maintain calibration data.

A microphone 140 is provided to pick up the sound of impact of club on golf ball, as discussed above. The signal from microphone 140 is passed through an amplifier/filter 142 and a comparator to microprocessor 110.

The output of microprocessor 110 is directed to liquid crystal display 52 as discussed above.

Figure 6:
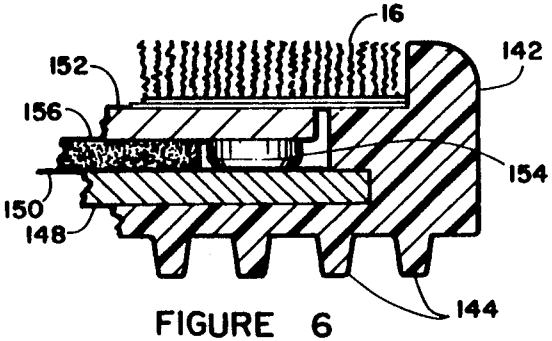
FIG. 6 is a schematic section view taken on line 6—6 in FIG. 5.
Figure 5:
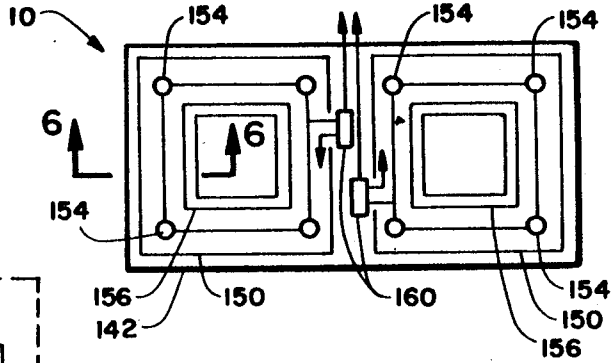
FIG. 5 is a schematic plan view of a foot pad with the upper cover removed.

Details of the internal components of a foot pad 10 or 12 are provided in FIGS. 5 and 6. In FIG. 5 the cover layer 16 and the upper pressure plate are removed to show the internal components. Each pad includes a base 142 of plastic, hard rubber or the like which covers the bottom of the pad and extends up the sides. A plurality of short pins or nubs 144 are preferably provided across the bottom of the pad to grip the grass or other surface and prevent the pad from slipping in use. A base plate 146 is secured within base 142. Base plate 148 can be formed from any rigid, strong material such as a metal, a fiber reinforced plastic or the like. For the optimum combination of light weight and strength, tempered aluminum is preferred.

Flexible sensor sheet 150 is placed over base plate 148. A force to electric energy transducer is formed in each corner of the sensor sheet 150. A pressure plate 152 is placed above sensor sheet 150 with a disk-like spacer at each corner in direct contact with each transducer to transfer loads on pressure plate 152 to the transducers. A frame-like sheet 156 of resilient foam material is placed between base plate 148 and pressure plate 152 to act as a spring and reduce the pressure of spacers 154 when no one is standing on the pad. The central portion of foam sheets 156 is cut away to provide room for the electronic components shown in FIG. 4, which are secured to or part of sensor sheet 150.

A layer of synthetic turf or other carpet-like material 16 is secured over pressure plate 152. For ease of access to the internal components, layer 16 could be secured with conventional hook-and-loop material such as that sold under the Velcro trademark along the edges where layer 16 overlaps base 142.

Electrical junction connectors 160 are provided in cut-out areas in base 142 to connect sensor sheets 150 to electrical cables 14. The wires may exit the side of the pad as sen in FIG. 5 or may run to one end in a suitable groove (not shown) in base 142 to exit at an end as seen in FIG. 1.

While certain specific materials, components and arrangements were described in detail in conjunction with the above description of preferred embodiments, those may be varied, where suitable, with similar results. This device may be adapted for use in baseball, tennis, basketball and other action sports and also has utility in orthopedic analysis and medical therapy. Other variations, applications and ramifications of this invention will occur to those skilled in the art upon reading the present disclosure. Those are intended to be included within the scope of the invention as defined in the appended claims.

```
2500 A.D. 6805 Macro Assembler  -  Version 4.01b
-----------------------------------------------------------

        Input  Filename : DUMMY.asm
        Output Filename : DUMMY.obj

                                LIST      ON
0000                            NAM       GO

                        * CONTROL PROGRAM FOR S&B ELECTRONICS' GOLF WEIGHT SHIFTER PROTOTYPE.
                        * WRITTEN FOR THE MICRO WORKS BY BOB LENTZ.
                        * COPYRIGHT (C.) 1990 BY THE MICRO WORKS INC.
                        * AND S & B ELECTRONICS.

                        * MOTOROLA MC68HC705C8S/P CODE

0000                            .PAGE0

        0000            PORTA   EQU     0
        0001            PORTB   EQU     1
        0002            PORTC   EQU     2
        0003            PORTD   EQU     3

        0004            DDRA    EQU     4
        0005            DDRB    EQU     5
        0006            DDRC    EQU     6
        0007            DDRD    EQU     7                       * FOR CY EMULATION

        000A            SPCR    EQU     $A
        000B            SPSR    EQU     $B
        000C            SPDR    EQU     $C

        000D            BAUD    EQU     $D
        000E            SCCR1   EQU     $E
        000F            SCCR2   EQU     $F
        0010            SCSR    EQU     $10
        0011            SCDAT   EQU     $11

        0012            TCR     EQU     $12
        0013            TSR     EQU     $13

        0014            ICH     EQU     $14
        0015            ICL     EQU     $15

        0016            OCH     EQU     $16
        0017            OCL     EQU     $17

        0018            COUNTH  EQU     $18
        0019            COUNTL  EQU     $19

        001A            ALTCH   EQU     $1A
        001B            ALTCL   EQU     $1B
```

```
GU

        001C        PROG    EQU     $1C

        001D        COPR    EQU     $1D
        001E        COPC    EQU     $1E

        0030        RAM     EQU     $30             * RAM IS PAGED IN HIGH AND LOW


0000                        .CODE

        0180        ROM     EQU     $180

        015F        RAMTOP  EQU     $15F            * MEMORY MAP #4

                    ****************************************************************
        0001        OPTLOC  ASK     EMULATOR (=0) OR ROM (=1) ?:

        [01]                IFZ     OPTLOC
                    OPTION  EQU     $3FDF           * FOR C9 EMULATOR
        [01]                ELSE
        1FDF        OPTION  EQU     $1FDF           * FOR C8 EPROM PART
        [00]                ENDIF

                    ****************************************************************

        1FF4        RSV     EQU     $1FF4

        1FF4        SPIVEC  EQU     $1FF4
        1FF6        SCIVEC  EQU     $1FF6
        1FF8        TIMVEC  EQU     $1FF8
        1FFA        IRQVEC  EQU     $1FFA
        1FFC        SWIVEC  EQU     $1FFC
        1FFE        RESVEC  EQU     $1FFE


0000                        .PAGE0


                    ********************************
                    *                              *
                    *                              *
                    *       CONSTANTS              *
                    *                              *
                    *                              *
                    ********************************



                    * ERROR CODES

        0001        ADE1    EQU     1               * SPI TIMEOUT ERROR
        0002        ADE2    EQU     2               * A/D CONVERTER TIMEOUT
        0003        NWTERR  EQU     3               * NOVRAM WRITE TIMEOUT
        0004        NRDERR  EQU     4               * NOVRAM READ TIMEOUT
        0005        NCSERR  EQU     5               * NOVRAM CHECKSUM ERROR
        0006        NWERR   EQU     6               * NOVRAM NOT WRITTEN ERROR
```

```
GO

0007        DTOERR   EQU     7          * DISPLAY RESET TIMEOUT ERROR

            * BATTERY VOLTAGE THRESHOLDS

00B2        BATLO    EQU     178        * 6.9 VOLTS
00B7        BATHI    EQU     183        * 7.1 VOLTS

            * AUTO RESET DISPLAY HOLD TIME DEFAULT

0002        HOLDTIM  EQU     2          * TABLE POINTER TO 15 SECOND DELAY

            * CHARACTER FONT AND FEET COUNTERS

000A        LARRO    EQU     10         * LEFT ARROW
000B        RARRO    EQU     11         * RIGHT ARROW
000C        TEE      EQU     12         * TEE
000D        BLANK    EQU     13         * BLANK SPACE
000E        BELEFT   EQU     14         * BULL'S EYE LEFT HALF
000F        BERIGHT  EQU     15         * BULL'S EYE RIGHT HALF
0010        LFOOT    EQU     16         * LEFT FOOT
0011        RFOOT    EQU     17         * RIGHT FOOT

            * STRING OFFSETS

0000        NL$      EQU     0          * NULL STRING (FOR CLEARING)
0002        NLS$     EQU     2          * NULL STRING, SET MODE
0004        SM$      EQU     4          * TARGET SET MODE TEXT STRING
0006        PM$      EQU     6          * PLAY MODE TEXT STRING
0008        CM$      EQU     8          * CONTRAST SET MODE TEXT STRING
000A        BL$      EQU     10         * BATTERY LOW WARNING STRING
000C        BLS$     EQU     12         * BATTERY LOW, SET MODE STRING
000E        ER$      EQU     14         * ERROR MESSAGE STRING
0010        BN$      EQU     16         * BANNER STRING
0012        BD$      EQU     18         * BARS DISPLAY STRING - MANUAL RESTART
0014        NA$      EQU     20         * BARS DISPLAY STRING - AUTO RESTART
0016        MV$      EQU     22         * MOVIE STRING - RUNNING
0018        MV1$     EQU     24         * MOVIE STRING - STOPPED
001A        BP$      EQU     26         * BACKSWING PEAK STRING - RUNNING
001C        BP1$     EQU     28         * BACKSWING PEAK STRING - STOPPED
001E        IP$      EQU     30         * IMPACT STRING - RUNNING
0020        IP1$     EQU     32         * IMPACT STRING - STOPPED
0022        FP$      EQU     34         * FORESWING PEAK STRING - RUNNING
0024        FP1$     EQU     36         * FORESWING PEAK STRING - STOPPED
0026        DM$      EQU     38         * DELAY SET MODE STRING
0028        SU$      EQU     40         * SETUP MENU STRING
002A        LF$      EQU     42         * 'LEFT FOOT' STRING
002C        RF$      EQU     44         * 'RIGHT FOOT' STRING

            * TYPAMATIC CONSTANTS

001E        STCNT    EQU     30         * 0.6 SEC TYPAMATIC START DELAY
0008        RPTCNT   EQU     8          * 320 mS. TYPAMATIC REPEAT TIME
```

```
GO

                                                                                
        0007            PRESS    EQU      7                  * TYPAMATIC 'PRESSED' BIT IN REGISTER
                                                                                
                                                                                
                        ********************************
                        *                              *
                        *                              *
                        *        RAM VARIABLES         *
                        *                              *
                        *                              *
                        ********************************
                                                                                
0030                            ORG      RAM
                                                                                
0030                    LEFTT    RMB      1                  * LEFT TOE DATA
0031                    LEFTH    RMB      1                  * LEFT HEEL DATA
0032                    RIGHTT   RMB      1                  * RIGHT TOE DATA
0033                    RIGHTH   RMB      1                  * RIGHT HEEL DATA
                                                                                
                        * DEBOUNCE ENGINE BIT POSITIONS (FOR PENDING AND BUTTON).
                                                                                
        0000            DIR      EQU      0                  * DIRECTION      BIT  SWITCH LOW = RIGHT
        0001            AMS      EQU      1                  * AUTO/MANUAL     "   SWITCH LOW = AUTO
        0002            PRE      EQU      2                  * PRESET          "   PB TOGGLES FLAG 2
        0003            RCP      EQU      3                  * RECIPROCAL      "
        0004            RST      EQU      4                  * RESET           "   PB TOGGLES FLAG 3
        0005            DSP      EQU      5                  * DISPLAY         "
                                                                                
0034                    PENDING  RMB      1                  * DEBOUNCE INTERMEDIATE REGISTER
0035                    BUTTON   RMB      1                  * DEBOUNCE RESULT REGISTER
                                                                                
0036                    PACKHI   RMB      1                  * PACKER TEMPS
0037                    PACKLO   RMB      1
                                                                                
0038                    FOOTHI   RMB      1                  * FOOT PROCESSOR TEMPS
0039                    FOOTLO   RMB      1                  *
                                                                                
003A                    COUNT    RMB      1                  * INTERRUPT COUNTER
003B                    SWATIM   RMB      1                  * POST IMPACT SAMPLE COUNTER
003C                    LTIME    RMB      1                  * EON COUNTER
                                                                                
003D                    TARGET   RMB      1                  * TAKEAWAY WEIGHT TARGET REGISTER
003E                    DUTY     RMB      1                  * LCD CONTRAST CONTROL REGISTER
003F                    DELAY    RMB      1                  * RESTART DELAY CONTROL REGISTER
                                                                                
0040                    APHI     RMB      1                  * ADDRESS POINTER HIGH
0041                    APLO     RMB      1                  * ADDRESS POINTER LOW
                                                                                
0042                    LTYPO    RMB      1                  * LEFT BUTTON TYPAMATIC REGISTER
0043                    RTYPO    RMB      1                  * RIGHT BUTTON TYPAMATIC REGISTER
                                                                                
0044                    XLOUNT   RMB      1                  * X REGISTER PASSES COUNTER LOW DISPLAY
                                                                                
0045                    THITMP   RMB      1                  * TEMP FOR RESETTING THE TIMER
0046                    NOVXT    RMB      1                  * TEMP FOR NOVROM ROUTINES
0047                    CKTMP    RMB      1                  * TEMP FOR CHECKSUM CHECKER
0048                    BIGDX    RMB      1                  * BIGD X TEMP
```

```
00

0049                BIGDA    RMB     1                 * BIGD A TEMP
004A                BPOINT   RMB     1                 * RING BUFFER POINTER
004B                TOTIME   RMB     1                 * NOVRAM TIMEOUT TIMER
004C                MXTEMP   RMB     1                 * MOVIE DISPLAY X TEMP

004D                GATE     RMB     1                 * BUTTON PRESS NOISE BLANKING GATE

004E                NUM      RMB     1                 * NUMERATOR FOR DIVIDE ROUTINE
004F                DENOM    RMB     1                 * DENOMINATOR FOR DIVIDE ROUTINE

0050                BUCKET   RMB     1                 * BIT BUCKET FOR A/D TEST DATA

0051                SHIFTER  RMB     1                 * OUTBITS TEMP & CURSOR SHIFT COUNTER

0052                SHIFT    RMB     1                 * CURSOR SHIFT TEMP
0053                OFFSET   RMB     1                 * CURSOR BYTE OFFSET TEMP

                    * A BYTE'S WORTH OF GENERAL PURPOSE FLAGS

0054                FLAGS    RMB     1

        0000        NOVHOT   EQU     0                 * NOVRAM ACTIVE FLAG. 1 = HOT
        0001        BAT      EQU     1                 * LOW BATTERY FLAG. 1 => FADING
                    *PRE     EQU     2                 * PRESET BUTTON TOGGLE. 1 = SET MODE
        0003        PAU      EQU     3                 * MOVIE PAUSE FLAG TOGGLE. 1 = PAUSE.
        0004        ZAP      EQU     4                 * ONWT FLAG BUFFER BIT
        0005        ONWT     EQU     5                 * ON TARGET WEIGHT FLAG. 1 = ON
        0006        DISP     EQU     6                 * DISPLAY REFRESH FLAG
        0007        SWT      EQU     7                 * END OF SWING FLAG

                    * ANOTHER BYTE'S WORTH OF RANDOM FLAGS

0055                FLAG2    RMB     1

        0000        LTO      EQU     0                 * LONG TIME TIMER TIMEOUT FLAG
        0001        HOLD     EQU     1                 * MOVIE PAUSE FLAG
        0002        NOV3     EQU     2                 * NOVRAM 3 CHIP SELECT FLAG
        0003        NOV2     EQU     3                 * NOVRAM 2 CHIP SELECT FLAG
        0004        LJ       EQU     4                 * LEFT JUSTIFY FLAG
        0005        RJ       EQU     5                 * RIGHT JUSTIFY FLAG
        0006        LR       EQU     6                 * LEFT/RIGHT SAMPLER FLAG
        0007        NOV1     EQU     7                 * NOVRAM 1 CHIP SELECT FLAG


                    * ERROR CODE TEMP

0056                ECODE    RMB     1


                    * DISPLAY BITMAP BUFFER

0057                DOTS1    RMB     1                 * LEFT CHR DOT ROW
0058                DOTS2    RMB     1                 * MIDDLE CHR DOT ROW
0059                DOTS3    RMB     1                 * RIGHT CHR DOT ROW

                    * SWING DATA REGISTERS
```

```
GO

005A                BHI     RMB     1           * BACKSWING HIGH VALUE POINTER
005B                BLO     RMB     1           *     "     LOW    "      "
005C                FHI     RMB     1           * FORESWING HIGH   "      "
005D                FLO     RMB     1           *     "     LOW    "      "
005E                IMP     RMB     1           * IMPACT VALUE POINTER

                    * FOOT FILLER POINTERS

005F                FILLON  RMB     1           * START FILLING HERE
0060                FILLOFF RMB     1           * STOP FILLING HERE


                    ********************************
                    * RAM RESIDENT CODE LIVES HERE *
                    ********************************

0061   D6 1F F4     RAMCODE LDA     RSV,X       * LDA 2-BYTE,X
0064   81                   RTS

       0062         RAH     EQU     RAMCODE+1
       0063         RAL     EQU     RAMCODE+2


       00D6         RAMLDA  EQU     $D6
       0081         RAMRTS  EQU     $81



                    * DUE TO SMALL RAM AND FIXED SYSTEM STACK, WE HAVE TO KLUGE
                    * THE RING BUFFER BY BREAKING IT INTO TWO SEGMENTS.

0070                        ORG     $70

0070                BUFFER1 RMB     106         * $6A - GOES TO $DA, RESERVES 37 BYTES
       00DA         BUF1END EQU     *           * FOR STACK.

0000                        .CODE

0100                        ORG     $100

0100                BUFFER2 RMB     94          * $5E - GOES TO TOP OF RAM @ $15E
       015E         BUF2END EQU     *

       0096         GAP     EQU     BUFFER2-106 * BUFFER SEGMENT OFFSET


                    ********************************
                    *                              *
                    *                              *
                    *        ROM CODE              *
                    *                              *
                    *                              *
                    ********************************

015E                        .CODE
```

```
00

0180                    ORG     ROM


                  * My friend foot - foot.


                  ********************************
                  *                              *
                  *                              *
                  *          INIT                *
                  *                              *
                  *                              *
                  ********************************


                  * RESET VECTOR POINTS HERE - ENTRY POINT TO INITIALIZE EVERYTHING.


0180   9C         RESET   RSP                     * $FF -> SP


                  * SET OPTION REGISTER - DON'T FORGET TO UN-WRITE PROTECT THE EVN!

0181   A6 C0              LDA     #$C0            * RAM @ $30 - $4F
                                                   * RAM @ $100 - $15F
                                                   * SECURITY OFF
0183   C7 1F DF           STA     OPTION          * IRQ EDGE SENSITIVE ONLY

                  * CLEAR THE RAM

0186   AE 30              LDX     #$30
0188   7F         CLL1    CLR     0,X
0189   5C                 INX
018A   26 FC               BNE     CLL1
018C   4F                  CLRA
018D   D7 01 00    CLL2    STA     $100,X
0190   5C                  INX
0191   A3 60               CPX     #$60
0193   26 F8               BNE     CLL2


                  * INIT THE I/O PORTS


                  * PORT A   BIT 0 = /IMPACT - INPUT FROM AUDIO PREAMP. LOW ON BALL HIT
                  *          BIT 1 = CALIBRATE MODE SWITCH - LOW = CAL MODE
                  *          BIT 2 = N3CS - NOVRAM 3 CHIP SELECT, ACTIVE HIGH
                  *          BIT 3 = N2CS - NOVRAM 2 CHIP SELECT, ACTIVE HIGH
                  *          BIT 4 = NDI - SERIAL DATA INPUT FROM NOVRAM BANK
                  *          BIT 5 = NDO - SERIAL DATA OUTPUT TO NOVRAM BANK
                  *          BIT 6 = NSK - NOVRAM BANK SERIAL CLOCK, RISING EDGE ACTIVE
                  *          BIT 7 = N1CS - NOVRAM 1 CHIP SELECT, ACTIVE HIGH


0195   A6 00              LDA     #%00000000
0197   B7 00              STA     PORTA
0199   A6 EC              LDA     #%11101100      * 0,1,4 INPUTS
```

```
GO

019B   B7 04                    STA     ADDR

                        * PORT B   BIT 0 = LCD C/D - HIGH = COMMAND, LOW => DATA
                        *          BIT 1 = LCD /CE - LOW = ENABLE
                        *          BIT 2 = LCD /RD - LOW = READ
                        *          BIT 3 = LCD /WR - LOW = WRITE
                        *          BIT 4 = LCD VEE CONTROL, HIGH = ON
                        *          BIT 5 = PULLDOWN FET GATE - HIGH = ON
                        *          BIT 6 = PULLUP FET GATE - LOW = ON
                        *          BIT 7 = A/D /CS - ACTIVE LOW

019D   A6 DF                    LDA     #%11011111
019F   B7 01                    STA     PORTB
01A1   A6 FF                    LDA     #%11111111          * ALL OUTPUTS
01A3   B7 05                    STA     BDDR

                        * PORT C   BIT 0 = DISPLAY DATA LSB
                        *          BIT 1 =
                        *          BIT 2 =
                        *          BIT 3 =                  8 BIT DATA BUS FOR LCD DISPLAY
                        *          BIT 4 =
                        *          BIT 5 =
                        *          BIT 6 =
                        *          BIT 7 = DISPLAY DATA MSB

01A5   A6 00                    LDA     #%00000000          * BIDIRECTIONAL - INPUTS WHEN IDLE.
01A7   B7 06                    STA     CDDR

                        * PORT D   BIT 0 = RDI
                        *          BIT 1 = TDO
                        *          BIT 2 = MISO
                        *          BIT 3 = MOSI
                        *          BIT 4 = SCK
                        *          BIT 5 = SLAVE SELECT - TIED HIGH.
                        *          BIT 7 = A/D EOC, GOES HIGH WHEN CONVERSION COMPLETE.

01A9   A6 1A                    LDA     #%00011010
01AB   B7 07                    STA     DDDR                * THE 68HC05C9 HAS ONE OF THESE...

                        * INIT THE SPI

01AD   A6 50                    LDA     #$50                * SPIEIA, MASTER, NORM LOW FAST CLOCK
01AF   B7 0A                    STA     SPCR

                        * INIT THE RS-232 PORT
```

```
GO

01B1   A6 30          LDA     #$30          * @ 4.0 mHz. 9600 BAUD
01B3   B7 0D          STA     BAUD
01B5   3F 0E          CLR     SCCR1         * 8 DATA BITS, IDLE LINE WAKE UP
01B7   A6 0C          LDA     #$C           * TX, RX ENABLE, INTERRUPTS DISABLED
01B9   B7 0F          STA     SCCR2

                    * INIT THE LCD CONTRAST REGISTER.

01BB   A6 23          LDA     #$23
01BD   B7 3E          STA     DUTY

                    * INIT TIMER FOR THE 20 mSEC. TIME SLICE INTERRUPTS.

01BF   B6 18          LDA     COUNTH        * GET HIGH BYTE, FREEZE COUNT
01C1   B7 45          STA     THITMP        * @ 4 mHz. 10000 COUNTS = 20 mS. = $2710
01C3   A6 10          LDA     #$10          * 20.0 mS TIME SLICE
01C5   BB 19          ADD     COUNTL        * ADD TO CURRENT TIMER VALUE
01C7   97             TAX
01C8   B6 45          LDA     THITMP        * GET HIGH BYTE
01CA   B9 3E          ADC     DUTY
01CC   B7 16          STA     OCH           * RESULT TO OUTPUT COMPARE REG
01CE   B6 13          LDA     TSR           * CLEAR THE OCF
01D0   BF 17          STX     OCL

01D2   A6 40          LDA     #$40          * ENABLE OCF INTERRUPTS
01D4   B7 12          STA     TCR

                    * INIT THE RAM CODE

01D6   A6 D6          LDA     #RAMLDA       * LDA 2-BYTE,X
01D8   B7 61          STA     RAMCODE
01DA   A6 81          LDA     #RAMRTS       * RTS
01DC   B7 64          STA     RAMCODE+3

                    * INIT THE BUFFER POINTER

01DE   3F 4A          CLR     BPOINT        * START OF LOW BUFFER AREA

                    * INIT INTERRUPT COUNTER

01E0   A6 0F          LDA     #15           * 15 INTERRUPTS = 300 mSEC.
01E2   B7 3A          STA     COUNT

                    * GO DO IT

01E4   9A             CLI


                    * INIT THE TARGET WEIGHT TO WHATEVER IT WAS LAST TIME THE USER SET IT.
```

```
60

01E5   5F                GETTAR   CLRX                        * TARGET = LOCATION 0
01E6   CD 11 AE                   JSR     RDNOV3
01E9   25 04                      BCS     ?2                  * CHECKSUM ERROR?

01EB   A1 12                      CMP     #18
01ED   23 0B                      BLS     ?3                  * TOO HIGH?

01EF   A6 07             ?2       LDA     #7                  * IF HOSED, MAKE IT 50%
01F1   5F                         CLRX                        * NOV3 ADDRESS = 0
01F2   CD 12 25                   JSR     WRTNOV3             * STICK IT IN THE NOVRAM
01F5   24 03                      BCC     ?3
01F7   CC 13 61                   JMP     FUBAR

01FA   B7 3D             ?3       STA     TARGET


                         * INIT THE CONTRAST SETTING TO WHATEVER IT WAS LAST TIME THE USER DWELLED IT.


01FC   AE 01             GETCON   LDX     #1                  * CONTRAST = LOCATION 1
01FE   CD 11 AE                   JSR     RDNOV3
0201   25 08                      BCS     ?2                  * CHECKSUM ERROR?

0203   A1 26                      CMP     #$26
0205   22 04                      BHI     ?2                  * TOO HIGH?
0207   A1 10                      CMP     #$10
0209   24 0C                      BHS     ?3                  * TOO LOW?

020B   A6 23             ?2       LDA     #$23                * IF HOSED, MAKE IT $23
020D   AE 01                      LDX     #1                  * NOV3 ADDRESS = 1
020F   CD 12 25                   JSR     WRTNOV3             * STICK IT IN THE NOVRAM
0212   24 03                      BCC     ?3
0214   CC 13 61                   JMP     FUBAR

0217   B7 3E             ?3       STA     DUTY


                         * INIT THE DELAY SETTING TO WHATEVER IT WAS LAST TIME THE USER DWELLED IT.


0219   AE 02             GETDEL   LDX     #2                  * DELAY = LOCATION 2
021B   CD 11 AE                   JSR     RDNOV3
021E   25 04                      BCS     ?2                  * CHECKSUM ERROR?

0220   A1 0E                      CMP     #14
0222   23 0C                      BLS     ?3                  * OUT OF RANGE? ( 0 - 14 )

0224   A6 02             ?2       LDA     #HOLDTIM            * IF HOSED, MAKE IT 15 SEC.
0226   AE 02                      LDX     #2                  * NOV3 ADDRESS = 2
0228   CD 12 25                   JSR     WRTNOV3             * STICK IT IN THE NOVRAM
022B   24 03                      BCC     ?3
022D   CC 13 61                   JMP     FUBAR

0230   B7 3F             ?3       STA     DELAY


                         * INIT THE DISPLAY
```

```
GO

0232   CD 0B 0C                JSR     DINIT

                       * CLEAR THE DISPLAY

0235   CD 0B 60                JSR     CLS

                       * DISPLAY THE BANNER

0238   AE 10                   LDX     #BN$            * BANNER STRING
023A   CD 0D 41                JSR     GSTRING

023D   9B                      SEI
023E   A6 0A                   LDA     #10             * THREE SECONDS
0240   B7 3C                   STA     LTIME
0242   11 55                   BCLR    LTO,FLAG2
0244   9A                      CLI

0245   CD 13 3B                JSR     COPYR           * SEND COPYRIGHT MESSAGE

0248   01 55 FD       NERF    BRCLR   LTO,FLAG2,NERF

024B   CD 0B 60                JSR     CLS

024E   1F 54                   BCLR    SWT,FLAG3       * FLUSH THE STARTUP TRANSIENT

                       ******************************
                       *                            *
                       *                            *
                       *          MAIN              *
                       *                            *
                       *                            *
                       ******************************

0250   02 00 03       MAIN    BRSET   1,PORTA,MAIN1   * CALIBRATE MODE?

0253   CD 0D F9                JSR     CAL

0256   05 54 03       MAIN1   BRCLR   PRE,FLAG5,MAIN2 * SET MODE?

0259   CD 02 6A                JSR     SETP

025C   0F 54 03       MAIN2   BRCLR   SWT,FLAG3,MAIN3 * TIME TO DISPLAY RESULTS?

025F   CD 03 4B                JSR     SWAT

0262   0D 54 EB       MAIN3   BRCLR   DISP,FLAG3,MAIN  * TIME TO REFRESH THE DISPLAY?

0265   CD 05 9F                JSR     PLAYDIS

026B   20 E6                   BRA     MAIN
```

```
GO

                                 ********************************
                                 *                              *
                                 *                              *
                                 *        SET MODE              *
                                 *                              *
                                 *                              *
                                 ********************************


                                 * ALLOW THE USER TO PRESET THE TAKEAWAY WEIGHT TARGET, THE CONTRAST
                                 * OF THE LCD DISPLAY AND THE RESTART DELAY.
                                 * WHILE IN WEIGHT MODE, THE LEFT BUTTON CAUSES THE LEFT WEIGHT TO
                                 * INCREASE AND THE RIGHT BUTTON CAUSES IT TO DECREASE. 5% PER PUSH.
                                 * WHILE IN CONTRAST MODE, THE LEFT BUTTON DECREASES THE DISPLAY
                                 * CONTRAST AND THE RIGHT BUTTON INCREASES IT.
                                 * WHILE IN DELAY MODE, THE LEFT BUTTON DECREASES THE DELAY TIME AND
                                 * THE RIGHT BUTTON INCREASES IT.
                                 * PROCESSOR WILL HANG AROUND HERE UNTIL THE USER QUITS FIDDLING. THEN
                                 * WRITE THE TARGET, DUTY AND DELAY TO THE NOVRAM AND RETURN.


026A    CD 0B 60         SETIT    JSR      CLS                    * CLEAR THE SCREEN
026D    AE 28                     LDX      #SU6                   * SETUP MAIN MENU STRING
026F    CD 0D 41                  JSR      GSTRING

0272    07 35 0C         SETIT0   BRCLR    RCP.BUTTON.SETWT       * SET THE TARGET WEIGHT?
0275    09 35 41                  BRCLR    RST.BUTTON.CONTT       * SET DISPLAY CONTRAST?
0278    0B 35 77                  BRCLR    DSP.BUTTON.DELTT       * SET RESTART DELAY?
027B    04 54 F4                  BRSET    PRE.FLAGS.SETIT0       * USER DONE TWEAKING?
027E    CC 03 44                  JMP      SETDUN2                * NO NEED TO THRASH THE NOVRAMS..


                                 ********************************
                                 *                              *
                                 *                              *
                                 *      SET TAKEAWAY WEIGHT     *
                                 *                              *
                                 *                              *
                                 ********************************


0281    CD 0B 60         SETWT    JSR      CLS
0284    CD 06 B1                  JSR      SETDISP                * DISPLAY

0287    07 35 FD         SETWT00  BRCLR    RCP.BUTTON.SETWT00     * GET DELTA DA BUTTON
028A    0B 35 FA                  BRCLR    DSP.BUTTON.SETWT00

028D    0E 42 12         SETWT0   BRSET    PRESS.KTYPE.SETUP      * USER WANT TO INCREASE LEFT WEIGHT?
0290    0E 43 06                  BRSET    PRESS.KTYPE.SETDWN     * USER WANT TO DECREASE LEFT WEIGHT?
0293    04 54 F7                  BRSET    PRE.FLAGS.SETWT0       * IS THE USER DONE WITH US?
0296    CC 03 77                  JMP      SETDUN

0299    B6 3D            SETDWN   LDA      TARGET                 * DECREASE IT BY ONE STEP
029B    4A                        DECA
029C    2B 0D                     BMI      SETOUT                 * CAN'T GO LOWER THAN 5%
029E    B7 3D                     STA      TARGET
02A0    20 09                     BRA      SETOUT
```

60

```
02A2   B6 3D        SETUP    LDA     TARGET          * INCREASE IT BY ONE STEP
02A4   4C                    INCA
02A5   A1 12                 CMP     #18             * CAN'T GO HIGHER THAN 95%
02A7   22 02                 BHI     SETOUT
02A9   B7 3D                 STA     TARGET

02AB   CD 06 B1     SETOUT   JSR     SETDISP         * PAINT THE DISPLAY

02AE   0E 42 FD     SETOUT1  BRSET   PRESS,LTYPO,SETOUT1 * LEGGO 'DAT BUTTON!
02B1   0E 43 FA              BRSET   PRESS,RTYPO,SETOUT1

02B4   04 54 D6              BRSET   PRE,FLAGS,SETOUT0 * LOOP UNTIL USER'S DONE NEGOTING
02B7   20 6E                 BRA     SETDUM

                    ******************************
                    *                            *
                    *                            *
                    *     SET DISPLAY CONTRAST   *
                    *                            *
                    *                            *
                    ******************************

02B9   CD 0B 60     CONIT    JSR     CLS
02BC   CD 06 AA              JSR     CONDISP

02BF   07 35 FD     CONIT00  BRCLR   RCP,BUTTON,CONIT00 * GIT OFFA DA BUTTON
02C2   0B 35 FA              BRCLR   DSP,BUTTON,CONIT00

02C5   0E 43 13     CONIT01  BRSET   PRESS,RTYPO,CONUP * USER WANT TO INCREASE CONTRAST?
02C8   0E 42 05              BRSET   PRESS,LTYPO,CONDWN * USER WANT TO DECREASE CONTRAST?
02CB   05 54 59              BRCLR   PRE,FLAGS,SETDUM * IS THE USER DONE WITH US?
02CE   20 F5                 BRA     CONIT01

02D0   B6 3E        CONDWN   LDA     DUTY
02D2   A1 10                 CMP     #$10
02D4   23 0E                 BLS     CONOUT          * CAN'T GO LOWER THAN $10
02D6   4A                    DECA                    * DECREASE IT BY ONE STEP
02D7   B7 3E                 STA     DUTY
02D9   20 09                 BRA     CONOUT

02DB   B6 3E        CONUP    LDA     DUTY
02DD   A1 26                 CMP     #$26
02DF   24 03                 BHS     CONOUT          * CAN'T GO HIGHER THAN $26
02E1   4C                    INCA                    * INCREASE IT BY ONE STEP
02E2   B7 3E                 STA     DUTY

02E4   CD 06 AA     CONOUT   JSR     CONDISP         * REPAINT THE DISPLAY

02E7   0E 42 FA     CONOUT1  BRSET   PRESS,LTYPO,CONOUT * LEGGO 'DAT BUTTON!
02EA   0E 43 F7              BRSET   PRESS,RTYPO,CONOUT
02ED   04 54 D5              BRSET   PRE,FLAGS,CONIT01 * LOOP UNTIL USER'S DONE INFORMING.
02F0   20 35                 BRA     SETDUM

                    ******************************
```

```
GO

                                *                                *
                                *                                *
                                *       SET RESTART DELAY        *
                                *                                *
                                *                                *
                                ********************************


02F2   CD 0B 60          DELIT    JSR      CLS
02F5   CD 07 90                   JSR      DELDISP

02F8   07 35 FD          DELIT00  BRCLR    RCP,BUTTON,DELIT00   * GIT OFFA DA BUTTON
02FB   0B 35 FA                   BRCLR    DSP,BUTTON,DELIT00

02FE   0E 43 11          DELIT01  BRSET    PRESS,KEYPD,DELUP    * USER WANT TO INCREASE CONTRAST
0301   0E 42 05                   BRSET    PRESS,KEYPD,DELDWN   * USER WANT TO DECREASE CONTRAST
0304   05 54 20                   BRCLR    PRE,FLAGS,SETDUN     * IS THE USER DONE WITH US?
0307   20 F5                      BRA      DELIT01

0309   B6 3F             DELDWN   LDA      DELAY
030B   4A                         DECA                          * DECREASE IT BY ONE STEP
030C   2B 0D                      BMI      DELOUT               * CAN'T BE < 0
030E   B7 3F                      STA      DELAY
0310   20 09                      BRA      DELOUT

0312   B6 3F             DELUP    LDA      DELAY
0314   4C                         INCA                          * INCREASE IT BY ONE STEP
0315   A1 0E                      CMP      #14
0317   22 02                      BHI      DELOUT               * CAN'T BE > 14
0319   B7 3F                      STA      DELAY

031B   CD 07 90          DELOUT   JSR      DELDISP              * REPAINT THE DISPLAY

031E   0E 42 FA          DELOUT1  BRSET    PRESS,KEYPD,DELOUT   * LEGGO DAT BUTTON!
0321   0E 43 F7                   BRSET    PRESS,KEYPD,DELOUT1
0324   04 54 D7                   BRSET    PRE,FLAGS,DELIT01    * LOOP UNTIL USER'S DONE TWEALING.


0327   5F                SETDUN   CLRX                          * WRITE THE TARGET SETTING TO
032B   B6 3D                      LDA      TARGET               * NOVRAM LOCATION 0
032A   CD 12 25                   JSR      WRTNOVS
032D   24 03                      BCC      SETDUN1
032F   CC 13 61          SETERR   JMP      FUBAR

0332   AE 01             SETDUN1  LDX      #1                   * WRITE THE CONTRAST SETTING TO
0334   B6 3E                      LDA      DUTY                 * NOVRAM LOCATION 1
0336   CD 12 25                   JSR      WRTNOVS
0339   25 F4                      BCS      SETERR

033B   AE 02                      LDX      #2                   * WRITE THE DELAY SETTING TO
033D   B6 3F                      LDA      DELAY                * NOVRAM LOCATION 2
033F   CD 12 25                   JSR      WRTNOVS
0342   25 EB                      BCS      SETERR


0344   CD 0B 60          SETDUN2  JSR      CLS
```

```
GO

0347   81                          RTS


                        ********************************
                        *                              *
                        *                              *
                        *     IMPACT PROCESSOR         *
                        *                              *
                        *                              *
                        ********************************


                        * WE NOW HAVE A BUFFER FULL OF DATA FOR THE LAST SWING, PROVIDED BY
                        * THE INTERRUPT HANDLER AND 'PLAY'.

0348   CD 06 1B         SWAT     JSR     GETDEAD          * ANALYSE THE SWING (Clubhead)
034B   1D 55                     BCLR    LR,FLAGS
034D   01 35 02                  BRCLR   DIR,BUTTON,SWAT1
0350   1C 55                     BSET    LR,FLAGS         * SAMPLE THE DIRECTION

0352   CD 0D 60         SWAT1    JSR     CLS              * CLEAR THE SCREEN

0355   CD 07 C0                  JSR     BARS             * GO DISPLAY IT

0358   BE 3F                     LDX     DELAY            * AUTO RESET DELAY TIME OFFSET
035A   D6 14 16                  LDA     DELTAB,X         * LOOK UP DELAY CONSTANT IN TABLE
035D   9B                        SEI                      * FIRE UP THE AUTO RESET TIMER
035E   B7 3C                     STA     LTIME            * IN 300 mSEC. INCREMENTS
0360   11 55                     BCLR    LTO,FLAGS        * LONG TIME TIMER TIMEOUT FLAG
0362   9A                        CLI

0363   03 35 0C         SWAT4    BRCLR   AMS,BUTTON,SWAT5 * ARE WE IN AUTO RESTART MODE?
0366   0B 35 1B                  BRCLR   DSP,BUTTON,SWAT7 * MOVIE?
0369   08 35 F7                  BRSET   RST,BUTTON,SWAT4 * JUST HANG IT UP HERE AND WAIT FOR USER
036C   CD 0B 60                  JSR     CLS
036F   1F 54                     BCLR    SWT,FLAGS        * CLEAR FLAG
0371   81                        RTS                      * TO HIT RESET OR FLIP THE AUTO RESET
                                                           * SWITCH BACK TO AUTO. THEN SPIN.

0372   00 55 06         SWAT5    BRSET   LTO,FLAGS,SWAT6  * WAIT FOR TIMEOUT
0375   0B 35 09                  BRCLR   DSP,BUTTON,SWAT7 * MOVIE?
0378   08 35 F7                  BRSET   RST,BUTTON,SWAT5 * OR RESET BUTTON PRESS
037B   CD 0B 60         SWAT6    JSR     CLS
037E   1F 54                     BCLR    SWT,FLAGS        * CLEAR FLAG
0380   81                        RTS                      * TO RETURN

0381   CD 0B 60         SWAT7    JSR     CLS

0384   AD 02                     BSR     MOVIE

0386   20 CA                     BRA     SWAT1
```

```
                                 ********************************
                                 *                              *
                                 *                              *
                                 *          ROLL 'EM!           *
                                 *                              *
                                 *                              *
                                 ********************************

0388  BE 4A          MOVIE   LDX     MPOINT      * BEGINNING OF BACKSWING
038A  3F 4F                  CLR     DENOM       * CURSOR POSITION
038C  17 54                  BCLR    PAU.FLAGS   * CLEAR THE PAUSE FLAG

038E  AD 62          M1      BSR     MSTRING     * SEND OUT THE STRINGS

0390  A3 6A                  CPX     #106        * SEQUENCE ?
0392  24 0A                  BHS     M4

0394  E6 70                  LDA     BUFFER1,X   * GET HIGH BYTE
0396  B7 36                  STA     PACKHI
0398  E6 71                  LDA     BUFFER1+1,X
039A  B7 37                  STA     PACKLO
039C  20 0A                  BRA     M5

039E  D6 00 96       M4      LDA     GAP,X
03A1  B7 36                  STA     PACKHI
03A3  D6 00 97               LDA     GAP+1,X
03A6  B7 37                  STA     PACKLO

03A8  CD 04 3B       M5      JSR     MDISP

03AB  03 55 0E               BRCLR   HOLD.FLAG2,M51  * PAUSE ?

03AE  A6 06                  LDA     #6          * PAUSE FOR 1.8 SEC. AT
                                                 * POINTS OF INTEREST.

03B0  9B                     SEI
03B1  B7 3C                  STA     LTIME
03B3  11 55                  BCLR    LTO.FLAG2
03B5  9A                     CLI

03B6  06 54 03       M50     BRSET   PAU.FLAGS,M51   * PLEASE THE WAIT IF BEING STOPPED.
03B9  01 55 FA               BRCLR   LTO.FLAG2,M50   * WAIT HERE 'TILL A MO'

03BC  07 54 22       M51     BRCLR   PAU.FLAGS,M59   * STOP THE WORLD?

03BF  AD 31                  BSR     MSTRING     * UPDATE THE STRINGS TO 'GO'

03C1  07 54 1D       M515    BRCLR   PAU.FLAGS,M59   * STOP THE WORLD?

03C4  0D 55 08               BRCLR   LR.FLAG,M52     * DIR LOW = RIGHT

03C7  07 35 17               BRCLR   RGP.BUTTON,M52  * LEFT: RGP HEADS GO FORWARD
03CA  0B 35 08               BRCLR   DGP.BUTTON,M57  * DGP HEADS GO BACKWARDS. FIRST WAIT.
03CD  20 F2                  BRA     M515

03CF  0B 35 0F       M52     BRCLR   DGP.BUTTON,M52  * RIGHT: DGP HEADS GO FORWARD
```

```
00

03D2   06 35 EC          BRSET   RCP,BUTTON,M57     * RCP MEANS GO BACKWARDS. ELSE WAIT
03D5   3A 4F     M57     DEC     DENOM              * RUN THE MOVIE BACKWARDS
03D7   5A                DEX
03D8   5A                DEX
03D9   A3 FE             CPX     #254
03DB   26 0D             BNE     M6
03DD   AE C6             LDX     #198
03DF   20 09     M58     BRA     M6
03E1   3C 4F     M59     INC     DENOM              * RUN THE MOVIE FORWARDS
03E3   5C                INX
03E4   5C                INX
03E5   A3 C8             CPX     #200
03E7   25 01             BLO     M6
03E9   5F                CLRX
03EA   B3 4A     M6      CPX     IMPOINT
03EC   27 03             BEQ     M7
03EE   CC 03 BE          JMP     M1
03F1   81        M7      RTS

                         ******************************
                         *                            *
                         *                            *
                         *   DISPLAY THE MOVIE STRINGS *
                         *                            *
                         *                            *
                         ******************************

03F2   BF 4C     MSTRING STX     HXTEMP             * STASH
03F4   B3 5E             CPX     IMP                * ARE WE AT IMPACT?
03F6   26 0E             BNE     MS2
03F8   AE 1E             LDX     #IP$               * IMPACT STRING OUT
03FA   07 54 02          BRCLR   PAU,FLAGS,MS1
03FD   AE 20             LDX     #IP1$
03FF   CD 0D 41  MS1     JSR     GSTRING
0402   1A 54             BSET    ONWT,FLAGS         * FLASH 'EM
0404   20 30             BRA     HOLDON             * AND HOLD 'EM.
0406   1B 54     MS2     BCLR    ONWT,FLAGS         * FOLD 'EM.
0408   B3 5B             CPX     BLO                * BACKSWING PEAK?
040A   26 0C             BNE     MS3
040C   AE 1A             LDX     #BP$               * BACKSWING PEAK STRING
040E   07 54 02          BRCLR   PAU,FLAGS,MS2B
```

```
GO

0411   AE 1C                    LDX     #MP1$

0413   CD 0D 41        MS25     JSR     GSTRING
0416   20 1E                    BRA     HOLDON

041B   B3 5C           MS3      CPX     FHI                 * FORESWING PEAK?
041A   26 0C                    BNE     HOLDOFF

041C   AE 22                    LDX     #FP$                * FORESWING PEAK STRING
041E   07 54 02                 BRCLR   PAU.FLAGS,MS35
0421   AE 24                    LDX     #FP1$

0423   CD 0D 41        MS35     JSR     GSTRING
0426   20 0E                    BRA     HOLDON

0428   13 55           HOLDOFF  BCLR    HOLD.FLAG2

042A   AE 16                    LDX     #MV$                * MOVIE PROMPT STRING
042C   07 54 02                 BRCLR   PAU.FLAGS,HOOD      * GREENER LIVES
042F   AE 18                    LDX     #MV1$

0431   CD 0D 41        HOOD     JSR     GSTRING             * AND RETOUCH
0434   20 02                    BRA     HOLDOUT

0436   12 55           HOLDON   BSET    HOLD.FLAG2          * A MOMENT OF SILENCE..
0438   BE 4C           HOLDOUT  LDX     MXTEMP
043A   81                       RTS


                       ********************************
                       *                              *
                       *                              *
                       *     DISPLAY A MOVIE FRAME    *
                       *                              *
                       *                              *
                       ********************************


043B   BF 4C           MDISP    STX     MXTEMP              * STASH

043D   18 55                    BSET    LJ.FLAG2            * LEFT JUSTIFY THE FIRST TWO
043F   1B 55                    BCLR    RJ.FLAG2

0441   A6 18                    LDA     #$18
0443   B7 41                    STA     APLO
0445   A6 06                    LDA     #$6
0447   B7 40                    STA     APHI

0449   B6 36                    LDA     PACHI               * GET CURRENT LOR DISTRIBUTION
044B   A4 1F                    AND     #$1F
044D   97                       TAX

044E   0D 55 10                 BRCLR   LR.FLAG2,HOO        * DON'T DISPLAY AMBIGUOUS DATA!

0451   D6 14 03                 LDA     FLAGLR,X
```

```
GO

1018  0454  44                LSRA
1019  0455  44                LSRA
1020  0456  44                LSRA
1021  0457  44                LSRA
1022  0458  CD 0B F3          JSR     BIGD
1023
1024  045B  A6 1B             LDA     #$1B
1025  045D  B7 41             STA     APLO
1026  045F  A6 06             LDA     #$6
1027  0461  B7 40             STA     APHI
1028
1029  0463  D6 14 03          LDA     PERTAB,X
1030  0466  A4 0F             AND     #$F
1031  0468  CD 0B F3          JSR     BIGD
1032
1033  046B  19 55       MD0   BCLR    LJ.FLAG2        * RIGHT JUSTIFY THE FIRST CENTER BLOCK
1034  046D  1A 55             BSET    RJ.FLAG2
1035
1036  046F  A6 1F             LDA     #$1F
1037  0471  B7 41             STA     APLO
1038  0473  A6 06             LDA     #$6
1039  0475  B7 40             STA     APHI
1040
1041  0477  A6 0D             LDA     #BLANK          * ON TARGET?
1042  0479  0B 54 02          BRCLR   ONNT.FLAGS,MD1
1043  047C  A6 0E             LDA     #DELEFT
1044
1045  047E  CD 0B F3    MD1   JSR     BIGD
1046
1047  0481  1B 55             BCLR    RJ.FLAG2        * LEFT JUSTIFY THE SECOND CENTER BLOCK
1048  0483  1B 55             BSET    LJ.FLAG2
1049
1050  0485  A6 22             LDA     #$22
1051  0487  B7 41             STA     APLO
1052  0489  A6 06             LDA     #$6
1053  048B  B7 40             STA     APHI
1054
1055  048D  A6 0D             LDA     #BLANK          * ON TARGET?
1056  048F  0B 54 02          BRCLR   ONNT.FLAGS,MD2
1057  0492  A6 0F             LDA     #DERIGHT
1058
1059  0494  CD 0B F3    MD2   JSR     BIGD
1060
1061  0497  0C 55 2B          BRSET   LR.FLAG2,MD1    * NONE OF THE ABOVE
1062
1063  049A  1A 55             BSET    RJ.FLAG2        * RIGHT JUSTIFY THE LAST TWO
1064  049C  19 55             BCLR    LJ.FLAG2
1065
1066  049E  A6 26             LDA     #$26
1067  04A0  B7 41             STA     APLO
1068  04A2  A6 06             LDA     #$6
1069  04A4  B7 40             STA     APHI
1070
1071  04A6  9F                TXA
1072  04A7  40                NEGA
1073  04A8  AB 12             ADD     #18
1074  04AA  97                TAX
```

```
        GO

1075    04AB    D6 14 03                LDA     PERTAB,X
1076    04AE    44                      LSRA
1077    04AF    44                      LSRA
1078    04B0    44                      LSRA
1079    04B1    44                      LSRA
1080    04B2    CD 0B F3                JSR     BIGD
1081
1082    04B5    A6 29                   LDA     #$29
1083    04B7    B7 41                   STA     APLO
1084    04B9    A6 06                   LDA     #$6
1085    04BB    B7 40                   STA     APHI
1086
1087    04BD    D6 14 03                LDA     PERTAB,X
1088    04C0    A4 0F                   AND     #$F
1089    04C2    CD 0B F3                JSR     BIGD
1090
1091    04C5    1B 55           MDT     BSET    LJ.FLAG2        * LEFT JUSTIFY THE TEE
1092    04C7    1B 55                   BCLR    RJ.FLAG2
1093
1094    04C9    A6 29                   LDA     #$29
1095    04CB    B7 41                   STA     APLO
1096    04CD    A6 08                   LDA     #$8
1097    04CF    B7 40                   STA     APHI
1098
1099    04D1    A6 0C                   LDA     #LF
1100    04D3    0A 54 02                BRSET   ONWT,FLAG5,MD5
1101    04D6    A6 0D                   LDA     #BLANK
1102
1103    04D8    CD 0B F3        MD5     JSR     BIGD
1104
1105    04DB    1B 55                   BCLR    RJ.FLAG2        * CENTER JUSTIFY THE ARROWS
1106    04DD    19 55                   BCLR    LJ.FLAG2
1107
1108    04DF    A6 21                   LDA     #$21            * DO LEFT ARROW
1109    04E1    B7 41                   STA     APLO
1110    04E3    A6 08                   LDA     #$8
1111    04E5    B7 40                   STA     APHI
1112
1113    04E7    A6 0A                   LDA     #LARRO
1114    04E9    0C 55 02                BRSET   LR.FLAG2,MD6    * LEFT OR RIGHT?
1115    04EC    A6 0D                   LDA     #BLANK
1116
1117    04EE    CD 0B F3        MD6     JSR     BIGD
1118
1119    04F1    A6 30                   LDA     #$30            * DO RIGHT ARROW
1120    04F3    B7 41                   STA     APLO
1121    04F5    A6 08                   LDA     #$8
1122    04F7    B7 40                   STA     APHI
1123
1124    04F9    A6 0B                   LDA     #RARRO
1125    04FB    0D 55 02                BRCLR   LR.FLAG2,MD7
1126    04FE    A6 0D                   LDA     #BLANK
1127
1128    0500    CD 0B F3        MD7     JSR     BIGD
1129
1130    0503    A6 97                   LDA     #$97
1131    0505    B7 41                   STA     APLO
```

```
GO

0507   A6 01                    LDA     #$1
0509   B7 40                    STA     APH
050B   B6 36                    LDA     PACKHI          * GET RATIOS
050D   BE 37                    LDX     PACKLO

050F   CD 09 74                 JSR     LEFTF

0512   A6 10                    LDA     BLFOOT
0514   CD 0C 9A                 JSR     BIGFOOT

0517   A6 9A                    LDA     #$9A
0519   B7 41                    STA     APLO
051B   A6 01                    LDA     #$1
051D   B7 40                    STA     APH

051F   CD 09 C1                 JSR     RIGHTF

0522   A6 11                    LDA     #BFOOT
0524   CD 0C 9A                 JSR     BIGFOOT

0527   AD 05                    BSR     CURSOR

0529   1D 54                    BCLR    DISP.FLAGS
052B   BE 4C                    LDX     MXTEMP
052D   81                       RTS

                        ******************************
                        *                            *
                        *                            *
                        *     CURSOR DISPLAY         *
                        *                            *
                        *                            *
                        ******************************

052E   BF 4E            CURSOR  STX     HOH             * SAVE
0530   B6 4F                    LDA     DENOM           * CURSOR POINTER
0532   0D 55 03                 BRCLR   LR.FLAG,L1      * RIGHT FOOT?
0535   40                       NEGA
0536   AB 64                    ADD     #100
0538   48               C1      ASLA
0539   97                       TAX
053A   A6 C3                    LDA     #195
053C   42                       MUL
053D   9F                       TXA
053E   A4 07                    AND     #7              * LEFT SHIFT COUNT IN LOW
0540   40                       NEGA
0541   AB 07                    ADD     #7
0543   B7 52                    STA     SHIFT

0545   54                       LSRX
0546   54                       LSRX
0547   54                       LSRX                    * BYTE OFFSET COUNT IN X
```

```
0548   9F                    TXA
0549   AB 64                 ADD     #64
054B   B7 41                 STA     AFLO
054D   A6 05                 LDA     #5
054F   A9 00                 ADC     #0
0551   B7 40                 STA     AFHI

0553   4F                    CLRA
0554   CD 0C 75              JSR     WDAD          * SHIFT OUT THE ADDRESS TO THE LCD

0557   5F                    CLRX                  * TOP LINE

0558   3F 57          F8     CLR     DOTS1
055A   3F 59                 CLR     DOTS3
055C   D6 18 99              LDA     BIND,X        * PIXELS
055F   B7 58                 STA     DOTS2

0561   B6 52                 LDA     SHIFT
0563   B7 51                 STA     SHIFTER
0565   27 0B                 BEQ     F10
0567   38 58          F9     LSL     DOTS2
0569   39 57                 ROL     DOTS1
056B   3A 51                 DEC     SHIFTER
056D   26 FB                 BNE     F9

056F   B6 57          F10    LDA     DOTS1
0571   CD 0A DE              JSR     WDAT
0574   A6 C0                 LDA     #$C0
0576   CD 0A C7              JSR     WCMD

0579   B6 58                 LDA     DOTS2
057B   CD 0A DE              JSR     WDAT
057E   A6 C0                 LDA     #$C0
0580   CD 0A C7              JSR     WCMD

0583   B6 59                 LDA     DOTS3
0585   CD 0A DE              JSR     WDAT
0588   A6 C0                 LDA     #$C0
058A   CD 0A C7              JSR     WCMD

058D   A6 14                 LDA     #20
058F   CD 0C 75              JSR     WDAD

0592   5C                    INX
0593   A3 08                 CPX     #8
0595   25 C1                 BLO     F8

0597   A6 9C                 LDA     #$9C          * DISPLAY ON
0599   CD 0A C7              JSR     WCMD

059C   BE 4E                 LDX     NUM
059E   81                    RTS

                   ********************************
```

```
GO

                                *                              *
                                *                              *
                                *     PLAY MODE DISPLAY        *
                                *                              *
                                *                              *
                                ********************************

05AF   AE 06          PLAYDIS   LDX     #PM%                   * PLAY MODE TEXT STRING
05A1   CD 0D 41                 JSR     GSTRING                * DISPLAY ON LCD

05A4   0A 54 04                 BRSET   UNWT,FLAGS,P1
05A7   19 54                    BCLR    ZAP,FLAGS              * LOOK AT ON TARGET FLAG ONLY ONCE
05A9   20 02                    BRA     PLAYD1                 * PER DISPLAY REFRESH OTHERWISE
                                                               * WE GET FRAGMENTATION OF THE INPUT S
05AB   18 54          P1        BSET    ZAP,FLAGS              * EYE AND TEE.

05AD   18 55          PLAYD1    BSET    LJ,FLAG2               * LEFT JUSTIFY THE FIRST TWO
05AF   1B 55                    BCLR    RJ,FLAG2

05B1   A6 18                    LDA     #$18
05B3   B7 41                    STA     APLO
05B5   A6 06                    LDA     #$6
05B7   B7 40                    STA     APHI

05B9   B6 36                    LDA     PACKHI                 * GET CURRENT L/R DISTRIBUTION
05BB   A4 1F                    AND     #$1F
05BD   97                       TAX

05BE   D6 14 03                 LDA     PERTAB,X
05C1   44                       LSRA
05C2   44                       LSRA
05C3   44                       LSRA
05C4   44                       LSRA

05C5   00 35 02                 BRSET   DIR,BUTTON,PD00        * DISPLAY DIGITS IF LEFT
05C8   A6 0D                    LDA     #BLANK                 * BLANK IF RIGHT (LOW)

05CA   CD 0B F3       PD00      JSR     BIGD

05CD   A6 18                    LDA     #$18
05CF   B7 41                    STA     APLO
05D1   A6 06                    LDA     #$6
05D3   B7 40                    STA     APHI

05D5   D6 14 03                 LDA     PERTAB,X
05D8   A4 0F                    AND     #$F

05DA   00 35 02                 BRSET   DIR,BUTTON,PD01
05DD   A6 0D                    LDA     #BLANK

05DF   CD 0B F3       PD01      JSR     BIGD

05E2   19 55                    BCLR    LJ,FLAG2               * RIGHT JUSTIFY THE FIRST CENTER BLOCK
05E4   1A 55                    BSET    RJ,FLAG2

05E6   A6 1F                    LDA     #$1F
```

```
1303  05E8  B7 41                 STA     APLO
1304  05EA  A6 06                 LDA     #$6
1305  05EC  B7 40                 STA     APHI
1306
1307  05EE  A6 0D                 LDA     #BLANK          * ON TARGET?
1308  05F0  09 54 02              BRCLR   ZAP,FLAG3,PD1
1309  05F3  A6 0E                 LDA     #BLEFT
1310
1311  05F5  CD 0B F3       PD1    JSR     BIGD
1312
1313  05F8  1B 55                 BCLR    RJ,FLAG2        * LEFT JUSTIFY THE SECOND CENTER BLOCK
1314  05FA  1B 55                 BSET    LJ,FLAG2
1315
1316  05FC  A6 22                 LDA     #$22
1317  05FE  B7 41                 STA     APLO
1318  0600  A6 06                 LDA     #$6
1319  0602  B7 40                 STA     APHI
1320
1321  0604  A6 0D                 LDA     #BLANK          * ON TARGET?
1322  0606  09 54 02              BRCLR   ZAP,FLAG3,PD2
1323  0609  A6 0F                 LDA     #BRIGHT
1324
1325  060B  CD 0B F3       PD2    JSR     BIGD
1326
1327  060E  1A 55                 BSET    RJ,FLAG2        * RIGHT JUSTIFY THE LAST TWO
1328  0610  19 55                 BCLR    LJ,FLAG2
1329
1330  0612  A6 26                 LDA     #$26
1331  0614  B7 41                 STA     APLO
1332  0616  A6 06                 LDA     #$6
1333  0618  B7 40                 STA     APHI
1334
1335  061A  9F                    TXA
1336  061B  40                    NEGA
1337  061C  AB 12                 ADD     #18
1338  061E  97                    TAX
1339  061F  D6 14 03              LDA     PERIAB,X
1340  0622  44                    LSRA
1341  0623  44                    LSRA
1342  0624  44                    LSRA
1343  0625  44                    LSRA
1344
1345  0626  01 35 02              BRCLR   DIR,BUTTON,PD21 * DISPLAY DIGITS IF RIGHT (LOW)
1346  0629  A6 0D                 LDA     #BLANK          * BLANK IF LEFT
1347
1348  062B  CD 0B F3       PD21   JSR     BIGD
1349
1350  062E  A6 29                 LDA     #$29
1351  0630  B7 41                 STA     APLO
1352  0632  A6 06                 LDA     #$6
1353  0634  B7 40                 STA     APHI
1354
1355  0636  D6 14 03              LDA     PERIAB,X
1356  0639  A4 0F                 AND     #$F
1357
1358  063B  01 35 02              BRCLR   DIR,BUTTON,PD22
1359  063E  A6 0D                 LDA     #BLANK
```

```
GO

0640   CD 0B F3        PD2    JSR     BIGD
0643   1D 55                  BCLR    RJ.FLAG2        * CENTER JUSTIFY THE ARROWS
0645   19 55                  BCLR    LJ.FLAG2
0647   A6 21                  LDA     #$21            * DO LEFT ARROW
0649   B7 41                  STA     APLO
064B   A6 0B                  LDA     #$B
064D   B7 40                  STA     APHI
064F   A6 0A                  LDA     #LARRO
0651   0D 35 02               BRSET   DIR.BUTTON,PD3  * LEFT OR RIGHT?
0654   A6 0D                  LDA     #BLANK
0656   CD 0B F3        PD3    JSR     BIGD
0659   A6 30                  LDA     #$30            * DO RIGHT ARROW
065B   B7 41                  STA     APLO
065D   A6 0B                  LDA     #$B
065F   B7 40                  STA     APHI
0661   A6 0B                  LDA     #RARRO
0663   01 35 02               BRCLR   DIR.BUTTON,PD4
0666   A6 0D                  LDA     #BLANK
0668   CD 0B F3        PD4    JSR     BIGD
066B   1B 55                  BSET    LJ.FLAG2        * LEFT JUSTIFY THE TEE
066D   A6 29                  LDA     #$29
066F   B7 41                  STA     APLO
0671   A6 0B                  LDA     #$B
0673   B7 40                  STA     APHI
0675   A6 0C                  LDA     #TEE
0677   0B 54 02               BRSET   ZAP.FLAG3,PD5
067A   A6 0D                  LDA     #BLANK
067C   CD 0B F3        PD5    JSR     BIGD
067F   19 55                  BCLR    LJ.FLAG2        * CENTER JUSTIFY THE MIDDLE CHRS
0681   1B 55                  BCLR    RJ.FLAG2
0683   A6 97                  LDA     #$97
0685   B7 41                  STA     APLO
0687   A6 01                  LDA     #$1
0689   B7 40                  STA     APHI
068B   B6 36                  LDA     FACPHI          * GET RATIOS
068D   BE 37                  LDX     FACPLO
068F   CD 09 74               JSR     LEFIT
0692   A6 10                  LDA     #LFOOT
0694   CD 0C 9A               JSR     BIGFOOT
```

```
GO

0697   A6 9A                 LDA     #$9A
0699   B7 41                 STA     APLO
069B   A6 01                 LDA     #$1
069D   B7 40                 STA     APHI

069F   CD 07 C1              JSR     RIGHTT

06A2   A6 11                 LDA     #$4001
06A4   CD 0C 9A              JSR     DIGIT01

06A7   1D 54                 BCLR    DISP,FLAG2
06A9   81                    RTS


                    ********************************
                    *                              *
                    *                              *
                    *     CONTRAST SET DISPLAY     *
                    *                              *
                    *                              *
                    ********************************


06AA   AE 08        CONDISP  LDX     #CM$          * CONTRAST SET MODE TEXT STRING
06AC   CD 0D 41              JSR     GSTRING

06AF   20 05                 BRA     SD1           * THEN ACT LIKE TARGET SET DISPLAY


                    ********************************
                    *                              *
                    *                              *
                    *   TARGET SET MODE DISPLAY    *
                    *                              *
                    *                              *
                    ********************************


06B1   AE 04        SETDISP  LDX     #SM$          * SET MODE TEXT STRING
06B3   CD 0D 41              JSR     GSTRING

06B6   18 55        SD1      BSET    LJ,FLAG2      * LEFT JUSTIFY THE FIRST TWO
06B8   1B 55                 BCLR    RJ,FLAG2

06BA   A6 18                 LDA     #$18
06BC   B7 41                 STA     APLO
06BE   A6 06                 LDA     #$6
06C0   B7 40                 STA     APHI

06C2   B6 3D                 LDA     TARGET        * GET CURRENT LZR DISTRIBUTION
06C4   A4 1F                 AND     #$1F
06C6   97                    TAX
06C7   D6 14 03              LDA     PERIAD,X
06CA   44                    LSRA
06CB   44                    LSRA
06CC   44                    LSRA
```

```
60

06CD   44                  LSRA
06CE   CD 0B F3            JSR     BIGD

06D1   A6 1B               LDA     #$1B
06D3   B7 41               STA     APLO
06D5   A6 06               LDA     #$6
06D7   B7 40               STA     APHI

06D9   D6 14 03            LDA     PERTAB,X
06DC   A4 0F               AND     #$F
06DE   CD 0B F3            JSR     BIGD

06E1   19 55               BCLR    LJ.FLAG2        * RIGHT JUSTIFY THE FIRST CENTER WORD
06E3   1A 55               BSET    RJ.FLAG2

06E5   A6 1F               LDA     #$1F
06E7   B7 41               STA     APLO
06E9   A6 06               LDA     #$6
06EB   B7 40               STA     APHI

06ED   A6 0E               LDA     #$0EFT

06EF   CD 0B F3            JSR     BIGD

06F2   1B 55               BCLR    RJ.FLAG2        * LEFT JUSTIFY THE SECOND CENTER WORD
06F4   19 55               BSET    LJ.FLAG2

06F6   A6 22               LDA     #$22
06F8   B7 41               STA     APLO
06FA   A6 06               LDA     #$6
06FC   B7 40               STA     APHI

06FE   A6 0F               LDA     #$0RIGHT

0700   CD 0B F3            JSR     BIGD

0703   1A 55               BSET    RJ.FLAG2        * RIGHT JUSTIFY THE LAST TWO
0705   19 55               BCLR    LJ.FLAG2

0707   A6 26               LDA     #$26
0709   B7 41               STA     APLO
070B   A6 06               LDA     #$6
070D   B7 40               STA     APHI

070F   9F                  TXA
0710   40                  NEGA
0711   AB 12               ADD     #18
0713   97                  TAX
0714   D6 14 03            LDA     PERTAB,X
0717   44                  LSRA
0718   44                  LSRA
0719   44                  LSRA
071A   44                  LSRA
071B   CD 0B F3            JSR     BIGD
```

```
      60

1531  071E  A6 29                 LDA   #$29
1532  0720  B7 41                 STA   APLO
1533  0722  A6 06                 LDA   #$6
1534  0724  B7 40                 STA   APHI
1535
1536  0726  D6 14 03              LDA   FERTAB,X
1537  0729  A4 0F                 AND   #$F
1538  072B  CD 0B F3              JSR   BIGD
1539
1540  072E  1B 55                 BCLR  RJ,FLAG2          * CENTER JUSTIFY THE ARROWS
1541
1542  0730  A6 21                 LDA   #$21              * DO LEFT ARROW
1543  0732  B7 41                 STA   APLO
1544  0734  A6 08                 LDA   #$8
1545  0736  B7 40                 STA   APHI
1546
1547  073B  A6 0A                 LDA   #LARRO
1548  073A  00 35 02              BRSET DIR,BUTTON,SD3    * LEFT OR RIGHT
1549  073D  A6 0D                 LDA   #BLANK
1550
1551  073F  CD 0B F3        SD3   JSR   BIGD
1552
1553  0742  A6 30                 LDA   #$30              * DO RIGHT ARROW
1554  0744  B7 41                 STA   APLO
1555  0746  A6 08                 LDA   #$8
1556  0748  B7 40                 STA   APHI
1557
1558  074A  A6 0B                 LDA   #RARRO
1559  074C  01 35 02              BRCLR DIR,BUTTON,SD4
1560  074F  A6 0D                 LDA   #BLANK
1561
1562  0751  CD 0B F3        SD4   JSR   BIGD
1563
1564  0754  1B 55                 BSET  LJ,FLAG2          * LEFT JUSTIFY THE TEE
1565
1566  0756  A6 29                 LDA   #$29
1567  0758  B7 41                 STA   APLO
1568  075A  A6 08                 LDA   #$8
1569  075C  B7 40                 STA   APHI
1570
1571  075E  A6 0C                 LDA   #TEE
1572
1573  0760  CD 0B F3              JSR   BIGD
1574
1575
1576  0763  19 55                 BCLR  LJ,FLAG2          * CENTER JUSTIFY THE MIDDLE CHRS
1577  0765  1B 55                 BCLR  RJ,FLAG2
1578
1579  0767  A6 97                 LDA   #$97
1580  0769  B7 41                 STA   APLO
1581  076B  A6 01                 LDA   #$1
1582  076D  B7 40                 STA   APHI
1583
1584  076F  B6 3D                 LDA   TARGET            * GET L/R
1585  0771  AA 40                 ORA   #$40              * SET L&R TOE/HEEL TO 50%
1586  0773  AE 4A                 LDX   #$4A
1587
```

```
GO

0775   CD 09 74                JSR     LEFTF
0778   A6 10                   LDA     #LFOOT
077A   CD 0C 9A                JSR     BIGFOOT

077D   A6 9A                   LDA     #$9A
077F   B7 41                   STA     APLO
0781   A6 01                   LDA     #$1
0783   B7 40                   STA     APHI

0785   CD 09 C1                JSR     RIGHTF

0788   A6 11                   LDA     #RFOOT
078A   CD 0C 9A                JSR     BIGFOOT

078D   1D 54                   BCLR    DISP.FLAGS
078F   81                      RTS


                        ********************************
                        *                              *
                        *                              *
                        *   RESTART DELAY SET DISPLAY  *
                        *                              *
                        *                              *
                        ********************************


0790   AE 26            DELDISP LDX    #DM%             * SET MODE TEXT STRING
0792   CD 0D 41                JSR     GSTRING


0795   19 55                   BCLR    LJ.FLAG2         * CENTER JUSTIFY THE CENTER BLOCKS
0797   1B 55                   BCLR    RJ.FLAG2

0799   A6 1F                   LDA     #$1F
079B   B7 41                   STA     APLO
079D   A6 06                   LDA     #$6
079F   B7 40                   STA     APHI

07A1   BE 3F                   LDX     DELAY            * GET DELAY TIME POINTER
07A3   D6 14 03                LDA     PERTAB.X         * GET DIGITS FROM PERCENTAGE TABLE
07A6   44                      LSRA
07A7   44                      LSRA
07A8   44                      LSRA
07A9   44                      LSRA

07AA   CD 0B F3                JSR     BIGD

07AD   A6 22                   LDA     #$22
07AF   B7 41                   STA     APLO
07B1   A6 06                   LDA     #$6
07B3   B7 40                   STA     APHI

07B5   D6 14 03                LDA     PERTAB.X
07B8   A4 0F                   AND     #$F
```

```
60

07BA   CD 0B F3                JSR     BIGD

07BD   1D 54                   BCLR    DISP.FLAGS
07BF   81                      RTS


                        ******************************
                        *                            *
                        *                            *
                        *        BARS DISPLAY        *
                        *                            *
                        *                            *
                        ******************************

07C0   AE 12            BARS   LDX     #BD$
07C2   02 35 02                BRSET   AMS.BUTTON,BARS0     * DISPLAY 'RESET' IF IN MANUAL
07C5   AE 14                   LDX     #HA$                 * 'AUTO' IF IN AUTO

07C7   CD 0D 41         BARS0  JSR     GSTRING
                                                            * LABEL WHICH FOOT WE'RE SHOWING
07CA   AE 2A                   LDX     #LF$                 * LEFT FOOT?
07CC   0C 55 02                BRSET   LR.FLAG2,BARS01      * SAMPLED DIRECTION BIT
07CF   AE 2C                   LDX     #RF$                 * RIGHT FOOT.

07D1   CD 0D 41         BARS01 JSR     GSTRING

07D4   18 55                   BSET    LJ,FLAG2             * LEFT JUSTIFY THE FIRST TWO
07D6   1B 55                   BCLR    RJ,FLAG2

07D8   A6 18                   LDA     #$18
07DA   B7 41                   STA     APLO
07DC   A6 06                   LDA     #$6
07DE   B7 40                   STA     APHI

07E0   BE 5C                   LDX     FHI                  * LEFT FOOT?
07E2   0C 55 02                BRSET   LR.FLAG2,B1
07E5   BE 5B                   LDX     BLO

07E7   A3 6A            B1     CPX     #106                 * WHICH SEGMENT?
07E9   24 04                   BHS     BARS1

07EB   E6 70                   LDA     BUFFER1,X            * GET FORESWING PEAK VALUE
07ED   20 03                   BRA     BARS15

07EF   D6 00 96         BARS1  LDA     GAP,X

07F2   A4 1F            BARS15 AND     #$1F
07F4   0C 55 03                BRSET   LR.FLAG2,B151        * LEFT FOOT?
07F7   40                      NEGA
07F8   AB 12                   ADD     #18
07FA   97               B151   TAX
07FB   D6 14 03                LDA     PERIOD,X
07FE   44                      LSRA
07FF   44                      LSRA
0800   44                      LSRA
0801   44                      LSRA
```

```
GO

0002   CD 0B F3                JSR     BIGD

0005   A6 1B                   LDA     #$1B
0007   B7 41                   STA     APLO
0009   A6 06                   LDA     #$6
080B   B7 40                   STA     APHI

080D   D6 14 03                LDA     PERTAB,X
0810   A4 0F                   AND     #$F
0812   CD 0B F3                JSR     BIGD

0815   19 55                   BCLR    LJ,FLAG2        * CENTER JUSTIFY THE MIDDLE CHRS
0817   1B 55                   BCLR    RJ,FLAG2

0819   A6 1F                   LDA     #$1F
081B   B7 41                   STA     APLO
081D   A6 06                   LDA     #$6
081F   B7 40                   STA     APHI

0821   BE 5E                   LDX     IMP
0823   A3 6A                   CPX     #106            * WHICH SEGMENT?
0825   24 04                   BHS     BARS2

0827   E6 70                   LDA     BUFFER1,X       * GET IMPACT VALUE
0829   20 03                   BRA     BARS25

082B   D6 00 96        BARS2   LDA     GAP,X
082E   A4 1F           BARS25  AND     #$1F
0830   0C 55 03                BRSET   LR,FLAG2,B251   * LEFT FOOT?
0833   40                      NEGA
0834   AB 12                   ADD     #18
0836   97              B251    TAX
0837   D6 14 03                LDA     PERTAB,X
083A   44                      LSRA
083B   44                      LSRA
083C   44                      LSRA
083D   44                      LSRA
083E   CD 0B F3                JSR     BIGD

0841   A6 22                   LDA     #$22
0843   B7 41                   STA     APLO
0845   A6 06                   LDA     #$6
0847   B7 40                   STA     APHI

0849   D6 14 03                LDA     PERTAB,X
084C   A4 0F                   AND     #$F
084E   CD 0B F3                JSR     BIGD

0851   1A 55                   BSET    RJ,FLAG2        * RIGHT JUSTIFY THE LAST TWO
0853   19 55                   BCLR    LJ,FLAG2

0855   A6 26                   LDA     #$26
0857   B7 41                   STA     APLO
0859   A6 06                   LDA     #$6
085B   B7 40                   STA     APHI

085D   DE 5B                   LDX     RLO
```

```
GO

085F   0C 55 02                 BRSET   LR,FLAG2,B2        * LEFT FOOT?
0862   BE 5C                    LDX     FFU
0864   A3 6A            B2      CPX     #106               * WITCH SQUARE?
0866   24 04                    BHS     BARS3
0868   E6 70                    LDA     BUFFER1,X          * GET BACKSWING PEAK VALUE
086A   20 03                    BRA     BARS35
086C   D6 00 96          BARS3  LDA     GAP,X
086F   A4 1F             BARS35 AND     #$1F
0871   0C 55 03                 BRSET   LR,FLAG2,B351      * LEFT FOOT?
0874   40                       NEGA
0875   AB 12                    ADD     #18
0877   97                B351   TAX
0878   D6 14 03                 LDA     PERTAB,X
087B   44                       LSRA
087C   44                       LSRA
087D   44                       LSRA
087E   44                       LSRA
087F   CD 0B F3                 JSR     BIGD
0882   A6 29                    LDA     #$29
0884   B7 41                    STA     APLO
0886   A6 06                    LDA     #$6
0888   B7 40                    STA     APHI
088A   D6 14 03                 LDA     PERTAB,X
088D   A4 0F                    AND     #$F
088F   CD 0B F3                 JSR     BIGD
0892   1B 55                    BCLR    RJ,FLAG2           * CENTER JUSTIFY THE ARROWS
0894   A6 21                    LDA     #$21               * DO LEFT ARROW
0896   B7 41                    STA     APLO
0898   A6 08                    LDA     #$8
089A   B7 40                    STA     APHI
089C   A6 0A                    LDA     #LARRO
089E   0C 55 02                 BRSET   LR,FLAG2,BARS4     * LEFT OR RIGHT?
08A1   A6 0D                    LDA     #BLANK
08A3   CD 0B F3          BARS4  JSR     BIGD
08A6   A6 30                    LDA     #$30               * DO RIGHT ARROW
08A8   B7 41                    STA     APLO
08AA   A6 08                    LDA     #$8
08AC   B7 40                    STA     APHI
08AE   A6 0B                    LDA     #RARRO
08B0   0D 55 02                 BRCLR   LR,FLAG2,BARS5     * LEFT OR RIGHT?
08B3   A6 0D                    LDA     #BLANK
08B5   CD 0B F3          BARS5  JSR     BIGD
08B8   1B 55                    BSET    LJ,FLAG2           * LEFT JUSTIFY THE ARROW
08BA   A6 29                    LDA     #$29
```

```
GO

08BC   B7 41                    STA     APLO
08BE   A6 00                    LDA     #$0
08C0   B7 40                    STA     APHI

08C2   A6 0C                    LDA     #1EE
08C4   CD 0B F3                 JSR     BIOD


                        * NOW VOTE WITH YOUR FEET


08C7   1B 55                    BSET    LJ.FLAG2        * LEFT JUSTIFY THE FIRST TWO
08C9   1B 55                    BCLR    RJ.FLAG2

08CB   A6 90                    LDA     #$90
08CD   B7 41                    STA     APLO
08CF   A6 01                    LDA     #$1
08D1   B7 40                    STA     APHI

08D3   BE 5C                    LDX     FHI
08D5   0C 55 02                 BRSET   LR.FLAG2,B3
08D8   BE 5B                    LDX     BLO

08DA   A3 6A            B3      CPX     #106            * WHICH SEGMENT?
08DC   24 06                    BHS     BARS6

08DE   E6 70                    LDA     BUFFER1,X       * GET FORESWING PEAK VALUE
08E0   EE 71                    LDX     BUFFER1+1,X
08E2   20 06                    BRA     BARS65

08E4   D6 00 96         BARS6   LDA     GAP,X
08E7   DE 00 97                 LDX     GAP+1,X

08EA   CD 09 74         BARS65  JSR     LEFTF           * CALCULATE LEFT FOOT FILLS

08ED   A6 10                    LDA     #LFOOT
08EF   CD 0C 9A                 JSR     BIGFOOT

08F2   A6 93                    LDA     #$93
08F4   B7 41                    STA     APLO
08F6   A6 01                    LDA     #$1
08F8   B7 40                    STA     APHI

08FA   CD 09 C1                 JSR     RIGHTF

08FD   A6 11                    LDA     #RFOOT
08FF   CD 0C 9A                 JSR     BIGFOOT

0902   19 55                    BCLR    LJ.FLAG2        * CENTER JUSTIFY THE MIDDLE CLUS
0904   1B 55                    BCLR    RJ.FLAG2

0906   A6 97                    LDA     #$97
0908   B7 41                    STA     APLO
090A   A6 01                    LDA     #$1
090C   B7 40                    STA     APHI

090E   BE 5E                    LDX     IMP
```

```
GO

0910   A3 6A                 CPX   #106          * WHICH SEGMENT?
0912   24 06                 BHS   BARS7
0914   E6 70                 LDA   BUFFER1,X     * GET IMPACT VALUE
0916   EE 71                 LDX   BUFFER1+1,X
0918   20 06                 BRA   BARS75
091A   D6 00 96      BARS7   LDA   GAP,X
091D   DE 00 97              LDX   GAP+1,X
0920   CD 09 74      BARS75  JSR   LEFTF
0923   A6 10                 LDA   #LFOOT
0925   CD 0C 9A              JSR   BIGFOOT
0928   A6 9A                 LDA   #$9A
092A   B7 41                 STA   APLO
092C   A6 01                 LDA   #1
092E   B7 40                 STA   APHI
0930   CD 09 C1              JSR   RIGHTF
0933   A6 11                 LDA   #RFOOT
0935   CD 0C 9A              JSR   BIGFOOT
0938   1A 55                 BSET  RJ.FLAG2      * RIGHT JUSTIFY THE LAST TWO
093A   19 55                 BCLR  LJ.FLAG2
093C   A6 9E                 LDA   #$9E
093E   B7 41                 STA   APLO
0940   A6 01                 LDA   #$1
0942   B7 40                 STA   APHI
0944   BE 5B                 LDX   HLO
0946   0C 55 02              BRSET LR.FLAG2,B4   * LEFT FOOT?
0949   BE 5C                 LDX   HHI
094B   A3 6A         B4      CPX   #106          * WHICH SEGMENT?
094D   24 06                 BHS   BARS8
094F   E6 70                 LDA   BUFFER1,X     * GET BACKSWING PEAK VALUE
0951   EE 71                 LDX   BUFFER1+1,X
0953   20 06                 BRA   BARS85
0955   D6 00 96      BARS8   LDA   GAP,X
0958   DE 00 97              LDX   GAP+1,X
095B   CD 09 74      BARS85  JSR   LEFTF
095E   A6 10                 LDA   #LFOOT
0960   CD 0C 9A              JSR   BIGFOOT
0963   A6 A1                 LDA   #$A1
0965   B7 41                 STA   APLO
0967   A6 01                 LDA   #$1
0969   B7 40                 STA   APHI
096D   CD 09 C1              JSR   RIGHTF
```

```
096E   A6 11          LDA     #$7001
0970   CD 0C 9A       JSR     BTGFOOT

0973   81             RTS


                 ********************************
                 *                              *
                 *                              *
                 *  BAR GRAPH FILL COMPUTATIONS *
                 *                              *
                 *                              *
                 ********************************


                 * COMPUTE FILL FOR LEFT FOOT

0974   B7 38      LEFTF   STA     FOOTHI
0976   BF 39              STX     FOOTLO

                 * PROCESS THE LEFT TOE/HEEL FILL DATA

097B   BE 39              LDX     FOOTLO          * GET LEFT TOE PERCENTAGE
097A   54                 LSRX
097B   54                 LSRX
097C   54                 LSRX                    * RIGHT JUSTIFY IT IN CXT
097D   A6 0E              LDA     #14             * FM  BINARY FRACTION STUFF
097F   42                 MUL
0980   97                 TAX
0981   49                 ROLA                    * COMPENSATE RESULT SINCE 14*18=252
0982   24 02              BCC     ?1
0984   5C                 INX
0985   5C                 INX
0986   49        ?1      ROLA
0987   24 01              BCC     ?2
0989   5C                 INX
098A   B6 38      ?2      LDA     FOOTHI          * GET LEFT FOOT PERCENTAGE
098C   A4 1F              AND     #$1F
098E   42                 MUL
098F   4D                 TSTA
0990   2A 01              BPL     ?3              * ROUND IT UP
0992   5C                 INX
0993   9F        ?3      TXA
0994   40                 NEGA
0995   AB 13              ADD     #19
0997   48                 ASLA
0998   B7 5F              STA     FILLON

099A   B6 39              LDA     FOOTLO          * GET LEFT TOE PERCENTAGE
099C   44                 LSRA
099D   44                 LSRA
099E   44                 LSRA                    * RIGHT JUSTIFY IT IN DAJ
099F   40                 NEGA
09A0   AB 12              ADD     #18             * MAKE INTO LEFT HEEL PERCENTAGE

09A2   97                 TAX
```

```
09A3   A6 0E                LDA     #14          * FM  BINARY FRACTION STUFF
09A5   42                   MUL
09A6   97                   TAX
09A7   49                   ROLA                 * COMPENSATE RESULT SINCE 14*18=252
09A8   24 02                BCC     ?4
09AA   5C                   INX
09AB   5C                   INX
09AC   49            ?4     ROLA
09AD   24 01                BCC     ?5
09AF   5C                   INX
09B0   B6 38         ?5     LDA     FOOTHI       * GET LEFT FOOT PERCENTAGE
09B2   A4 1F                AND     #$1F
09B4   42                   MUL
09B5   4D                   TSTA
09B6   2A 01                BPL     ?6           * ROUND IT UP
09B8   5C                   INX
09B9   9F            ?6     TXA

09BA   AB 16                ADD     #22
09BC   48                   ASLA
09BD   4C                   INCA
09BE   B7 60                STA     FILLOFF

09C0   81                   RTS


                     * COMPUTE FILL FOR RIGHT FOOT


09C1   BE 38         RIGHTF LDX     FOOTHI       * GET RIGHT TOE PERCENTAGE
09C3   B6 39                LDA     FOOTLO
09C5   A4 07                AND     #7
09C7   50                   LSLX
09C8   49                   ROLA
09C9   58                   LSLX
09CA   49                   ROLA
09CB   97                   TAX

09CC   A6 0E                LDA     #14          * FM  BINARY FRACTION STUFF
09CE   42                   MUL
09CF   97                   TAX
09D0   49                   ROLA                 * COMPENSATE RESULT SINCE 14*18=252
09D1   24 02                BCC     ?1
09D3   5C                   INX
09D4   5C                   INX
09D5   49            ?1     ROLA
09D6   24 01                BCC     ?2
09D8   5C                   INX
09D9   B6 38         ?2     LDA     FOOTHI       * GET LEFT FOOT PERCENTAGE
09DB   A4 1F                AND     #$1F
09DD   40                   NEGA                 * MAKE RIGHT FOOT PERCENTAGE
09DE   AB 12                ADD     #18
09E0   42                   MUL
09E1   4D                   TSTA
09E2   2A 01                BPL     ?3           * ROUND IT UP
09E4   5C                   INX
09E5   9F            ?3     TXA
```

60

```
09E6   40                 NEGA
09E7   AB 13              ADD     #19
09E9   48                 ASLA
09EA   B7 5F              STA     FILLON

09FC   BE 38              LDX     FOOTHT          * GET RIGHT TOE PERCENTAGE
09EE   B6 39              LDA     FOOTLO
09F0   A4 07              AND     #7
09F2   58                 LSLX
09F3   49                 ROLA
09F4   58                 LSLX
09F5   49                 ROLA
09F6   40                 NEGA
09F7   AB 12              ADD     #18             * MAKE INTO RIGHT HEEL PERCENTAGE
09F9   97                 TAX

09FA   A6 0E              LDA     #14             * FM  BINARY FRACTION STUFF
09FC   42                 MUL
09FD   97                 TAX
09FE   49                 ROLA                    * COMPENSATE RESULT SINCE 14*18 >5
09FF   24 02              BCC     ?4
0A01   5C                 INX
0A02   5C                 INX
0A03   49          ?4     ROLA
0A04   24 01              BCC     ?5
0A06   5C                 INX
0A07   B6 38       ?5     LDA     FOOTHT          * GET LEFT FOOT PERCENTAGE
0A09   A4 1F              AND     #$1F
0A0B   40                 NEGA                    * MAKE RIGHT FOOT PERCENTAGE
0A0C   AB 12              ADD     #18

0A0E   42                 MUL
0A0F   4D                 TSTA
0A10   2A 01              BPL     ?6              * ROUND IT UP
0A12   5C                 INX
0A13   9F          ?6     TXA

0A14   AB 16              ADD     #22
0A16   48                 ASLA
0A17   4C                 INCA
0A18   B7 60              STA     FILLOFF

0A1A   81                 RTS


                   ********************************
                   *                              *
                   *                              *
                   *       GET WEIGHT PEAKS       *
                   *         FROM BUFFER          *
                   *                              *
                   ********************************


                   * THIS ROUTINE GOES THROUGH THE BUFFERED DATA AND FINDS THE PEAKS.
                   * STARTS AT BPOINT AND RETURNS POINTERS IN DH1, DH0, FH1, FH0 AND LNP
                   * DURING THE BACKSWING WE LOOK FOR >= AND <=. DURING THE FORESWING
```

```
                                 * JUST > AND <. THIS WILL GIVE THE PEAK VALUES CLOSEST TO IMPACT! IN
                                 * CASE OF IDENTICAL PEAK VALUES, SINCE WE'RE GOING FORWARD AND THROUGH
                                 * THE SWING, WE'LL TAKE THE LAST PEAK VALUE IN THE BACKSWING AND THE FIRST
                                 * PEAK VALUE IN THE FORESWING. SINCE WE ARE STORING THE LEFT FOOT VALUES
                                 * IN THE BUFFER, WE CHECK THE DIRECTION FLAG BEFORE LEAVING: IF RIGHT
                                 * FOOT, WE SWAP THE BHI AND BLO, THEN SWAP FHI AND FLO.

0A1B   A6 32                GETPEAK  LDA     #50                 * SAMPLE COUNTER
0A1D   B7 4E                         STA     NUM

0A1F   3F 62                         CLR     RAH                 * HIGH VALUE TEMP
0A21   A6 FF                         LDA     #$FF
0A23   B7 63                         STA     RAL                 * LOW VALUE TEMP

0A25   BE 4A                         LDX     BPOINT              * BEGINNING OF BACKSWING

0A27   A3 6A                GP1      CPX     #106                * UPPER OR LOWER SEGMENT?
0A29   24 04                         BHS     GP2

0A2B   E6 70                         LDA     BUFFER1,X           * GET THE HIGH DATA BYTE
0A2D   20 03                         BRA     GP3

0A2F   D6 00 96             GP2      LDA     GAP,X
0A32   A4 1F                GP3      AND     #$1F                * LOW 5 BITS ARE L/(L+R)

0A34   B1 62                         CMP     RAH                 * >= TO EXISTING HIGH PEAK VALUE?
0A36   25 04                         BLO     GP4

0A38   B7 62                         STA     RAH                 * IF SO, UPDATE VALUE AND POINTER
0A3A   BF 5A                         STX     BHI

0A3C   B1 63                GP4      CMP     RAL                 * <= TO EXISTING LOW PEAK VALUE?
0A3E   22 04                         BHI     GP5

0A40   B7 63                         STA     RAL                 * IF SO, UPDATE VALUE AND POINTER
0A42   BF 5B                         STX     BLO

0A44   5C                   GP5      INX                         * NEXT BUCKET
0A45   5C                            INX
0A46   A3 C8                         CPX     #200                * TIME TO WRAP?
0A48   25 01                         BLO     GP6

0A4A   5F                            CLRX

0A4B   3A 4E                GP6      DEC     NUM                 * DONE WITH BACKSWING YET?
0A4D   26 D8                         BNE     GP1                 * IF NOT.


                                 * HERE WE ARE AT THE IMPACT POINT


0A4F   BF 5E                         STX     IMP                 * SAVE IMPACT POINTER

0A51   5C                            INX                         * NEXT BUCKET
0A52   5C                            INX
0A53   A3 C8                         CPX     #200                * WRAP?
```

```
GO

0A55   25 01                 BLO     GP65
0A57   5F                    CLRX                          * WRAP.
0A58   3F 62        GP65     CLR     RAH                   * RESET THE TEMPS
0A5A   A6 FF                 LDA     #$FF
0A5C   B7 63                 STA     RAL

0A5E   A3 6A        GP7      CPX     #106                  * UPPER OR LOWER SEGMENT?
0A60   24 04                 BHS     GP8
0A62   E6 70                 LDA     BUFFER1,X             * GET THE HIGH DATA BYTE
0A64   20 03                 BRA     GP9
0A66   D6 00 96     GP8      LDA     GAP,X
0A69   A4 1F        GP9      AND     #$1F                  * LOW 5 BITS ARE L/(L+R)
0A6B   B1 62                 CMP     RAH                   * > EXISTING HIGH PEAK VALUE?
0A6D   23 04                 BLS     GP10
0A6F   B7 62                 STA     RAH                   * IF SO, UPDATE VALUE AND POINTER
0A71   BF 5C                 STX     RHI
0A73   B1 63        GP10     CMP     RAL                   * < EXISTING LOW PEAK VALUE?
0A75   24 04                 BHS     GP11
0A77   B7 63                 STA     RAL                   * IF SO, UPDATE VALUE AND POINTER
0A79   BF 5D                 STX     RLO
0A7B   5C           GP11     INX                           * NEXT BUCKET
0A7C   5C                    INX
0A7D   A3 C8                 CPX     #200                  * TIME TO WRAP?
0A7F   25 01                 BLO     GP12
0A81   5F                    CLRX
0A82   B3 4A        GP12     CPX     DPOINT                * GONE ALL THE WAY AROUND?
0A84   26 D8                 BNE     GP7                   * IF NOT.
0A86   00 35 10              BRSET   DIR,BUTTON,GP13       * IF LEFT, WE'RE DONE.
0A89   B6 5A                 LDA     RHI                   * ELSE SWAP THE HIGH AND LOW POINTERS.
0A8B   BE 5B                 LDX     RLO
0A8D   B7 5B                 STA     RLO
0A8F   BF 5A                 STX     RHI
0A91   B6 5C                 LDA     RHI
0A93   BE 5D                 LDX     RLO
0A95   B7 5D                 STA     RLO
0A97   BF 5C                 STX     RHI
0A99   81           GP13     RTS

                             ******************************
                             *                            *
```

```
GO

                                *                                *
                                *    LCD DRIVER SUBROUTINES      *
                                *                                *
                                *                                *
                                ***********************************

                                * STATUS READ COMMANDS PRESERVE ALL REGISTERS.

0A9A   10 01                    RSTAT01  BSET     0,PORTB          * COMMAND
0A9C   15 01                             BCLR     2,PORTB          * /READ
0A9E   16 01                             BSET     3,PORTB          * WRITE
0AA0   13 01                             BCLR     1,PORTB          * /CE
0AA2   01 02 FD                 ?1       BRCLR    0,PORTC,?1
0AA5   03 02 FA                          BRCLR    1,PORTC,?1
0AA8   12 01                             BSET     1,PORTB          * DESELECT
0AAA   81                                RTS

0AAB   10 01                    RSTAT3   BSET     0,PORTB          * COMMAND
0AAD   15 01                             BCLR     2,PORTB          * /READ
0AAF   16 01                             BSET     3,PORTB          * WRITE
0AB1   13 01                             BCLR     1,PORTB          * /CE
0AB3   07 02 FD                 ?1       BRCLR    3,PORTC,?1
0AB6   12 01                             BSET     1,PORTB          * DESELECT
0AB8   81                                RTS

                                * READ STATUS BIT 5 RETURNS BIT 5 IN CARRY - NO WAITING.

0AB9   10 01                    RSTAT5   BSET     0,PORTB          * COMMAND
0ABB   15 01                             BCLR     2,PORTB          * /READ
0ABD   16 01                             BSET     3,PORTB          * WRITE
0ABF   13 01                             BCLR     1,PORTB          * /CE
0AC1   0A 02 00                          BRSET    5,PORTC,?1
0AC4   12 01                    ?1       BSET     1,PORTB          * DESELECT
0AC6   81                                RTS


                                * ALL WRITE ROUTINES ASSUME THAT CDDR IS CLEARED ON ENTRY AND LEAVE IT
                                * CLEARED ON EXIT. ALL REGISTERS PRESERVED.

0AC7   AD D1                    WCMD     BSR      RSTAT01
0AC9   B7 02                             STA      PORTC            * COMMAND TO PORT BITS
0ACB   10 01                             BSET     0,PORTB          * COMMAND
0ACD   14 01                             BSET     2,PORTB          * READ
0ACF   16 01                             BSET     3,PORTB          * WRITE
0AD1   13 01                             BCLR     1,PORTB          * /CE
0AD3   3A 06                             DEC      CDDR             * PORTC OUTPUTS ( $FF )
0AD5   17 01                             BCLR     3,PORTB          * /WRITE
0AD7   16 01                             BSET     3,PORTB
0AD9   3F 06                             CLR      CDDR             * PORTC INPUTS ( 0 )
0ADB   12 01                             BSET     1,PORTB          * DESELECT
0ADD   81                                RTS
```

60

```
0ADE   AD BA        WDAT     BSR      RSTAT01
0AE0   B7 02                 STA      PORTC          * DATA TO PORT BITS
0AE2   11 01                 BCLR     0,PORTB        * /DATA
0AE4   14 01                 BSET     2,PORTB        * READ
0AE6   16 01                 BSET     3,PORTB        * WRITE
0AE8   13 01                 BCLR     1,PORTB        * /CE
0AEA   3A 06                 DEC      CDDR           * PORTC OUTPUTS ( $FF )
0AEC   17 01                 BCLR     3,PORTB        * /WRITE
0AEE   16 01                 BSET     3,PORTB
0AF0   3F 06                 CLR      CDDR           * PORTC INPUTS ( 0 )
0AF2   12 01                 BSET     1,PORTB        * DESELECT
0AF4   81                    RTS

0AF5   AD B4        WAUTO    BSR      RSTAT3
0AF7   B7 02                 STA      PORTC          * DATA TO PORT BITS
0AF9   11 01                 BCLR     0,PORTB        * /DATA
0AFB   14 01                 BSET     2,PORTB        * READ
0AFD   16 01                 BSET     3,PORTB        * WRITE
0AFF   13 01                 BCLR     1,PORTB        * /CE
0B01   3A 06                 DEC      CDDR           * PORTC OUTPUTS ( $FF )
0B03   17 01                 BCLR     3,PORTB        * /WRITE
0B05   16 01                 BSET     3,PORTB
0B07   3F 06                 CLR      CDDR           * PORTC INPUTS ( 0 )
0B09   12 01                 BSET     1,PORTB        * DESELECT
0B0B   81                    RTS


                    ********************************
                    *                              *
                    *                              *
                    *   INITIALIZE THE LCD MODULE  *
                    *                              *
                    *                              *
                    ********************************


                    * CHECK TO SEE THAT THE DISPLAY PROCESSOR POWERED UP OK.

0B0C   A6 02        DINIT    LDA      #2             * 40 mSEC OUGHT TO BE ENOUGH..
0B0E   B7 4B                 STA      TOTIME

0B10   AD A7        DINIT1   BSR      RSTAT5         * CHECK RESET OK
0B12   25 09                 BCS      DINIT2         * OK IF SET
0B14   3D 4B                 TST      TOTIME         * TIME OUT YET?
0B16   26 F8                 BNE      DINIT1         * LOOP IF NO
0B18   A6 07                 LDA      #DTOERR        * DISPLAY TIMEOUT ERROR
0B1A   CC 13 61              JMP      FUBAR          * COMPLAIN

                    * NOW SET THE HOME POSITION AND AREA REGISTERS AND THE CG OFFSET REGISTER.

0B1D   A6 80        DINIT2   LDA      #$80           * MODE SET COMMAND
0B1F   AD A6                 BSR      WCMD           * CG = ROM/RAM
                                                     * GRAPHICS.OR.TEXT

0B21   A6 00                 LDA      #0             * TEXT HOME POSITION LOW
0B23   AD B9                 BSR      WDAT
```

```
GO

0B25   A6 0A          LDA   #$A        * TEXT HOME POSITION HIGH
0B27   AD B5          BSR   WDAT
0B29   A6 40          LDA   #$40       * SET TEXT HOME ADDRESS CMD
0B2B   AD 9A          BSR   WCMD

0B2D   A6 14          LDA   #$14       * TEXT AREA LOW
0B2F   AD AD          BSR   WDAT
0B31   A6 00          LDA   #0         * TEXT AREA HIGH
0B33   AD A9          BSR   WDAT
0B35   A6 41          LDA   #$41       * SET TEXT AREA COMMAND
0B37   AD BE          BSR   WCMD

0B39   A6 00          LDA   #0         * GRAPHICS HOME POSITION LOW
0B3B   AD A1          BSR   WDAT
0B3D   A6 00          LDA   #0         * GRAPHICS HOME POSITION HIGH
0B3F   AD 9D          BSR   WDAT
0B41   A6 42          LDA   #$42       * SET GRAPHICS HOME CMD
0B43   AD B2          BSR   WCMD

0B45   A6 14          LDA   #$14       * GRAPHICS AREA LOW
0B47   AD 95          BSR   WDAT
0B49   A6 00          LDA   #0         * GRAPHICS AREA HIGH
0B4B   AD 91          BSR   WDAT
0B4D   A6 43          LDA   #$43       * SET GRAPHICS AREA COMMAND
0B4F   CD 0A C7       JSR   WCMD

0B52   A6 01          LDA   #1         * OFFSET REGISTER LOW
0B54   AD B8          BSR   WDAT
0B56   A6 00          LDA   #0         * OFFSET REGISTER HIGH
0B58   AD B4          BSR   WDAT
0B5A   A6 22          LDA   #$22       * SET OFFSET REGISTER CMD
0B5C   CD 0A C7       JSR   WCMD

0B5F   81             RTS


                 ********************************
                 *                              *
                 *                              *
                 *    CLEAR THE DISPLAY SCREEN  *
                 *                              *
                 *                              *
                 ********************************


                 * CLEAR THE TWO TEXT SCREENS.

0B60   A6 00     CLS  LDA   #0         * TEXT POINTER LOW
0B62   CD 0A DE       JSR   WDAT       * DO UPPER HALF OF SCREEN
0B65   A6 0A          LDA   #$0A
0B67   CD 0A DE       JSR   WDAT
0B6A   A6 24          LDA   #$24       * SET ADDRESS POINTER CMD
0B6C   CD 0A C7       JSR   WCMD

0B6F   A6 B0          LDA   #$B0       * ENTER AUTO WRITE
0B71   CD 0A C7       JSR   WCMD
```

```
        80

2386
2387    0B74    AE A0                   LDX     #160            * 20*8-1
2388    0B76    4F                      CLRA                    * SPACES
2389    0B77    CD 0B EC                JSR     DOXA            * AUTO WRITE [A], [X] TIMES
2390
2391    0B7A    A6 B2                   LDA     #$B2            * EXIT AUTO MODE
2392    0B7C    CD 0A C7                JSR     WCMD
2393
2394    0B7F    A6 00                   LDA     #0              * TEXT POINTER LOW
2395    0B81    CD 0A DE                JSR     WDAT            * DO LOWER HALF OF SCREEN
2396    0B84    A6 BA                   LDA     #$BA
2397    0B86    CD 0A DE                JSR     WDAT
2398    0B89    A6 24                   LDA     #$24            * SET ADDRESS POINTER CMD
2399    0B8B    CD 0A C7                JSR     WCMD
2400
2401    0B8E    A6 B0                   LDA     #$B0            * ENTER AUTO MODE
2402    0B90    CD 0A C7                JSR     WCMD
2403
2404    0B93    AE A0                   LDX     #160
2405    0B95    4F                      CLRA                    * SPACES
2406    0B96    CD 0B EC                JSR     DOXA            * AUTO WRITE [A], [X] TIMES.
2407
2408    0B99    A6 B2                   LDA     #$B2            * EXIT AUTO MODE
2409    0B9B    CD 0A C7                JSR     WCMD
2410
2411                            * NOW CLEAR THE TWO GRAPHICS SCREENS
2412
2413    0B9E    4F                      CLRA                    * SET GRAPHICS POINTER TO UPPER SCREEN
2414    0B9F    CD 0A DE                JSR     WDAT
2415    0BA2    CD 0A DE                JSR     WDAT
2416    0BA5    A6 24                   LDA     #$24
2417    0BA7    CD 0A C7                JSR     WCMD
2418
2419    0BAA    A6 05                   LDA     #5              * PASSES THROUGH [X]
2420    0BAC    B7 44                   STA     XCOUNT
2421
2422    0BAE    A6 B0                   LDA     #$B0            * ENTER AUTO MODE
2423    0BB0    CD 0A C7                JSR     WCMD
2424
2425    0BB3    A6 00                   LDA     #0              * BITS ALL OFF
2426    0BB5    5F                      CLRX                    * 256 TIMES
2427
2428    0BB6    AD 34           CGLP    BSR     DOXA
2429    0BB8    3A 44                   DEC     XCOUNT
2430    0BBA    26 FA                   BNE     CGLP
2431
2432    0BBC    A6 B2                   LDA     #$B2            * EXIT AUTO MODE
2433    0BBE    CD 0A C7                JSR     WCMD
2434
2435    0BC1    4F                      CLRA                    * SET GRAPHICS POINTER TO LOWER SCREEN
2436    0BC2    CD 0A DE                JSR     WDAT
2437    0BC5    A6 80                   LDA     #$80
2438    0BC7    CD 0A DE                JSR     WDAT
2439    0BCA    A6 24                   LDA     #$24
2440    0BCC    CD 0A C7                JSR     WCMD
2441
2442    0BCF    A6 05                   LDA     #5              * PASSES THROUGH [X]
```

```
GO

0BD1   B7 44                    STA     XCOUNT

0BD3   A6 B0                    LDA     #$B0            * ENTER AUTO MODE
0BD5   CD 0A C7                 JSR     WCMD

0BD8   A6 00                    LDA     #0              * BITS ALL OFF
0BDA   5F                       CLRX                    * 256 TIMES

0BDB   AD 0F            CGLP1   BSR     DOXA
0BDD   3A 44                    DEC     XCOUNT
0BDF   26 FA                    BNE     CGLP1

0BE1   A6 B2                    LDA     #$B2            * EXIT AUTO MODE
0BE3   CD 0A C7                 JSR     WCMD

                        * TURN ON THE TEXT & GRAPHICS MODES AND WE'RE 10 - 8.

0BE6   A6 9C                    LDA     #$9C            * TEXT ON, GRAPHICS ON, CURSOR OFF.
0BE8   CD 0A C7                 JSR     WCMD
0BEB   81                       RTS

0BEC   CD 0A F5         DOXA    JSR     WAUTO           * WRITE [X] WORTH OF [A]
0BEF   5A                       DEX
0BF0   26 FA                    BNE     DOXA
0BF2   81                       RTS

                        ********************************
                        *                              *
                        *                              *
                        *    DISPLAY A BIG DIGIT       *
                        *                              *
                        *                              *
                        ********************************

                        * TO DISPLAY A BIG DIGIT ON THE SCREEN, SET THE ADDRESS POINTER. LOCATIONS
                        * [APHI,APLO] TO THE UPPER LEFT CORNER SCREEN ADDRESS WHERE YOU WANT THE
                        * CHR, SET THE LEFT AND RIGHT JUSTIFY FLAGS (RJ, LJ IN FLAG2), PUT THE
                        * CHARACTER CODE IN [A] AND CALL ME. REGISTERS PRESERVED.

0BF3   B7 49            BIGD    STA     BIGDA
0BF5   BF 48                    STX     BIGDX
0BF7   97                       TAX
0BF8   58                       ASLX                    * X 2 FOR TABLE ADDRESSES
0BF9   D6 18 75                 LDA     DTAB,X          * HIGH CHARACTER ADDRESS
0BFC   B7 62                    STA     RAH             * IT'S SELF - MODIFYING TIME
0BFE   D6 18 76                 LDA     DTAB+1,X
0C01   B7 63                    STA     RAL

0C03   A6 D6                    LDA     #RAMLDA         * GET 2 BYTE LDA NN,X OPCODE
0C05   B7 61                    STA     RAMCODE         * BUILD THE PILE.
0C07   A6 81                    LDA     #RAMRTS
0C09   B7 64                    STA     RAMCODE+3
```

```
GU

0C0B   4F                          CLRA                          * SEND THE CHARACTER'S STARTING WIDTH CAL..
0C0C   CD 0A 75                    JSR     WDAT
0C0F
0C0F   5F                          CLRX
0C10
0C10   BD 61              BIGDL    JSR     RAMCODE               * CALL THE FILE
0C12   0A 55 26                    BRSET   RJ.FLAG,RIGHTJ        * RIGHT JUSTIFY THIS THING?
0C15
0C15                      * PUT THE CHR BITS IN THE LEFT BITMAP TEMPS
0C15
0C15   B7 57                       STA     DOTS1
0C17   5C                          INX
0C18   BD 61                       JSR     RAMCODE
0C1A   B7 58                       STA     DOTS2
0C1C   3F 59                       CLR     DOTS3
0C1E
0C1E                      * IF WE WANT LEFT JUSTIFIED, WE'RE DONE.
0C1E
0C1E   0B 55 23                    BRSET   LJ.FLAG2,OUTDOTS
0C21
0C21                      * CENTER JUSTIFY THE DOTS
0C21
0C21   34 57                       LSR     DOTS1
0C23   36 58                       ROR     DOTS2
0C25   36 59                       ROR     DOTS3
0C27   34 57                       LSR     DOTS1
0C29   36 58                       ROR     DOTS2
0C2B   36 59                       ROR     DOTS3
0C2D   34 57                       LSR     DOTS1
0C2F   36 58                       ROR     DOTS2
0C31   36 59                       ROR     DOTS3
0C33   34 57                       LSR     DOTS1
0C35   36 58                       ROR     DOTS2
0C37   36 59                       ROR     DOTS3
0C39   20 09                       BRA     OUTDOTS               * WE'RE CENTERED
0C3B
0C3B                      * RIGHT JUSTIFY THE DOTS
0C3B
0C3B   B7 58              RIGHTJ   STA     DOTS2
0C3D   5C                          INX
0C3E   BD 61                       JSR     RAMCODE
0C40   B7 59                       STA     DOTS3
0C42   3F 57                       CLR     DOTS1
0C44
0C44                      * SHIP THE 3 BITMAP TEMPS TO THE DISPLAY.
0C44
0C44   B6 57              OUTDOTS  LDA     DOTS1
0C46   CD 0A DE                    JSR     WDAT
0C49   A6 C0                       LDA     #$C0                  * DATA WRITE - AUTOINCREMENT COUNTER
0C4B   CD 0A C7                    JSR     WCMD
0C4E
0C4E   B6 58                       LDA     DOTS2
0C50   CD 0A DE                    JSR     WDAT
0C53   A6 C0                       LDA     #$C0                  * DATA WRITE - AUTOINCREMENT COUNTER
0C55   CD 0A C7                    JSR     WCMD
0C58
0C58   B6 59                       LDA     DOTS3
```

```
0C5A   CD 0A DE          JSR    WDAT
0C5D   A6 C0             LDA    #$C0          * DATA WRITE   (AUTOINCREMENT POINTER)
0C5F   CD 0A C7          JSR    WCMD

0C62   A6 14             LDA    #20           * ADR PTR + 20 -> DISPLAY
0C64   AD 0F             BSR    WDAD

0C66   5C                INX                  * NEXT PIXEL ROW
0C67   A3 30             CPX    #48           * LAST PIXEL ROW?
0C69   25 A5             BLO    BIGDL

0C6B   A6 9C             LDA    #$9C          * TEXT OFF, GRAPHICS ON, CURSOR OFF
0C6D   CD 0A C7          JSR    WCMD

0C70   B6 49             LDA    BIGDA
0C72   BE 48             LDX    BIGDX

0C74   81                RTS


                 * ADD THE CONTENTS OF (A) TO THE ADDRESS POINTER (APHI, APLO) THEN
                 * WRITE OUT THE DISPLAY POINTER TO THE LCD.


0C75   BB 41     WDAD    ADD    APLO          * ADD TO LOW BYTE
0C77   B7 41             STA    APLO
0C79   B6 40             LDA    APHI          * HIGH BYTE
0C7B   A9 00             ADC    #0            * ADD CARRY TO HIGH BYTE
0C7D   B7 40             STA    APHI
0C7F   B6 40             LDA    APHI          * LOWER HALF OF SCREEN
0C81   A4 7F             AND    #$7F
0C83   A0 05             SUB    #5
0C85   25 04             BCS    WDAD1
0C87   AA 80             ORA    #$80          * HIGH GRAPHICS BUFFER AREA
0C89   B7 40             STA    APHI

0C8B   B6 41     WDAD1   LDA    APLO          * SHIP LOW BYTE
0C8D   CD 0A DE          JSR    WDAT
0C90   B6 40             LDA    APHI          * SHIP HIGH BYTE
0C92   CD 0A DE          JSR    WDAT
0C95   A6 24             LDA    #$24          * ADDRESS POINTER SET CMD
0C97   CC 0A C7          JMP    WCMD          * AND RTS


                 ********************************
                 *                              *
                 *                              *
                 *    DISPLAY A BIG FOOT        *
                 *                              *
                 *                              *
                 ********************************


                 * TO DISPLAY A BIG FOOT ON THE SCREEN, SET THE ADDRESS POINTER, LOCATIONS
                 * (APHI,APLO) TO THE UPPER LEFT CORNER SCREEN ADDRESS WHERE YOU WANT THE
```

```
                                  * FOOT. SET THE LEFT AND RIGHT JUSTIFY FLAGS (BY. LJ IN FLAG2), FIX THE
                                  * FOOT CODE IN RAM, SET UP THE FILE POINTERS AND CALL IN. BEWISHIT'S PRESSWATER.

0C9A   B7 49                      BIGFOOT  STA     BIGDA
0C9C   BF 48                               STX     BIGDX
0C9E   97                                  TAX
0C9F   58                                  ASLX                          * X 2 FOR TABLE ADDRESSES
0CA0   D6 18 75                            LDA     DTAB,X                * HIGH CHARACTER ADDRESS
0CA3   B7 62                               STA     RAH                   * IT'S SELF - MODIFYING TIME
0CA5   D6 18 76                            LDA     DTAB+1,X
0CA8   B7 63                               STA     RAL

0CAA   A6 D6                               LDA     #RAHLDA               * GET 2 BYTE LDA NN,X OPCODE
0CAC   B7 61                               STA     RAMCODE               * BUILD THE FILE.
0CAE   A6 81                               LDA     #RANKIS
0CB0   B7 64                               STA     RAMCODE+3

0CB2   4F                                  CLRA                          * SEND THE ADDRESS POINTER START ADR.
0CB3   CD 0C 75                            JSR     WDAD

0CB6   5F                                  CLRX

0CB7   BD 61                      BIGFL    JSR     RAMCODE               * CALL THE FILE
0CB9   CD 0D 26                            JSR     FILCHK                * CHECK FILL POINTERS
0CBC   0A 55 29                            BRSET   RJ,FLAG2,FOOTRJ       * RIGHT JUSTIFY THIS THING?

                                  * PUT THE CHR BITS IN THE LEFT BITMAP TEMPS

0CBF   B7 57                               STA     DOTS1
0CC1   5C                                  INX
0CC2   BD 61                               JSR     RAMCODE
0CC4   CD 0D 26                            JSR     FILCHK
0CC7   B7 58                               STA     DOTS2
0CC9   3F 59                               CLR     DOTS3

                                  * IF WE WANT LEFT JUSTIFIED, WE'RE DONE.

0CCB   08 55 26                            BRSET   LJ,FLAG2,OUTFEET

                                  * CENTER JUSTIFY THE DOTS

0CCE   34 57                               LSR     DOTS1
0CD0   36 58                               ROR     DOTS2
0CD2   36 59                               ROR     DOTS3
0CD4   34 57                               LSR     DOTS1
0CD6   36 58                               ROR     DOTS2
0CD8   36 59                               ROR     DOTS3
0CDA   34 57                               LSR     DOTS1
0CDC   36 58                               ROR     DOTS2
0CDE   36 59                               ROR     DOTS3
0CE0   34 57                               LSR     DOTS1
0CE2   36 58                               ROR     DOTS2
0CE4   36 59                               ROR     DOTS3
0CE6   20 0C                               BRA     OUTFEET               * WE'RE CENTERED

                                  * RIGHT JUSTIFY THE DOTS
```

```
GO

0CEB   B7 58          FOOTRJ   STA   DOTS2
0CEA   5C                      INX
0CEB   BD 61                   JSR   RAMCODE
0CED   CD 0D 26                JSR   FILCHK
0CF0   B7 59                   STA   DOTS3
0CF2   3F 57                   CLR   DOTS1

                      * SHIP THE 3 BITMAP TEMPS TO THE DISPLAY.

0CF4   B6 57          OUTFEET  LDA   DOTS1
0CF6   CD 0A DE                JSR   WDAT
0CF9   A6 C0                   LDA   #$C0                 * DATA WRITE - AUTOINCREMENT POINTER
0CFB   CD 0A C7                JSR   WCMD

0CFE   B6 58                   LDA   DOTS2
0D00   CD 0A DE                JSR   WDAT
0D03   A6 C0                   LDA   #$C0                 * DATA WRITE - AUTOINCREMENT POINTER
0D05   CD 0A C7                JSR   WCMD

0D08   B6 59                   LDA   DOTS3
0D0A   CD 0A DE                JSR   WDAT
0D0D   A6 C0                   LDA   #$C0                 * DATA WRITE - AUTOINCREMENT POINTER
0D0F   CD 0A C7                JSR   WCMD

0D12   A6 14                   LDA   #20                  * ADR PTR + 20 -> DISPLAY
0D14   CD 0C 75                JSR   WDAD

0D17   5C                      INX                        * NEXT PIXEL ROW
0D18   A3 54                   CPX   #84                  * LAST PIXEL ROW?
0D1A   25 9B                   BLO   BIGFL

0D1C   A6 9C                   LDA   #$9C                 * TEXT ON, GRAPHICS ON, CURSOR OFF
0D1E   CD 0A C7                JSR   WCMD

0D21   B6 49                   LDA   BIGDA
0D23   BE 48                   LDX   BIGDX

0D25   81                      RTS


                      * CHECK THE FILL POINTERS AND FILL THE DATA IF NECESSARY

0D26   B3 60          FILCHK   CPX   FILLOFF
0D28   22 16                   BHI   FEXIT
0D2A   B3 5F                   CPX   FILLON
0D2C   25 12                   BLO   FEXIT
0D2E   B7 59                   STA   DOTS3
0D30   9F                      TXA
0D31   AB 54                   ADD   #84
0D33   97                      TAX
0D34   BD 61                   JSR   RAMCODE              * GET THE FILL DATA
0D36   BA 59                   ORA   DOTS3
0D38   B7 59                   STA   DOTS3
0D3A   9F                      TXA
```

```
G0

0D3B   A0 54                    SUB     #84
0D3D   97                       TAX
0D3E   B6 59                    LDA     DUTY3
0D40   81              FEXIT    RTS


                       ********************************
                       *                              *
                       *                              *
                       *     DISPLAY A TEXT STRING    *
                       *                              *
                       *                              *
                       ********************************


                       * TO DISPLAY A TEXT STRING ON THE SCREEN, PUT THE STRING NUMBER IN LXI
                       * AND CALL ME. AUTOMATICALLY DISPLAYS ERRORS, BATTERY STATUS ON BOTTOM
                       * LINE OF SCREEN WHENEVER CALLED.


0D41   4F              GSTRING  CLRA                          * ADDRESS POINTER = TEXT HOME
0D42   CD 0A DE                 JSR     WDAT
0D45   A6 0A                    LDA     #$A
0D47   CD 0A DE                 JSR     WDAT
0D4A   A6 24                    LDA     #$24
0D4C   CD 0A C7                 JSR     WCMD

0D4F   A6 D6                    LDA     #RAMLDA                * GET 2 BYTE LDA NN,X OPCODE
0D51   B7 61                    STA     RAMCODE                * BUILD THE PILE.
0D53   A6 B1                    LDA     #RAMRTS
0D55   B7 64                    STA     RAMCODE+3

0D57   3D 56                    TST     ECODE
0D59   27 02                    BEQ     G0
0D5B   AE 0E                    LDX     #ER$                   * ERROR STRING

0D5D   D6 18 A1        G0       LDA     STRTAB,X
0D60   B7 62                    STA     RAH
0D62   D6 18 A2                 LDA     STRTAB+1,X
0D65   B7 63                    STA     RAL

0D67   A6 B0                    LDA     #$B0                   * ENTER AUTO MODE
0D69   CD 0A C7                 JSR     WCMD

0D6C   5F                       CLRX

0D6D   BD 61           GLOOP    JSR     RAMCODE                * GET THE CHR
0D6F   27 0A                    BEQ     G1                     * ASCIIZ
0D71   A0 20                    SUB     #$20                   * CONVERT TO DISPLAY'S CODE
0D73   CD 0A F5                 JSR     WAUTO                  * SHIP IT.
0D76   5C                       INX
0D77   A3 A0                    CPX     #160                   * EIGHT LINES MAX HERE..
0D79   25 F2                    BLO     GLOOP

0D7B   A6 B2           G1       LDA     #$B2                   * EXIT AUTO MODE
0D7D   CD 0A C7                 JSR     WCMD
```

```
0D80   4F                      CLRA                    * ADDRESS POINTER = TOP LINE
0D81   CD 0A DE                JSR     WDAT            * WRITE
0D84   A6 BA                   LDA     #$BA
0D86   CD 0A DE                JSR     WDAT
0D89   A6 24                   LDA     #$24
0D8B   CD 0A C7                JSR     WCMD

0D8E   5C                      INX                     * SKIP OVER THE NULL

0D8F   A6 B0                   LDA     #$B0            * ENTER AUTO MODE
0D91   CD 0A C7                JSR     WCMD

0D94   BD 61           GL1     JSR     RAMCODE         * GET THE CHR
0D96   27 08                   BEQ     G01             * ASCII Z
0D98   A0 20                   SUB     #$20            * CONVERT TO DISPLAY'S CODE
0D9A   CD 0A F5                JSR     WAUTO           * SHIP IT.
0D9D   5C                      INX
0D9E   26 F4                   BNE     GL1             * ALL WE CAN GET HERE..


0DA0   A6 B2           G01     LDA     #$B2            * EXIT AUTO MODE
0DA2   CD 0A C7                JSR     WCMD

0DA5   A6 BC                   LDA     #$BC            * ADDRESS POINTER = BOTTOM LINE
0DA7   CD 0A DE                JSR     WDAT
0DAA   A6 BA                   LDA     #$BA
0DAC   CD 0A DE                JSR     WDAT
0DAF   A6 24                   LDA     #$24
0DB1   CD 0A C7                JSR     WCMD

0DB4   05 54 09                BRCLR   PRE,FLAGS,G20   * ARE WE IN SET MODE?

0DB7   AE 02                   LDX     #NLS$           * YES. TAG ON THE 'PLAY'
0DB9   03 54 0B                BRCLR   BAT,FLAGS,G21
0DBC   AE 0C                   LDX     #BLS$           * BATTERY IS LOW TO BOOT.
0DBE   20 07                   BRA     G21

0DC0   AE 00           G20     LDX     #NL$            * ASSUME BATTERY OK
0DC2   03 54 02                BRCLR   BAT,FLAGS,G21   * NOW CHECK.
0DC5   AE 0A                   LDX     #BL$            * IF IT'S LOW..

0DC7   D6 18 A1        G21     LDA     STRTAB,X
0DCA   B7 62                   STA     RAH
0DCC   D6 18 A2                LDA     STRTAB+1,X
0DCF   B7 63                   STA     RAL

0DD1   A6 B0                   LDA     #$B0            * ENTER AUTO MODE
0DD3   CD 0A C7                JSR     WCMD

0DD6   5F                      CLRX

0DD7   B6 56                   LDA     ECODE           * ANY ERRORS PENDING?
0DD9   27 02                   BEQ     G22             * WRITE THE SPACE IF NOT
0DDB   A0 20                   SUB     #$20            * CONVERT ERROR CODE TO DISP. CODE
0DDD   CD 0A F5        G22     JSR     WAUTO           * WRITE IT OUT

0DE0   BD 61           GL2     JSR     RAMCODE         * GET THE CHR
```

```
0DE2   27 06                 BEQ     GOUT        * ACCEPT
0DE4   A0 20                 SUB     #$20        * CONVERT TO PERIPHERAL CODE
0DE6   CD 06 15              JSR     WRITE       * STORE IT.
0DE9   5C                    INX
0DEA   A3 13                 CPX     #19         * ONE LINE MAX HERE..
0DEC   25 F2                 BLO     GL2
0DEE   A6 82         GOUT    LDA     #$82        * EXIT AUTO MODE
0DF0   CD 0A C7              JSR     WCMD
0DF3   A6 9C                 LDA     #$9C        * TEXT, GRAPHICS ON, CURSOR OFF
0DF5   CD 0A C7              JSR     WCMD
0DF8   81                    RTS

                     ********************************
                     *                              *
                     *                              *
                     *     CALIBRATION ROUTINE      *
                     *                              *
                     *                              *
                     ********************************

0DF9   A6 43         CAL     LDA     #'C'
0DFB   CD 13 47              JSR     OUTCH
0DFE   81                    RTS

                     ********************************
                     *                              *
                     *                              *
                     *   TIMER INTERRUPT HANDLER    *
                     *                              *
                     *                              *
                     ********************************

                     * INTERRUPTS OCCUR AT 50 Hz., WHICH IS THE WEIGHT SAMPLING FREQUENCY
                     * AS WELL AS A REASONABLE TIME FOR DEBOUNCING, ETC.

                     * ACTUALLY THE MAIN INTERRUPT SERVICE IS PERFORMED AT 50 Hz. BUT THE
                     * 20 mS. TIME SLICE IS CHOPPED UP INTO TWO PARTS TOTALLING 20 mS. THE
                     * RATIO OF THESE TIMES DETERMINES THE DUTY CYCLE OF THE PULSE WIDTH
                     * MODULATED SIGNAL GOING TO THE LCD VEE AMPLIFIER. WHICH INTEGRATES IT.
                     * CHANGING THE LCD VEE VOLTAGE AND HENCE THE LCD CONTRAST.

0DFF   B6 18         TINT    LDA     COUNTH      * GET HIGH BYTE, FREEZE COUNT
0E01   B7 45                 STA     THITMP
0E03   B6 19                 LDA     COUNTL      * ADD 20 mS TO CURRENT COUNT

0E05   09 01 12              BRCLR   4,PORTB,VEEON   * CHECK LCD PHASE
```

```
                        * WHEN WE GET HERE, THE LCD VEE IS ON. WE TURN IT OFF. SET THE INTERRUPT
                        * TIMEOUT TO 5/2 - [DUTY] AND SPIN.

0E08   AB 10            VEEOFF  ADD     #$10            * 10000 = $2710 @ 4 mHz.
0E0A   97                       TAX
0E0B   B6 45                    LDA     THITMP
0E0D   A9 27                    ADC     #$27
0E0F   B0 3E                    SUB     DUTY
0E11   B7 16                    STA     OCH             * NEW TARGET TO OUT COMPARE REG
0E13   B6 13                    LDA     TSR             * CLEAR OCF
0E15   BF 17                    STX     OCL
0E17   19 01                    BCLR    4,PORTB         * VEE OFF AND WAIT FOR NEXT INTERRUPT.
0E19   80                       RTI

                        * WHEN WE GET HERE, THE LCD VEE IS OFF. WE TURN IT ON. SET THE INTERRUPT
                        * TIMEOUT TO [DUTY] AND PROCESS THE INTERRUPT TASKS.

0E1A   AB 10            VEEON   ADD     #$10            * 10000 = $2710 @ 4 mHz.
0E1C   97                       TAX
0E1D   B6 45                    LDA     THITMP
0E1F   B9 3E                    ADC     DUTY            * LONG PART OF CYCLE
0E21   B7 16                    STA     OCH             * NEW TARGET TO OUT COMPARE REG
0E23   B6 13                    LDA     TSR             * CLEAR OCF
0E25   BF 17                    STX     OCL
0E27   1B 01                    BSET    4,PORTB         * VEE ON AND GO DO THE REST OF THE
                                                        * INTERRUPT SERVICING.

                        * SAVE BUTTON STATE SO WE CAN CHECK FOR CHANGES AT THE END OF THE
                        * INTERRUPT HANDLER. WE WANT TO SET THE DISPLAY FLAG IMMEDIATELY
                        * IF ANY BUTTONS ARE PRESSED TO ELIMINATE PERCEIVED LATENCY OF RESPONSE.

0E29   B6 35                    LDA     BUTTON
0E2B   B7 45                    STA     THITMP          * DOUBLE PURPOSE TEMP

                        ********************************
                        *                              *
                        *                              *
                        *       GET ANALOG DATA        *
                        *                              *
                        *                              *
                        ********************************

                        * DO A/D CONVERSION OF ALL THE DATA CHANNELS SUCCESSIVELY, DEALING WITH
                        * THE FET SWITCHES AND DEBOUNCING THE BUTTONS.

                        * CONVERSION OF THE FIRST 4 CHANNELS IS TIME CRITICAL SINCE THE SENSOR
                        * EXCITATION MUST HAVE EXACTLY 50% DUTY CYCLE TO KEEP DC OFF THE SENSORS.
                        * OTHERWISE THE DAMN THINGS CREEP.

                        * START BY APPLYING 45 TO THE SENSORS AND CONVERTING CHANNELS 0 & 1
```

60

```
0E2D   1D 01        ANALOG   BCLR    6,PORTB      * TURN ON PULL UP FET

0E2F   A6 00                 LDA     #0           * SELECT SENSOR 1
0E31   CD 10 AF              JSR     CONVERT
0E34   25 33                 BCS     ANERR2
0E36   B7 50                 STA     RUCKET       * DATA RETURNED IS GOD TEST (50%)

0E38   A6 10                 LDA     #$10         * SELECT SENSOR 2
0E3A   CD 10 AF              JSR     CONVERT
0E3D   25 2A                 BCS     ANERR2
0E3F   B7 30                 STA     LEFTT        * DATA RETURNED IS LEFT TOE

0E41   1C 01                 BSET    6,PORTB      * TURN OFF PULL UP FET

                     * NOW FLIP THE SENSOR EXCITATION POLARITY AND DO CHANNELS 2 & 3.

0E43   1A 01                 BSET    5,PORTB      * TURN ON PULL DOWN FET

0E45   A6 20                 LDA     #$20         * SELECT SENSOR 3
0E47   CD 10 AF              JSR     CONVERT
0E4A   25 1D                 BCS     ANERR2
0E4C   B7 31                 STA     LEFTH        * DATA RETURNED IS LEFT HEEL

0E4E   A6 30                 LDA     #$30         * SELECT SENSOR 4
0E50   CD 10 AF              JSR     CONVERT
0E53   25 14                 BCS     ANERR2
0E55   B7 32                 STA     RIGHTT       * DATA RETURNED IS RIGHT TOE

0E57   1B 01                 BCLR    5,PORTB      * TURN OFF PULL DOWN FET

                     * NOW WE CAN SCREW AROUND ALL WE WANT: TIMING NO LONGER MATTERS.

0E59   A6 40                 LDA     #$40         * SELECT DIRECTION SWITCH
0E5B   CD 10 AF              JSR     CONVERT
0E5E   25 09                 BCS     ANERR2
0E60   B7 33                 STA     RIGHTH       * DATA RETURNED IS RIGHT HEEL

0E62   A6 50                 LDA     #$50         * SELECT AUTO/MAN SWITCH
0E64   CD 10 AF              JSR     CONVERT
0E67   24 03                 BCC     DBDIR        * DATA RETURNED IS DIRECTION SWITCH'S
0E69   CC 10 A3      ANERR2  JMP     ANERR        * BRANCH ISLAND


                     * THE "PREDATOR SPECIAL" HIGH SPEED DEBOUNCE ENGINE.


0E6C   5F            DBDIR   CLRX
0E6D   01 34 00              BRCLR   DIR,PEDDING,?1
0E70   59            ?1      ROLX
0E71   01 35 00              BRCLR   DIR,BUTTON,?2
0E74   59            ?2      ROLX
0E75   49                    ROLA                 * DATA HIGH ORDER BIT IS ALL ON HERE.
0E76   59                    ROLX
0E77   DE 13 7D              LDX     STATE,X
0E7A   DC 0E 7D              JMP     ?3,X
```

```
        00

0E7D    10 34          ?3      BSET    DIR,PENDING
0C7F    20 0A                  BRA     ?4
0EB1    11 34                  BCLR    DIR,PENDING
0EB3    20 06                  BRA     ?4
0EB5    10 35                  BSET    DIR,BUTTON
0EB7    20 02                  BRA     ?4
0EB9    11 35                  BCLR    DIR,BUTTON
        0EBB           ?4      EQU     *

0EBB    A6 60          DBAMS   LDA     #$60            * SELECT PRESET BUTTON
0EBD    CD 10 AF               JSR     CONVERT
0E90    25 56                  BCS     ANERR1
                                                       * DATA RETURNED IS AUTO/MAN SWITCH'S
0E92    5F                     CLRX
0E93    03 34 00               BRCLR   AMS,PENDING,?1
0E96    59             ?1      ROLX
0E97    03 35 00               BRCLR   AMS,BUTTON,?2
0E9A    59             ?2      ROLX
0E9B    49                     ROLA                    * DATA HIGH ORDER BIT IS ALL WE NEED.
0E9C    59                     ROLX
0E9D    DE 13 7B               LDX     STABLE,X
0EA0    DC 0E A3               JMP     ?3,X
0EA3    12 34          ?3      BSET    AMS,PENDING
0EA5    20 0A                  BRA     ?4
0EA7    13 34                  BCLR    AMS,PENDING
0EA9    20 06                  BRA     ?4
0EAB    12 35                  BSET    AMS,BUTTON
0EAD    20 02                  BRA     ?4
0EAF    13 35                  BCLR    AMS,BUTTON
        0EB1           ?4      EQU     *

0EB1    A6 70          DBPRE   LDA     #$70            * SELECT RECIPROCAL BUTTON
0EB3    CD 10 AF               JSR     CONVERT
0EB6    25 30                  BCS     ANERR1
                                                       * DATA RETURNED IS PRESET BUTTON'S
0EB8    5F                     CLRX
0EB9    05 34 00               BRCLR   PRE,PENDING,?1
0EBC    59             ?1      ROLX
0EBD    05 35 00               BRCLR   PRE,BUTTON,?2
0EC0    59             ?2      ROLX
0EC1    49                     ROLA                    * DATA HIGH ORDER BIT IS ALL WE NEED.
0EC2    59                     ROLX
0EC3    DE 13 7B               LDX     STABLE,X
0EC6    DC 0E C7               JMP     ?3,X
0EC9    14 34          ?3      BSET    PRE,PENDING
0ECB    20 14                  BRA     DONEP
0ECD    15 34                  BCLR    PRE,PENDING
0ECF    20 10                  BRA     DONEP
0ED1    20 06                  BRA     ?5              * SEE FOLLOWING NOTE.
0ED3    20 0C                  BRA     DONEP
0ED5    15 35                  BCLR    PRE,BUTTON
0ED7    20 08          ?4      BRA     DONEP

                       * SPECIAL STUFF FOR PRESET BUTTON PRESS. NOTE: DUE TO PC LAYOUT ERROR
                       * THIS BUTTON IS NORMALLY CLOSED, WE COMPENSATE HEREWITH.

0ED9    14 35          ?5      BSET    PRE,BUTTON      * WHEN THIS BUTTON GETS PRESSED,
```

```
0ED0   A6 04                 LDA    #4              * TOGGLE BIT 2 IN FLAGS.
0ED2   B8 54                 EOR    FLAGS
0ED4   B7 54                 STA    FLAGS

0ED6   A6 80        DBRCP    LDA    #$80            * SELECT RESET BUTTON
0ED8   CD 10 AF              JSR    CONVERT
0EDB   24 03                 BCC    DBRCP1
0EDD   CC 10 A3     ANERR1   JMP    ANERR           * BRANCH ISLAND
                                                    * DATA RETURNED IS RECIPROCAL BUTTON #
0EE0   5F           DBRCP1   CLRX
0EE1   07 34 00              BRCLR  RCP,PENDING,?1
0EE4   59           ?1       ROLX
0EE5   07 35 00              BRCLR  RCP,BUTTON,?2
0EE8   59           ?2       ROLX
0EE9   49                    ROLA                   * DATA HIGH ORDER BIT IS ALL WE NEED.
0EEA   59                    ROLX
0EEB   DE 13 7B              LDX    STABLE,X
0EEE   DC 0E FC              JMP    ?3,X
0EF1   16 34        ?3       BSET   RCP,PENDING
0EF3   20 32                 BRA    ?6

0EF5   17 34                 BCLR   RCP,PENDING
0EF7   20 2E                 BRA    ?6

0EF9   16 35                 BSET   RCP,BUTTON      * IF BUTTON WAS JUST RELEASED
0EFB   20 26                 BRA    ?5

0EFD   20 1C                 BRA    ?5              * IF BUTTON WAS JUST PRESSED

0EFF   06 35 25     ?4       BRSET  RCP,BUTTON,?6   * IF NOT PRESSED, NOP EXIT.


                    * BUTTON IS ALREADY DOWN-- UPDATE THE TYPAMATIC REGISTER

0F02   B6 42                 LDA    LTYPU           * GET LEFT TYPAMATIC COUNTER
0F04   A4 7F                 AND    #$7F            * REMOVE SIGN BIT
0F06   4A                    DECA                   * DECREMENT IT
0F07   26 09                 BNE    ?45             * DELAY COUNTDOWN FINISHED YET?
0F09   A6 08                 LDA    #RPTCNT         * RESET REPEAT COUNT
0F0B   0E 42 09              BRSET  PRESS,LTYPU,?46 * TOGGLE THE PRESS BIT
0F0E   AA 80                 ORA    #$80
0F10   20 05                 BRA    ?46

0F12   0F 42 02     ?45      BRCLR  PRESS,LTYPU,?46 * RESTORE THE PRESSED BIT
0F15   AA 80                 ORA    #$80

0F17   B7 42        ?46      STA    LTYPU           * SAVE NEW TYPAMATIC REGISTER VALUE
0F19   20 0C                 BRA    ?6              * EXIT


                    * BUTTON WAS JUST PRESSED. INITIALIZE TYPAMATIC REGISTER FOR LONG START
                    * DELAY AND SET PRESSED BIT.

0F1B   17 35        ?5       BCLR   RCP,BUTTON      * WHEN THIS BUTTON IS PRESSED,

0F1D   A6 9E                 LDA    #STCNT+128      * START UP TYPAMATIC DELAY
0F1F   B7 42                 STA    LTYPU           * AND SET THE PRESSED BIT
```

```
0F2C   20 04                    BRA     ?6

                      * BUTTON WAS JUST RELEASED. CLEAR ALL THE TYPAMATIC REGISTERS.

0F2E   3F 42          ?55       CLR     LTYPO          * BUTTON WAS JUST RELEASED
0F30   3F 43                    CLR     RTYPO

       0F32           ?6        EQU     *

0F32   A6 90          DBRST     LDA     #$90           * SELECT DISPLAY BUTTON
0F34   CD 10 AF                 JSR     CONVERT
0F37   25 AF                    BCS     ANERR
                                                       * DATA RETURNED IS RESET BUTTON'S
0F39   5F                       CLRX
0F3A   09 34 00                 BRCLR   RST,PENDING,?1
0F3D   59             ?1        ROLX
0F3E   09 35 00                 BRCLR   RST,BUTTON,?2
0F41   59             ?2        ROLX
0F42   49                       ROLA                   * DATA HIGH ORDER BIT IS ALL WE NEED.
0F43   59                       ROLX
0F44   DE 13 7B                 LDX     STABLE,X
0F47   DC 0F 4A                 JMP     ?3,X
0F4A   18 34          ?3        BSET    RST,PENDING
0F4C   20 0A                    BRA     ?4
0F4E   19 34                    BCLR    RST,PENDING
0F50   20 06                    BRA     ?4
0F52   18 35                    BSET    RST,BUTTON
0F54   20 02                    BRA     ?4
0F56   20 02                    BRA     ?5
0F58   20 08          ?4        BRA     DBDSP

                      * RESET BUTTON TOGGLES BIT 3 OF FLAGS TO START/STOP THE MOVIE

0F5A   19 35          ?5        BCLR    RST,BUTTON
0F5C   A6 08                    LDA     #8
0F5E   B8 54                    EOR     FLAGS
0F60   B7 54                    STA     FLAGS

0F62   A6 A0          DBDSP     LDA     #$A0           * SELECT VBAT
0F64   CD 10 AF                 JSR     CONVERT
0F67   24 03                    BCC     DBDSP1
0F69   CC 10 A3                 JMP     ANERR
                                                       * DATA RETURNED IS DISPLAY BUTTON'S
0F6C   5F             DBDSP1    CLRX
0F6D   0B 34 00                 BRCLR   DSP,PENDING,?1
0F70   59             ?1        ROLX
0F71   0B 35 00                 BRCLR   DSP,BUTTON,?2
0F74   59             ?2        ROLX
0F75   49                       ROLA                   * DATA HIGH ORDER BIT IS ALL WE NEED.
0F76   59                       ROLX
0F77   DE 13 7B                 LDX     STABLE,X
0F7A   DC 0F 7D                 JMP     ?3,X
0F7D   1A 34          ?3        BSET    DSP,PENDING
0F7F   20 32                    BRA     ?6
```

```
0F81   1B 34                 BCLR    DSP,PENDING
0F83   20 2E                 BRA     ?6
0F85   1A 35                 BSET    DSP,BUTTON          * IF BUTTON WAS JUST RELEASED
0F87   20 26                 BRA     ?55
0F89   20 1C                 BRA     ?5                  * IF BUTTON WAS JUST PRESSED

0F8B   0A 35 25      ?4      BRSET   DSP,BUTTON,?6       * IF NOT PRESSED, NOP EXIT.


                     * BUTTON IS ALREADY DOWN - UPDATE THE TYPAMATIC REGISTER

0F8E   B6 43                 LDA     RTYPO               * GET RIGHT TYPAMATIC COUNTER
0F90   A4 7F                 AND     #$7F                * REMOVE SIGN BIT
0F92   4A                    DECA                        * DECREMENT IT
0F93   26 09                 BNE     ?45                 * DELAY COUNTDOWN FINISHED YET?
0F95   A6 08                 LDA     #RPTCNT             * RESET REPEAT COUNT
0F97   0E 43 09              BRSET   PRESS,RTYPO,?46     * TOGGLE THE PRESS BIT
0F9A   AA 80                 ORA     #$80
0F9C   20 05                 BRA     ?46

0F9E   0F 43 02      ?45     BRCLR   PRESS,RTYPO,?46     * RESTORE THE PRESSED BIT
0FA1   AA 80                 ORA     #$80

0FA3   B7 43         ?46     STA     RTYPO               * SAVE NEW TYPAMATIC REGISTER VALUE
0FA5   20 0C                 BRA     ?6                  * EXIT


                     * BUTTON WAS JUST PRESSED. INITIALIZE TYPAMATIC REGISTER FOR LONG START
                     * DELAY AND SET PRESSED BIT.

0FA7   1B 35         ?5      BCLR    DSP,BUTTON

0FA9   A6 9E                 LDA     #STCNT+128          * START UP TYPAMATIC DELAY
0FAB   B7 43                 STA     RTYPO               * AND SET THE PRESSED BIT
0FAD   20 04                 BRA     ?6


                     * BUTTON WAS JUST RELEASED. CLEAR ALL THE TYPAMATIC REGISTERS.

0FAF   3F 42         ?55     CLR     LTYPO               * BUTTON WAS JUST RELEASED
0FB1   3F 43                 CLR     RTYPO

0FB3                 ?6      EQU     *


0FB3   A6 B0         DVBAT   LDA     #$B0                * SELECT CHANNEL 11 (A/D TEST)
0FB5   CD 10 AF              JSR     CONVERT
0FB8   24 03                 BCC     DVBAT1
0FBA   CC 10 A3              JMP     ANERR

0FBD   A1 B7         DVBAT1  CMP     #BATH1              * DATA RETURNED IS VBAT S
0FBF   24 08                 BHS     BATOK

0FC1   A1 B2                 CMP     #BATLO
0FC3   24 06                 BHS     FIXBAT              * HYSTERESIS - DO NOTHING
```

```
GO

0FC5   12 54                 BSET    BAT,FLAGS        * SET BATTERY FLAG IF < LOW THRESHOLD
0FC7   20 02                 BRA     FIXDAT
0FC9   13 54          BATOK  BCLR    BAT,FLAGS        * CLEAR BAT FLAG IF > HIGH THRESHOLD


                      * FIX UP THE SENSOR DATA. CHECK FOR UNDERFLOW AFTER SUBTRACTIONS
                      * AND MAKE DATA 0 IF SO. IF DATA IS '1', MAKE IT 0 TO PROVIDE SMALL
                      * DEADBAND WITH SENSORS UNLOADED.
                      *
                      * SENSORS 1 & 2 ARE INVERTED AROUND 128:

0FCB   A6 80          FIXDAT LDA     #128             * 128 - SENSORn => SENSORn
0FCD   B0 30                 SUB     LEFTT
0FCF   2B 04                 BMI     FD1              * CHECK FOR UNDERFLOW: 0 IF SO
0FD1   A1 01                 CMP     #1               * 1 LSB DEADBAND @ 0
0FD3   26 01                 BNE     FD2
0FD5   4F             FD1    CLRA
0FD6   B7 30          FD2    STA     LEFTT

0FD8   A6 80                 LDA     #128
0FDA   B0 31                 SUB     LEFTH
0FDC   2B 04                 BMI     FD3
0FDE   A1 01                 CMP     #1
0FE0   26 01                 BNE     FD4
0FE2   4F             FD3    CLRA
0FE3   B7 31          FD4    STA     LEFTH

                      * SENSORS 3 & 4 ARE 128 HIGH:

0FE5   B6 32                 LDA     RIGHTT           * SENSORn - 128 => SENSORn
0FE7   A0 80                 SUB     #128
0FE9   2B 04                 BMI     FD5
0FEB   A1 01                 CMP     #1
0FED   26 01                 BNE     FD6
0FEF   4F             FD5    CLRA
0FF0   B7 32          FD6    STA     RIGHTT

0FF2   B6 33                 LDA     RIGHTH
0FF4   A0 80                 SUB     #128
0FF6   2B 04                 BMI     FD7
0FF8   A1 01                 CMP     #1
0FFA   26 01                 BNE     FD8
0FFC   4F             FD7    CLRA
0FFD   B7 33          FD8    STA     RIGHTH


                      * DECREMENT THE TIMEOUT TIMER IF IT NEEDS IT

0FFF   B6 4B                 LDA     TOTIME           * IF THE TIMEOUT TIMER IS NON-ZERO,
1001   27 03                 BEQ     NRMP             * DECREMENT IT.
1003   4A                    DECA
1004   B7 4B                 STA     TOTIME


                      * CHECK TO SEE IF THE MOVEmENS ARE DONE WRITING AND NEED TO BE WRITE PROTECTED.
```

```
GO

1006   01 54 4F        NRWP    BRCLR   NOVHOT,FLAGS,CNTDN  * DO THE NOVRAMS HAVE THE HOTS?

                                                            * YES: LET'S SEE WHAT'S HAPPENING.
                                                            * LAST ACTIVE ONE IS STILL SELECTED.
1009   09 00 4C                BRCLR   4,PORTA,CNTDN       * STILL BUSY? FORGET IT.

100C   1C 00                   BSET    6,PORTA             * IF IT'S DONE, CLEAR THE READY STATUS
100E   1D 00                   BCLR    6,PORTA

1010   3F 00                   CLR     PORTA               * DESELECT

1012   1C 00                   BSET    6,PORTA             * CLOCK
1014   1D 00                   BCLR    6,PORTA

                                                            * RE-SELECT FOR WRITE PROTECT
1016   B6 55                   LDA     FLAG2               * GET CE MASK
1018   A4 BC                   AND     #%10001100          * MASK OFF OTHER FLAGS

101A   BA 00                   ORA     PORTA               * OR IN THE SELECT BITS
101C   B7 00                   STA     PORTA

101E   1B 00           WPNOW   BCLR    5,PORTA             * DATA = 0

1020   1C 00                   BSET    6,PORTA             * CLOCK IN THE CHIP SELECT
1022   1D 00                   BCLR    6,PORTA

1024   1A 00                   BSET    5,PORTA             * START BIT

1026   1C 00                   BSET    6,PORTA             * CLOCK IT IN
1028   1D 00                   BCLR    6,PORTA

102A   1B 00                   BCLR    5,PORTA             * WRITE PROTECT COMMAND = 0000xxxxx

102C   1C 00                   BSET    6,PORTA             * 0
102E   1D 00                   BCLR    6,PORTA

1030   1C 00                   BSET    6,PORTA             * 0
1032   1D 00                   BCLR    6,PORTA

1034   1C 00                   BSET    6,PORTA             * 0
1036   1D 00                   BCLR    6,PORTA

1038   1C 00                   BSET    6,PORTA             * 0
103A   1D 00                   BCLR    6,PORTA

103C   1C 00                   BSET    6,PORTA             * x
103E   1D 00                   BCLR    6,PORTA

1040   1C 00                   BSET    6,PORTA             * x
1042   1D 00                   BCLR    6,PORTA

1044   1C 00                   BSET    6,PORTA             * x
1046   1D 00                   BCLR    6,PORTA

1048   1C 00                   BSET    6,PORTA             * x
```

```
00

104A   1D 00                 BCLR    6,PORTA
104C   1C 00                 BSET    6,PORTA          * *
104E   1D 00                 BCLR    6,PORTA

1050   11 54                 BCLR    NOVHOT,FLAGS     * CLEAR THE FLAG

1052   3F 00                 CLR     PORTA            * DESELECT THE CHIPS

1054   1C 00                 BSET    6,PORTA          * THANK YOU MA'M
1056   1D 00                 BCLR    6,PORTA


1058   3A 3A        CNTDN    DEC     COUNT            * COUNT DOWN THE 300 mSEC. TIMER
105A   26 11                 BNE     CNTDN1
105C   A6 0F                 LDA     #15
105E   B7 3A                 STA     COUNT
1060   1C 54                 BSET    DISP,FLAGS       * SET THE DISPLAY REFRESH FLAG

1062   B6 3C                 LDA     LTIME            * COUNT DOWN THE LONG TIMER
1064   27 07                 BEQ     CNTDN1           * DONE YET?
1066   4A                    DECA
1067   26 02                 BNE     ?1
1069   10 55                 BSET    LTO,FLAG2        * SET THE LONG TIME TIMEOUT FLAG
106B   B7 3C        ?1       STA     LTIME

106D   B6 3B        CNTDN1   LDA     SWATIM           * POST IMPACT SAMPLE COUNTER
106F   26 05                 BNE     ?1               * COUNTING DOWN NOW?

1071   00 00 09              BRSET   0,PORTA,?3       * IMPACT?
1074   A6 33                 LDA     #51              * START UP THE SWAT TIME COUNTER

1076   4A          ?1       DECA
1077   26 02                 BNE     ?2               * IF ZERO, LEAVE IT ALONE
1079   1E 54                 BSET    SWT,FLAGS        * SET THE END OF SWING FLAG
107B   B7 3B        ?2       STA     SWATIM

107D   0E 54 03     ?3       BRSET   SWT,FLAGS,INTEND * IF END OF SWING, DON'T BUFFER ANY MORE
1080   CD 10 D7              JSR     PLAY

1083   0F 54 02     INTEND   BRCLR   SWT,FLAGS,INTEN0 * DISABLE THE PRESET BUTTON IF SWAT
1086   15 54                 BCLR    PRE,FLAGS        * FLAG IS TRUE.

1088   B6 4D        INTEN0   LDA     GATE             * IMPACT BLANKING ACTIVE?
108A   4A                    DECA
108B   2B 04                 BMI     ?1               * IF ZERO, DON'T BLANK

108D   B7 4D                 STA     GATE             * UPDATE GATE TIME
108F   3F 3B                 CLR     SWATIM           * BLANK IMPACTS FOR 1/2 SECOND OF HER
                                                      * BUTTON ACTIVITY

1091   0B 10 02     ?1       BRCLR   5,SCSR,INTEN1    * RS232 Data HERE?
1094   B6 11                 LDA     SCDAT

1096   B6 45        INTEN1   LDA     THITHP           * ANY BUTTON CHANGES?
1098   B1 35                 CMP     BUTTON
109A   27 06                 BEQ     INTEN2
```

```
GO

109C   1C 54                    BSET    DISP.FLOOD        * UPDATE THE DISPLAY 'NOW' IF SO.

109E   A6 19                    LDA     #25               * ALONE IMPACTS FOR 1/2 SECOND
10A0   B7 4D                    STA     GATE              * AFTER BUTTON STATE CHANGE.


10A2   80              INTEN2   RTI


10A3   1C 01           ANERR    BSET    6,PORTB           * FETS OFF
10A5   1B 01                    BCLR    5,PORTB
10A7   AB 30           ANERRL   ADD     #$30
10A9   B7 56                    STA     ECODE
10AB   CD 13 47                 JSR     OUTCH
10AE   80              ANRTI    RTI


                       ********************************
                       *                              *
                       *                              *
                       *       A/D CONVERSION         *
                       *                              *
                       *                              *
                       ********************************


                       * GO CONVERT AN ANALOG INPUT. CALL WITH A CHANNEL # IN HIGH NYBBLE OF [A]:
                       * RETURNS CARRY CLEAR AND PREVIOUSLY CONVERTED DATA IN [A] IF SUCCESSFULL.
                       * CARRY SET AND ERROR CODE IN [A] IF ERROR OCCURRED. [X] PRESERVED.

                       ************** !NOTE! ****************

                       * DATA RETURNED IS FOR THE CHANNEL NUMBER SENT BY THE CALL TO CONVERT
                       * IMMEDIATELY PRECEEDING THE CURRENT ONE. NOT THE ONE IN [A].
                       * CHANNEL [A] DATA WILL BE RETURNED ON THE !next! CALL TO CONVERT.

                       ************************************


10AF   3D 0B           CONVERT  TST     SPSR              * CLEAR THE SPI FLAG
10B1   1F 01                    BCLR    7,PORTB           * CS THE A/D CHIP
10B3   B7 0C                    STA     SPDR              * SEND CHANNEL #

10B5   A6 04                    LDA     #4                * SPI TIMEOUT TIMER - 22 uSEC.
10B7   4A              SPIWAI   DECA                      * COUNT DOWN THE TIMEOUT TIMER      (3)
10B8   27 11                    BEQ     ADERR1            * SPI TIME OUT? IF SO, FUB.         (3)
10BA   0E 03 FA                 BRSET   7,PORTD,SPIWAI    * WAIT FOR SPI TRANSFER TO FINISH   (5)
                                                          * AND EOC TO GO FALSE
                                                          *                     Total = (11)
                                                          * @ 4 mHz. 5.5 uSEC PER LOOP

10BD   A6 07                    LDA     #7                * A/D TIMEOUT TIMER - 38 uSEC
10BF   4A              ADWAI    DECA                      * COUNT DOWN                        (3)
10C0   27 0F                    BEQ     ADERR2            * A/D TIMEOUT?                      (3)
```

```
10C2   0F 03 FA          BRCLR   7,PORTD,ADWAI     * WAIT FOR EOC TO GO TRUE
10C5   B6 0C             LDA     SPDR              * GET DATA FROM PREVIOUS CONVERSION
10C7   1E 01             BSET    7,PORTB           * DESELECT THE A/D CHIP
10C9   98                CLC
10CA   81                RTS

10CB   1E 01     ADERR1  BSET    7,PORTB           * DESELECT THE A/D CHIP
10CD   A6 01             LDA     #ADE1             * SPI TIMEOUT ERROR CODE
10CF   99                SEC
10D0   81                RTS

10D1   1E 01     ADERR2  BSET    7,PORTB           * DESELECT THE A/D CHIP
10D3   A6 02             LDA     #ADE2             * A/D CONVERTER TIMEOUT ERROR CODE
10D5   99                SEC
10D6   81                RTS


                 ********************************
                 *                              *
                 *                              *
                 *      COMPUTE RATIOS AND      *
                 *       PACK INTO BUFFER       *
                 *                              *
                 ********************************

                 * PROCESS THE DATA IN THE SENSOR(N) BUFFER LOCATIONS
                 * COMPUTE THE 3 WEIGHT RATIOS. PACK THEM INTO TWO BYTES AND QUEUE THEM
                 * IN THE RING BUFFER. CHECK TO SEE IF WEIGHT DISTRIBUTION IS = WEIGHT SETPOINT
                 * AND SET FLASH FLAG IF SO.

                 * DATA IS PACKED IN THE RING BUFFER 'CAUSE WE DON'T HAVE MUCH RAM.
                 * THE NUMBERS REPRESENT WEIGHT PERCENTAGE FOR THE TOES AND THE LEFT FOOT.
                 * WE DO THE BIGTAB LOOKUP BEFORE STORING TO MAINTAIN AS MUCH
                 * PRECISION AS POSSIBLE. 1 LSB = 5% OF THE WEIGHT.
                 *
                 *          LOW BYTE                        HIGH BYTE
                 *
                 *    7  6  5  4  3     2  1  0        7  6     5  4  3  2  1  0
                 *   MSB -  -  - LSB   MSB -  -        - LSB      MSB -  -  - LSB
                 *
                 *    LEFT F/(F+B)        RIGHT F/(F+B)        LEFT/(LEFT+RIGHT)
                 *      5 BITS              5 BITS               5 BITS


10D7   B6 30     PLAY    LDA     LEFTT             * DIVIDE LEFT TOE WEIGHT
10D9   B7 4E             STA     NUM               * BY SUM OF LEFT TOE AND HEEL
10DB   BB 31             ADD     LEFHH             * TO GET LEFT FOOT FRONT/BACK RATIO
10DD   B7 4F             STA     DENOM
10DF   CD 11 50          JSR     DIVIDE            * RESULT IS 0 - 127
10E2   D6 13 83          LDA     BIGTAB,X          * LOOK UP RATIO IN TABLE
                                                   * RESULT IS 5 BIT SCALE TOWARD 00 - 31D
10E5   B7 37             STA     FACTLO            * SAVE IT
```

60

```
10E7   B6 32                LDA     RIGHTT          * DIVIDE RIGHT TOE WEIGHT
10E9   B7 4E                STA     NUM             * BY SUM OF RIGHT TOE AND HEEL
10EB   BB 33                ADD     RIGHTH          * TO GET RIGHT FOOT FRONT/BACK RATIO
10ED   B7 4F                STA     DENOM
10EF   CD 11 50             JSR     DIVIDE
10F2   D6 13 B3             LDA     BIGTAB,X
10F5   48                   LSLA                    * LEFT JUSTIFY RESULT
10F6   48                   LSLA
10F7   48                   LSLA

                    * PACK THE 3 HIGH ORDER BITS OF RIGHT F/B INTO PACK LOW BYTE

10F8   48                   LSLA
10F9   39 37                ROL     PACKLO
10FB   48                   LSLA
10FC   39 37                ROL     PACKLO
10FE   48                   LSLA
10FF   39 37                ROL     PACKLO

1101   A4 C0                AND     #$C0            * MASK OFF ALL BUT 2 LSB
1103   B7 36                STA     PACKHI          * PUT IN PACK HIGH BYTE

1105   B6 30                LDA     LEFTT           * ADD LEFT TOE AND HEEL
1107   BB 31                ADD     LEFTH
1109   44                   LSRA                    * DIVIDE BY TWO - PREVENT OVERFLOWS
110A   B7 4E                STA     NUM             * LEFT SUM -> NUM
110C   B6 32                LDA     RIGHTT          * ADD RIGHT TOE AND HEEL
110E   BB 33                ADD     RIGHTH
1110   44                   LSRA                    * DIVIDE BY 2
1111   BB 4E                ADD     NUM             * ADD LEFT SUM
1113   B7 4F                STA     DENOM           * TO DENOMINATOR
1115   CD 11 50             JSR     DIVIDE
1118   D6 13 B3             LDA     BIGTAB,X

111B   BA 36                ORA     PACKHI          * PACK WITH LOW BITS OF RFB
111D   B7 36                STA     PACKHI

                    * NOW STORE THE PACKED DATA IN THE RING BUFFER

111F   BE 4A                LDX     BPOINT          * GET CURRENT POINTER
1121   B6 36                LDA     PACKHI          * GET HIGH DATA BYTE
1123   A3 6A                CPX     #106            * WHICH SEGMENT ARE WE IN?
1125   24 09                BHS     HISEG

1127   E7 70                STA     BUFFER1,X       * STUFF 'EM IN THE LOW SEGMENT
1129   5C                   INX                     * NEXT LOC
112A   B6 37                LDA     PACKLO          * GET LOW DATA BYTE
112C   E7 70                STA     BUFFER1,X       * STUFF
112E   20 09                BRA     HUBCHK

1130   D7 00 96     HISEG  STA     GAP,X           * STUFF 'EM IN THE HIGH SEGMENT
1133   5C                   INX                     * GAP = BUFFER2 ORG - BUFFER1 LENGTH
1134   B6 37                LDA     PACKLO
1136   D7 00 96             STA     GAP,X
```

```
GO

1139   5C                NEWPTR   INX
113A   A3 C8                      CPX     #200                  * TIME TO WRAP AROUND?
113C   25 01                      BLO     ?1
113E   5F                         CLRX                          * WRAP
113F   BF 4A             ?1       STX     BPOINT                * SAVE NEW POINTER


                         * CHECK TO SEE IF THE WEIGHT = FALLAWAY TARGET


1141   B6 36                      LDA     PACKH1                * L/R BALANCE IS 5 LSB
1143   A4 1F                      AND     #$1F                  * MASK OFF HIGH BITS
1145   B1 3D                      CMP     TARGET
1147   27 04                      BEQ     ?2                    * SAME?

1149   1B 54                      BCLR    ONWT,FLAGS            * IF NOT, TURN OFF FLASH FLAG
114B   20 02                      BRA     ?3

114D   1A 54             ?2       BSET    ONWT,FLAGS            * IF SO, SET FLASH FLAG
       114F              ?3       EQU     *

114F   81                PEXIT    RTS



                         ********************************
                         *                              *
                         *                              *
                         *       DIVIDE ROUTINE         *
                         *                              *
                         *                              *
                         ********************************


                         * CALL WITH NUMERATOR IN 'NUM' AND DENOMINATOR IN 'DENOM'. RESULT RETURNED
                         * IN [X].

                         * NORMALIZE THE NUM AND DENOM DATA SO THAT THE MOST SIGNIFICANT ONE
                         * BIT OF DENOM IS IN BIT 7 OF DENOM. THEN DIVIDE: NUM/DENOM.
                         * RESULT OF DIVISION WILL THEN BE A NUMBER FROM 0 TO 127 (7 BITS)
                         * WHICH CAN BE TRANSLATED BY "BIGTAB" LOOKUP TO SMOOTHED RATIO.


1150   3D 4F             DIVIDE   TST     DENOM                 * CHECK FOR DIVIDE BY 0
1152   26 09                      BNE     NORM3
1154   A6 7F                      LDA     #$7F                  * DIVIDE BY ZERO.
1156   3D 4E                      TST     NUM                   * SOMETHING/0 = 127
1158   26 01                      BNE     NORM2                 * 0/0 = 0
115A   44                         LSRA
115B   97                NORM2    TAX
115C   81                         RTS

115D   0E 4F 06          NORM3    BRSET   7,DENOM,DIV0          * IF IT'S ODD, NORMALIZE ANYWAY
1160   38 4E                      LSL     NUM
```

```
3640  1162  38 4F                 LSL   DENOM
3641  1164  20 F7                 BRA   NORM3
3642
3643  1166  AE FF          DIV0   LDX   #$FF          * ACCUMULATE /RESULT IN X
3644  1168  B6 4E                 LDA   NUM
3645  116A  34 4F                 LSR   DENOM
3646  116C  B0 4F                 SUB   DENOM
3647  116E  24 03                 BCC   DIV1
3648  1170  BB 4F                 ADD   DENOM
3649  1172  99                    SEC
3650
3651  1173  59            DIV1   ROLX
3652  1174  34 4F                 LSR   DENOM
3653  1176  B0 4F                 SUB   DENOM
3654  1178  24 03                 BCC   DIV2
3655  117A  BB 4F                 ADD   DENOM
3656  117C  99                    SEC
3657  117D  59            DIV2   ROLX
3658
3659  117E  34 4F                 LSR   DENOM
3660  1180  B0 4F                 SUB   DENOM
3661  1182  24 03                 BCC   DIV3
3662  1184  BB 4F                 ADD   DENOM
3663  1186  99                    SEC
3664  1187  59            DIV3   ROLX
3665
3666  1188  34 4F                 LSR   DENOM
3667  118A  B0 4F                 SUB   DENOM
3668  118C  24 03                 BCC   DIV4
3669  118E  BB 4F                 ADD   DENOM
3670  1190  99                    SEC
3671  1191  59            DIV4   ROLX
3672
3673  1192  34 4F                 LSR   DENOM
3674  1194  B0 4F                 SUB   DENOM
3675  1196  24 03                 BCC   DIV5
3676  1198  BB 4F                 ADD   DENOM
3677  119A  99                    SEC
3678  119B  59            DIV5   ROLX
3679
3680  119C  34 4F                 LSR   DENOM
3681  119E  B0 4F                 SUB   DENOM
3682  11A0  24 03                 BCC   DIV6
3683  11A2  BB 4F                 ADD   DENOM
3684  11A4  99                    SEC
3685  11A5  59            DIV6   ROLX
3686
3687  11A6  34 4F                 LSR   DENOM
3688  11A8  B0 4F                 SUB   DENOM
3689  11AA  59                    ROLX
3690  11AB  53                    COMX
3691
3692  11AC  9F            DIVEND TXA                  * 7 BIT RATIO NOW IN ACC
3693  11AD  81                    RTS
3694
3695
3696
```

```
00

                                 ********************************
                                 *                              *
                                 *                              *
                                 *       NOVRAM ROUTINES        *
                                 *                              *
                                 *                              *
                                 ********************************


                                 * IN ORDER TO BE ABLE TO COMPENSATE FOR SENSOR NON-LINEARITY, WE HAVE
                                 * 384 BYTES OF NON VOLATILE RAM IN THREE TS93C46 CHIPS. EACH SENSOR GETS
                                 * 64 BYTES OF LOOK UP TABLE: TABLE DATA IS 7 BITS + ODD PARITY CHECKSUM.
                                 * 3RD NOVRAM CHIP ADDED AS AFTERTHOUGHT FOR RANDOM FEATURES WE WANTED
                                 * LIKE TAKEAWAY WEIGHT AND CONTRAST SETTING MEMORY.

                                 * TO READ THE TABLE VALUE FROM THE NOVRAMS, PUT THE ADDRESS IN [X] AND
                                 * CALL RDNOV: THE VALUE RETURNS IN [A] WITH CARRY CLEAR. ON CHECKSUM
                                 * OR TIMEOUT ERROR, CARRY IS SET AND ERROR CODE IS IN [A].

  11AE   14 00                   RDNOV3   BSET     2,PORTA          * SELECT NOVRAM 3
  11B0   BF 46                            STX      NOVXT
  11B2   9F                               TXA
  11B3   20 0C                            BRA      NOVRDY


  11B5   BF 46                   RDNOV    STX      NOVXT            * X IS PRESERVED ON NORMAL EXIT
  11B7   9F                               TXA

  11B8   4D                               TSTA                      * WHICH CHIP? HIGH ORDER ADDRESS BIT
  11B9   2B 04                            BMI      HINOV            * TELLS.

  11BB   1E 00                            BSET     7,PORTA          * HIGH CHIP
  11BD   20 02                            BRA      NOVRDY

  11BF   16 00                   HINOV    BSET     3,PORTA          * LOW CHIP


  11C1   1B 00                   NOVRDY   BCLR     5,PORTA          * DATA = 0

  11C3   AE 02                            LDX      #2               * TWO TICKS (40 mSEC.) TIMEOUT.
  11C5   BF 4B                            STX      TOTIME

  11C7   08 00 07                NOVRDY1  BRSET    4,PORTA,NRDGO    * GO FOR IT IF HIGH (READY)
  11CA   3D 4B                            TST      TOTIME           * HAS THE TIMEOUT EXPIRED YET?
  11CC   26 F9                            BNE      NOVRDY1          * IF NOT, GIVE IT TIME.
  11CE   CC 12 19                         JMP      NOVTO            * IF SO, GENERATE ERROR.

  11D1   1C 00                   NRDGO    BSET     6,PORTA          * CLOCK THE CHIP SELECT IN
  11D3   1D 00                            BCLR     6,PORTA

  11D5   1A 00                            BSET     5,PORTA          * START BIT

  11D7   1C 00                            BSET     6,PORTA          * CLOCK IT OUT
  11D9   1D 00                            BCLR     6,PORTA

  11DB   1C 00                            BSET     6,PORTA          * READ COMMAND - 10
```

```
11DD   1D 00                    BCLR    6,PORTA
11DF   1D 00                    BCLR    5,PORTA

11E1   1C 00                    BSET    6,PORTA         * CLOCK IT OUT
11E3   1D 00                    BCLR    6,PORTA

11E5   AE 08                    LDX     #8              * SHIP OUT THE ADDRESS, LSB FIRST.
11E7   1A 00            NRDAD   BSET    5,PORTA         * ASSUME 1 BIT
11E9   44                       LSRA
11EA   25 02                    BCS     NRDAD1
11EC   1B 00                    BCLR    5,PORTA         * CLEAR DATA BIT IF NOT 1

11EE   1C 00            NRDAD1  BSET    6,PORTA
11F0   1D 00                    BCLR    6,PORTA

11F2   5A                       DEX
11F3   26 F2                    BNE     NRDAD


                        * THE ADDRESS IS REALLY SEVEN BITS, BUT THE FIRST CLOCK CYCLE AFTER THE
                        * ADDRESS GENERATES A DUMMY DATA OUTPUT: WE JUST FLUSHED IT AND NOW WE
                        * CAN READ THE NOVRAM.

11F5   AE 08                    LDX     #8              * 8 DATA BITS
11F7   0B 00 00         NRDAT   BRSET   4,PORTA,NRDAT1  * DATA BIT -> CARRY
11FA   46               NRDAT1  RORA                    * CARRY -> LSB

11FB   1C 00                    BSET    6,PORTA         * CLOCK IT
11FD   1D 00                    BCLR    6,PORTA

11FF   5A                       DEX
1200   26 F3                    BNE     NRDAT

1202   3F 00                    CLR     PORTA           * DESELECT CHIPS

1204   1C 00                    BSET    6,PORTA         * BANG IT ONE MORE TIME
1206   1D 00                    BCLR    6,PORTA         * TO SAY GOODBYE.

1208   CD 13 11                 JSR     CHKSUM          * CHECK IT OUT
120B   25 14                    BCS     NOVCS           * IF NUM SUM, ERROR DEF.
120D   A4 7F                    AND     #$7F            * OFF THE CHECK BIT
120F   BE 46                    LDX     NOVXT           * RESTORE X
1211   98                       CLC
1212   81                       RTS

1213   A6 03            NOVWTO  LDA     #NWTERR         * NOVRAM TIMED OUT ON WRITE
1215   20 02                    BRA     NOVTO
1217   A6 04            NOVRTO  LDA     #NRDERR         * NOVRAM TIMED OUT ON READ
1219   3F 00            NOVTO   CLR     PORTA           * OFF WITH THEIR SELECTS!
121B   1C 00                    BSET    6,PORTA
121D   1D 00                    BCLR    6,PORTA
121F   99                       SEC
1220   81                       RTS

1221   A6 05            NOVCS   LDA     #NCSERR         * CHECKSUM ERROR
```

```
GO

1223   99                          SEC
1224   81                          RTS


                        * WRITE TO THE NOVRAM. CALL WITH ADDRESS IN [X] AND DATA IN [A]
                        * TIMEOUT IS ONLY ERROR POSSIBLE: RETURNS CARRY SET AND ERR CODE IN [A]
                        * THIS ROUTINE WRITE ENABLES THE NOVRAM, STARTS THE SELF TIMED WRITE
                        * AND SETS THE 'NOVHOT' FLAG. THE INTERRUPT ROUTINE CHECKS THIS FLAG
                        * AND IF SET, CHECKS TO SEE IF THE NOVRAMS HAVE FINISHED THE WRITE
                        * CYCLE. IF SO, IT WRITE PROTECTS THEM AGAIN. [A] PRESERVED ON NORMAL EXIT.

1225   B7 46            WRTNOV3  STA     NOVXT

1227   A6 03                     LDA     #3                  * 3 TICKS (40 mSEC.) TIMEOUT.
1229   B7 4B                     STA     TOTIME

122B   01 54 06         WR31     BRCLR   NOVHOT,FLAGS,WR32   * GO FOR IT IF COLD (READY)
122E   3D 4B                     TST     TOTIME              * HAS THE TIMEOUT EXPIRED YET?
1230   26 F9                     BNE     WR31                * IF NOT, GIVE IT TIME.
1232   20 DF                     BRA     NOVWTO              * IF SO, GENERATE ERROR.

1234   9F               WR32     TXA
1235   14 00                     BSET    2,PORTA             * SELECT NOVRAM 3
1237   14 55                     BSET    NOV3,FLAG2          * SET THE CHIP SELECT MASK
1239   17 55                     BCLR    NOV2,FLAG2
123B   1F 55                     BCLR    NOV1,FLAG2
123D   20 23                     BRA     NOVWRY

123F   B7 46            WRTNOV   STA     NOVXT

1241   A6 03                     LDA     #3                  * 3 TICKS (60 mSEC.) TIMEOUT.
1243   B7 4B                     STA     TOTIME

1245   01 54 06         WR1      BRCLR   NOVHOT,FLAGS,WR2    * GO FOR IT IF COLD (READY)
1248   3D 4B            WR3      TST     TOTIME              * HAS THE TIMEOUT EXPIRED YET?
124A   26 F9                     BNE     WR1                 * IF NOT, GIVE IT TIME.
124C   20 C5                     BRA     NOVWTO              * IF SO, GENERATE ERROR.

124E   15 55            WR2      BCLR    NOV3,FLAG2          * CLEAR THE NOVRAM 3 FLAG
1250   9F                        TXA

1251   4D                        TSTA                        * WHICH CHIP? HIGH ORDER ADDRESS BIT
1252   2B 08                     BMI     UPNOV               * TELLS.

1254   1E 00                     BSET    7,PORTA             * NOVRAM 1
1256   1E 55                     BSET    NOV1,FLAG2          * SET THE CHIP SELECT MASK
1258   17 55                     BCLR    NOV2,FLAG2
125A   20 06                     BRA     NOVWRY

125C   16 00            UPNOV    BSET    3,PORTA             * NOVRAM 2
125E   16 55                     BSET    NOV2,FLAG2          * SET CHIP SELECT MASK
1260   1F 55                     BCLR    NOV1,FLAG2

1262   AE 03            NOVWRY   LDX     #3                  * 3 TICKS (40 mSEC.) TIMEOUT.
1264   BF 4B                     STX     TOTIME
```

```
GO

1266   08 00 06        NOVWRY1  BRSET   4,PORTA,NWREN     * GO FOR IT IF HIGH (READY)
1269   3D 4B                    TST    TOTIME            * HAS THE TIMEOUT EXPIRED YET?
126B   26 F9                    BNE    NOVWRY1           * IF NOT, GIVE IT TIME.
126D   20 A4                    BRA    NOVWTO            * IF SO, GENERATE ERROR.

                       * WRITE ENABLE THE NOVRAM

126F   1B 00           NWREN    BCLR   5,PORTA           * DATA = 0

1271   1C 00                    BSET   6,PORTA           * CLOCK IN THE CHIP SELECT
1273   1D 00                    BCLR   6,PORTA

1275   1A 00                    BSET   5,PORTA           * START BIT

1277   1C 00                    BSET   6,PORTA           * CLOCK IT IN
1279   1D 00                    BCLR   6,PORTA

127B   1B 00                    BCLR   5,PORTA           * WRITE ENABLE COMMAND = 0011xxxxx

127D   1C 00                    BSET   6,PORTA           * 0
127F   1D 00                    BCLR   6,PORTA

1281   1C 00                    BSET   6,PORTA           * 0
1283   1D 00                    BCLR   6,PORTA

1285   1A 00                    BSET   5,PORTA

1287   1C 00                    BSET   6,PORTA           * 1
1289   1D 00                    BCLR   6,PORTA

128B   1C 00                    BSET   6,PORTA           * 1
128D   1D 00                    BCLR   6,PORTA

128F   1C 00                    BSET   6,PORTA           * x - GOTTA CLOCK THE GARBAGE OUT.
1291   1D 00                    BCLR   6,PORTA

1293   1C 00                    BSET   6,PORTA           * x
1295   1D 00                    BCLR   6,PORTA

1297   1C 00                    BSET   6,PORTA           * x
1299   1D 00                    BCLR   6,PORTA

129B   1C 00                    BSET   6,PORTA           * x
129D   1D 00                    BCLR   6,PORTA

129F   1C 00                    BSET   6,PORTA           * x
12A1   1D 00                    BCLR   6,PORTA

12A3   3F 00                    CLR    PORTA             * DESELECT ALL THE CHIPS

12A5   1C 00                    BSET   6,PORTA           * CLOCK IT OUT
12A7   1D 00                    BCLR   6,PORTA

12A9   04 55 07                 BRSET  NOV4,FLAG2,NOW23  * NOVRAM 3?
12AC   06 55 08                 BRSET  NOV2,FLAG2,NOW22  * NOVRAM 2?

12AF   1E 00                    BSET   7,PORTA           * NOVRAM 1
```

```
GO

12B1   20 06                 BRA     NWRGO
12B3   14 00        UNOV3    BSET    2,PORTA      * NOVRAM 3
12B5   20 02                 BRA     NWRGO
12B7   16 00        UNOV2    BSET    3,PORTA      * NOVRAM 2
12B9   1D 00        NWRGO    BCLR    5,PORTA      * DATA = 0
12BB   1C 00                 BSET    6,PORTA      * CLOCK IN THE CHIP SELECT
12BD   1D 00                 BCLR    6,PORTA
12BF   1A 00                 BSET    5,PORTA      * START BIT
12C1   1C 00                 BSET    6,PORTA      * CLOCK IT OUT
12C3   1D 00                 BCLR    6,PORTA
12C5   1B 00                 BCLR    5,PORTA      * WRITE COMMAND = 01
12C7   1C 00                 BSET    6,PORTA
12C9   1D 00                 BCLR    6,PORTA
12CB   1A 00                 BSET    5,PORTA      * 1
12CD   1C 00                 BSET    6,PORTA      * CLOCK IT OUT
12CF   1D 00                 BCLR    6,PORTA
12D1   AE 07                 LDX     #7           * SHIP OUT THE ADDRESS, LSB FIRST.
12D3   1A 00        NWRAD    BSET    5,PORTA      * ASSUME 1 BIT
12D5   44                    LSRA
12D6   25 02                 BCS     NWRAD1
12D8   1B 00                 BCLR    5,PORTA      * CLEAR DATA BIT IF NOT 1
12DA   1C 00        NWRAD1   BSET    6,PORTA
12DC   1D 00                 BCLR    6,PORTA
12DE   5A                    DEX
12DF   26 F2                 BNE     NWRAD
12E1   B6 46                 LDA     NOVXT        * GET THE DATA IN LAI
12E3   CD 13 11              JSR     CHKSUM       * COMPUTE THE CHECKSUM
12E6   AE 08                 LDX     #8           * 8 DATA BITS
12E8   1A 00        NWRAT    BSET    5,PORTA      * ASSUME HIGH BIT
12EA   44                    LSRA                 * GET THE BIT
12EB   25 02                 BCS     NWRAT1       * IS IT REALLY A 1?
12ED   1B 00                 BCLR    5,PORTA      * IF NOT, FIX THE DATA BIT
12EF   1C 00        NWRAT1   BSET    6,PORTA      * CLOCK IT OUT
12F1   1D 00                 BCLR    6,PORTA
12F3   5A                    DEX
12F4   26 F2                 BNE     NWRAT
12F6   3F 00                 CLR     PORTA        * DESELECT CHIPS
12F8   1C 00                 BSET    6,PORTA      * WAIT TO GO BUSY
```

```
60

12FA   1D 00                    BCLR    6,PORTA          * TO SAY GOODBYE.

                                                         * NOW RE-SELECT FOR STATUS CHECK

12FC   B6 55                    LDA     FLAG2            * GET MASK BITS
12FE   A4 8C                    AND     #%10001100       * OFF ANY OTHER FLAGS
1300   BA 00                    ORA     PORTA
1302   B7 00                    STA     PORTA            * SELECT IT.

1304   10 54                    BSET    NOVHOT,FLAGS     * TELL THE INTERRUPT ROUTINE WE'RE HOT..
1306   08 00 04                 BRSET   4,PORTA,NOTHOT   * ARE WE !REALLY! HOT?

1309   B6 46                    LDA     NOVXT            * RESTORE [A]
130B   98                       CLC
130C   81                       RTS

130D   A6 06            NOTHOT  LDA     #NWERR
130F   99                       SEC
1310   81                       RTS


                        * COMPUTE AND CHECK A CHECKSUM. CALL WITH [A] CONTAINING BYTE TO BE
                        * CHECKSUMMED. RETURNS ODD PARITY BYTE IN [A]: CARRY IS CLEAR IF BYTE
                        * HAD CORRECT CHECKSUM WHEN IT GOT HERE, CARRY SET IF NOT. X TRASHED.
                        * CHECK BIT IS BIT 7: SUM OF ALL ON BITS IS AN ODD #.


1311   5F               CHKSUM  CLRX                     * SUM -> [X]
1312   B7 47                    STA     CKTMP            * SAVE ORIGINAL FOR TEST
1314   46                       RORA                     * BIT 0 -> CARRY
1315   25 01                    BCS     ?1
1317   5C                       INX
1318   46               ?1      RORA                     * 1
1319   25 01                    BCS     ?2
131B   5C                       INX
131C   46               ?2      RORA                     * 2
131D   25 01                    BCS     ?3
131F   5C                       INX
1320   46               ?3      RORA                     * 3
1321   25 01                    BCS     ?4
1323   5C                       INX
1324   46               ?4      RORA                     * 4
1325   25 01                    BCS     ?5
1327   5C                       INX
1328   46               ?5      RORA                     * 5
1329   25 01                    BCS     ?6
132B   5C                       INX
132C   46               ?6      RORA                     * 6
132D   25 01                    BCS     ?7
132F   5C                       INX
1330   46               ?7      RORA                     * BIT 7 -> CARRY
1331   56                       RORX                     * REPLACE CHECKSUM BIT WITH THE ONE
1332   46                       RORA                     * WE JUST COMPUTED.
1333   B1 47                    CMP     CKTMP            * WAS THE CHECKSUM CORRECT ORIGINALLY?
1335   26 02                    BNE     SUMDUN
1337   98                       CLC                      * OK
```

```
GD

1338   81                          RTS

1339   99                 SUMBUM   SEC                          * NUM SUM
133A   81                          RTS



                          ********************************
                          *                              *
                          *                              *
                          *   COPYRIGHT STRING OUTPUT    *
                          *                              *
                          *                              *
                          ********************************

                          * SEND THE COPYRIGHT STRING OUT THE RS-232 PORT

133B   5F                 COPPER   CLRX
133C   D6 1E 47           COPPR1   LDA      COPY,X
133F   27 05                       BEQ      COPOUT
1341   AD 04                       BSR      OUTCH
1343   5C                          INX
1344   26 F6                       BNE      COPPR1

1346   81                 COPOUT   RTS


                          ********************************
                          *                              *
                          *                              *
                          *   RS-232 CHARACTER OUTPUT    *
                          *                              *
                          *                              *
                          ********************************

1347   3D 10              OUTCH    TST      SCSR
1349   2A FC                       BPL      OUTCH
134B   B7 11                       STA      SCDAT
134D   81                          RTS


                          ********************************
                          *                              *
                          *                              *
                          *          OUTBITS             *
                          *                              *
                          *                              *
                          ********************************

                          * SEND THE CONTENTS OF LAI OUT RS-232 PORT IN ASCII FORMAT

134E   B7 51              OUTBITS  STA      SHIFTER
1350   AE 08                       LDX      #8
```

```
BO

1352   A6 30          OB1     LDA     #$30
1354   3U 51                  LSL     SHIFTER
1356   A9 00                  ADC     #0
1358   AD ED                  BSR     OUTCH
135A   5A                     DEX
135B   26 F5                  BNE     OB1
135D   A6 0D                  LDA     #$D                 * JUST A C/R - OVERWRITE ON THE SCREEN
135F   20 E6                  BRA     OUTCH               * AND RTS

                       ********************************
                       *                              *
                       *                              *
                       *       ERROR HANDLER          *
                       *                              *
                       *                              *
                       ********************************

                       * MOSTLY FOR DEBUGGING, BUT MAY BE USEFUL IN PRODUCTION TEST.

1361   3D 10          FUBAR   TST     SCSR                * TDRE?
1363   2A FC                  BPL     FUBAR               * WAIT..

1365   AB 30                  ADD     #$30                * MAKE ASCII
1367   B7 11                  STA     SCDAT               * SHIP IT
1369   B7 56                  STA     ECODE               * STASH IT
136B   9A                     CLI

136C   CD 0B 60               JSR     CLS                 * CLEAR THE SCREEN
136F   BE 0E                  LDX     ER$                 * PUT UP ERROR STRING
1371   CD 0D 41               JSR     GSTRING

1374   08 35 FD       FUBAR1  BRSET   RST,BUTTON,FUBAR1
1377   9B                     SEI
1378   CC 01 80               JMP     RESET


                       ********************************
                       *                              *
                       *                              *
                       *       LOOKUP TABLES          *
                       *                              *
                       *                              *
                       ********************************

                       * DEBOUNCE ENGINE NEXT STATE LOOKUP TABLE
                       *
                       *       PENDING   BUTTON    TOGGLE    ACTION    GOODBYE RETURNED
                       *       -------   ------    ------    ------    ---------------
                       *       0         0         0         - (NOP)   14
                       *       0         0         1         1 -> P    0
                       *       0         1         0         0 -> P    12
                       *       0         1         1         1 -> P    0
```

```
                                 *        1        0        0        0 -> P    4
                                 *        1        0        1        1 -> B    8
                                 *        1        1        0        0 -> P    4
                                 *        1        1        1        - (NOP)   14

                                 STABLE   FCB      14
137B   0E                                 FCB      0
137C   00                                 FCB      12
137D   0C                                 FCB      0
137E   00                                 FCB      4
137F   04                                 FCB      8
1380   08                                 FCB      4
1381   04                                 FCB      14
1382   0E

                                 * WEIGHT RATIO CONVERSION TABLE

                                 BIGTAB   FCB      0                  * 5 %
1383   00                                 FCB      0
1384   00                                 FCB      0
1385   00                                 FCB      0
1386   00                                 FCB      0
1387   00                                 FCB      0
1388   00                                 FCB      0
1389   00                                 FCB      0
138A   00

138B   01                                 FCB      1                  * 10 %
138C   01                                 FCB      1
138D   01                                 FCB      1
138E   01                                 FCB      1
138F   01                                 FCB      1
1390   01

1391   02                                 FCB      2                  * 15 %
1392   02                                 FCB      2
1393   02                                 FCB      2
1394   02                                 FCB      2
1395   02                                 FCB      2
1396   02                                 FCB      2
1397   02

1398   03                                 FCB      3                  * 20 %
1399   03                                 FCB      3
139A   03                                 FCB      3
139B   03                                 FCB      3
139C   03                                 FCB      3
139D   03

139E   04                                 FCB      4                  * 25 %
139F   04                                 FCB      4
13A0   04                                 FCB      4
13A1   04                                 FCB      4
13A2   04                                 FCB      4
13A3   04                                 FCB      4
13A4   04                                 FCB      4
```

```
GO

4210
4211   13A5   05          FCB   5          * 30 %
4212   13A6   05          FCB   5
4213   13A7   05          FCB   5
4214   13A8   05          FCB   5
4215   13A9   05          FCB   5
4216   13AA   05          FCB   5
4217
4218   13AB   06          FCB   6          * 35 %
4219   13AC   06          FCB   6
4220   13AD   06          FCB   6
4221   13AE   06          FCB   6
4222   13AF   06          FCB   6
4223   13B0   06          FCB   6
4224   13B1   06          FCB   6
4225
4226   13B2   07          FCB   7          * 40 %
4227   13B3   07          FCB   7
4228   13B4   07          FCB   7
4229   13B5   07          FCB   7
4230   13B6   07          FCB   7
4231   13B7   07          FCB   7
4232
4233   13B8   08          FCB   8          * 45 %
4234   13B9   08          FCB   8
4235   13BA   08          FCB   8
4236   13BB   08          FCB   8
4237   13BC   08          FCB   8
4238   13BD   08          FCB   8
4239   13BE   08          FCB   8
4240
4241   13BF   09          FCB   9          * 50 %
4242   13C0   09          FCB   9
4243   13C1   09          FCB   9
4244   13C2   09          FCB   9
4245   13C3   09          FCB   9
4246   13C4   09          FCB   9
4247   13C5   09          FCB   9
4248   13C6   09          FCB   9
4249
4250   13C7   0A          FCB   10         * 55 %
4251   13C8   0A          FCB   10
4252   13C9   0A          FCB   10
4253   13CA   0A          FCB   10
4254   13CB   0A          FCB   10
4255   13CC   0A          FCB   10
4256   13CD   0A          FCB   10
4257
4258   13CE   0B          FCB   11         * 60 %
4259   13CF   0B          FCB   11
4260   13D0   0B          FCB   11
4261   13D1   0B          FCB   11
4262   13D2   0B          FCB   11
4263   13D3   0B          FCB   11
4264
4265   13D4   0C          FCB   12         * 65 %
4266   13D5   0C          FCB   12
```

60

```
13D6   0C                    FCB     12
13D7   0C                    FCB     12
13D8   0C                    FCB     12
13D9   0C                    FCB     12
13DA   0C                    FCB     12

13DB   0D                    FCB     13                  * 70 %
13DC   0D                    FCB     13
13DD   0D                    FCB     13
13DE   0D                    FCB     13
13DF   0D                    FCB     13
13E0   0D                    FCB     13

13E1   0E                    FCB     14                  * 75 %
13E2   0E                    FCB     14
13E3   0E                    FCB     14
13E4   0E                    FCB     14
13E5   0E                    FCB     14
13E6   0E                    FCB     14
13E7   0E                    FCB     14

13E8   0F                    FCB     15                  * 80 %
13E9   0F                    FCB     15
13EA   0F                    FCB     15
13EB   0F                    FCB     15
13EC   0F                    FCB     15
13ED   0F                    FCB     15

13EE   10                    FCB     16                  * 85 %
13EF   10                    FCB     16
13F0   10                    FCB     16
13F1   10                    FCB     16
13F2   10                    FCB     16
13F3   10                    FCB     16
13F4   10                    FCB     16

13F5   11                    FCB     17                  * 90 %
13F6   11                    FCB     17
13F7   11                    FCB     17
13F8   11                    FCB     17
13F9   11                    FCB     17
13FA   11                    FCB     17

13FB   12                    FCB     18                  * 95 %
13FC   12                    FCB     18
13FD   12                    FCB     18
13FE   12                    FCB     18
13FF   12                    FCB     18
1400   12                    FCB     18
1401   12                    FCB     18
1402   12                    FCB     18


                    ********************************
                    *                              *
                    *                              *
                    *      PERCENTAGE TABLE        *
```

```
                                  *                                *
                                  *                                *
                                  ***********************************

                                  * MAPS FROM PERCENTAGE TOKENS 0 - 18 TO PACKED DISPLAY CODES

1403  D5                          PERTAB   FCB      $D5                 * 0      5
1404  10                                     FCB      $10                 * 1     10
1405  15                                     FCB      $15                 * 2     15
1406  20                                     FCB      $20                 * 3     20
1407  25                                     FCB      $25                 * 4     25
1408  30                                     FCB      $30                 * 5     30
1409  35                                     FCB      $35                 * 6     35
140A  40                                     FCB      $40                 * 7     40
140B  45                                     FCB      $45                 * 8     45
140C  50                                     FCB      $50                 * 9     50
140D  55                                     FCB      $55                 * 10    55
140E  60                                     FCB      $60                 * 11    60
140F  65                                     FCB      $65                 * 12    65
1410  70                                     FCB      $70                 * 13    70
1411  75                                     FCB      $75                 * 14    75
1412  80                                     FCB      $80                 * 15    80
1413  85                                     FCB      $85                 * 16    85
1414  90                                     FCB      $90                 * 17    90
1415  95                                     FCB      $95                 * 18    95

                                  ***********************************
                                  *                                *
                                  *                                *
                                  *     RESTART DELAY TABLE        *
                                  *                                *
                                  *                                *
                                  ***********************************

                                  * MAPS FROM DELAY TOKENS (0 - 14) TO DELAY PRESET VALUES.

                                  *                PRESET            TOKEN    SECONDS

1416  10                          DELTAB   FCB      16                  * 0      5
1417  21                                     FCB      33                  * 1     10
1418  32                                     FCB      50                  * 2     15
1419  43                                     FCB      67                  * 3     20
141A  53                                     FCB      83                  * 4     25
141B  64                                     FCB      100                 * 5     30
141C  75                                     FCB      117                 * 6     35
141D  85                                     FCB      133                 * 7     40
141E  96                                     FCB      150                 * 8     45
141F  A7                                     FCB      167                 * 9     50
1420  B7                                     FCB      183                 * 10    55
1421  C8                                     FCB      200                 * 11    60
1422  D9                                     FCB      217                 * 12    65
1423  85                                     FCB      133                 * 13    70
1424  FA                                     FCB      250                 * 14    75
```

```
                                  ********************************
                                  *                              *
                                  *                              *
                                  *    CHARACTER SET BITMAP      *
                                  *    FOR BIG DIGITS & ICONS    *
                                  *                              *
                                  ********************************

                                  * EACH DIGIT IS MADE UP OF SIX RAM 'CHARACTERS' WITH A DOT RESOLUTION
                                  * OF 16 X 20 DOTS PER DIGIT. THE CHUNKS OF DIGIT ARE STORED UPPER LEFT
                                  * BYTE, UPPER RIGHT BYTE, NEXT LEFT BYTE, NEXT RIGHT BYTE AND SO ON,
                                  * SINCE THE AND 1013 WANTS THEM IN THAT ORDER IN GRAPHICS MODE.

1425  1F F8 3F FC 7F   FONT0    .BYTE    $1F,$F8,$3F,$FC,$7F,$FE,$FF,$FF        * DIGIT 0
142A  FE FF FF
142D  F8 1F F0 0F F0           .BYTE    $F8,$1F,$F0,$0F,$F0,$0F,$F0,$0F
1432  0F F0 0F
1435  F0 0F F0 0F F0           .BYTE    $F0,$0F,$F0,$0F,$F0,$0F,$F0,$0F
143A  0F F0 0F
143D  F0 0F F0 0F F0           .BYTE    $F0,$0F,$F0,$0F,$F0,$0F,$F8,$1F
1442  0F F8 1F
1445  FF FF 7F FE 3F           .BYTE    $FF,$FF,$7F,$FE,$3F,$FC,$1F,$F8
144A  FC 1F F8
144D  00 00 00 00 00           .BYTE    $00,$00,$00,$00,$00,$00,$00,$00
1452  00 00 00

1455  00 78 00 F8 01   FONT1    .BYTE    $00,$78,$00,$F8,$01,$F8,$03,$F8        * DIGIT 1
145A  F8 03 F8
145D  03 F8 00 78 00           .BYTE    $03,$F8,$00,$78,$00,$78,$00,$78
1462  78 00 78
1465  00 78 00 78 00           .BYTE    $00,$78,$00,$78,$00,$78,$00,$78
146A  78 00 78
146D  00 78 00 78 00           .BYTE    $00,$78,$00,$78,$00,$78,$00,$78
1472  78 00 78
1475  00 78 00 78 00           .BYTE    $00,$78,$00,$78,$00,$78,$00,$78
147A  78 00 78
147D  00 00 00 00 00           .BYTE    $00,$00,$00,$00,$00,$00,$00,$00
1482  00 00 00

1485  1F F8 3F FC 7F   FONT2    .BYTE    $1F,$F8,$3F,$FC,$7F,$FE,$FF,$FF        * DIGIT 2
148A  FE FF FF
148D  F8 1F F0 1F F0           .BYTE    $F8,$1F,$F0,$1F,$F0,$3F,$00,$7E
1492  3F 00 7E
1495  00 FC 01 F8 03           .BYTE    $00,$FC,$01,$F8,$03,$F0,$07,$E0
149A  F0 07 E0
149D  0F C0 1F 80 3F           .BYTE    $0F,$C0,$1F,$80,$3F,$00,$7E,$00
14A2  00 7E 00
14A5  FF FF FF FF FF           .BYTE    $FF,$FF,$FF,$FF,$FF,$FF,$FF,$FF
14AA  FF FF FF
14AD  00 00 00 00 00           .BYTE    $00,$00,$00,$00,$00,$00,$00,$00
14B2  00 00 00

14B5  FF FF FF FF FF   FONT3    .BYTE    $FF,$FF,$FF,$FF,$FF,$FF,$FF,$FF        * DIGIT 3
14BA  FF FF FF
```

60

```
14BD   00 0F 00 1F 00          .BYTE   $00,$0F,$00,$1F,$00,$3F,$00,$7E
14C2   3F 00 7E
14C5   03 FC 03 FC 03          .BYTE   $03,$FC,$03,$FC,$03,$FC,$03,$FC
14CA   FC 03 FE
14CD   00 1F 00 0F F0          .BYTE   $00,$1F,$00,$0F,$F0,$0F,$F8,$1F
14D2   0F F8 1F
14D5   FF FF 7F FE 3F          .BYTE   $FF,$FF,$7F,$FE,$3F,$FC,$1F,$F8
14DA   FC 1F F8
14DD   00 00 00 00 00          .BYTE   $00,$00,$00,$00,$00,$00,$00,$00
14E2   00 00 00

14E5   00 3C 00 7C 00   FONT4  .BYTE   $00,$3C,$00,$7C,$00,$FC,$01,$FC   * DIGIT 4
14EA   FC 01 FC
14ED   03 FC 07 FC 0F          .BYTE   $03,$FC,$07,$FC,$0F,$BC,$1F,$3C
14F2   BC 1F 3C
14F5   3E 3C 7C 3C F8          .BYTE   $3E,$3C,$7C,$3C,$F8,$3C,$FF,$FF
14FA   3C FF FF
14FD   FF FF FF FF FF          .BYTE   $FF,$FF,$FF,$FF,$FF,$FF,$00,$3C
1502   FF 00 3C
1505   00 3C 00 3C 00          .BYTE   $00,$3C,$00,$3C,$00,$3C,$00,$3C
150A   3C 00 3C
150D   00 00 00 00 00          .BYTE   $00,$00,$00,$00,$00,$00,$00,$00
1512   00 00 00

1515   FF FF FF FF FF   FONT5  .BYTE   $FF,$FF,$FF,$FF,$FF,$FF,$FF,$FF   * DIGIT 5
151A   FF FF FF
151D   F0 00 F0 00 F0          .BYTE   $F0,$00,$F0,$00,$F0,$00,$F0,$00
1522   00 F0 00
1525   FF F8 FF FC FF          .BYTE   $FF,$F8,$FF,$FC,$FF,$FE,$FF,$FF
152A   FE FF FF
152D   00 1F 00 0F F0          .BYTE   $00,$1F,$00,$0F,$F0,$0F,$F0,$1F
1532   0F F8 1F
1535   FF FF 7F FE 3F          .BYTE   $FF,$FF,$7F,$FE,$3F,$FC,$1F,$F8
153A   FC 1F F8
153D   00 00 00 00 00          .BYTE   $00,$00,$00,$00,$00,$00,$00,$00
1542   00 00 00

1545   1F F8 3F FC 7F   FONT6  .BYTE   $1F,$F8,$3F,$FC,$7F,$FE,$FF,$FF   * DIGIT 6
154A   FE FF FF
154D   F8 1F F0 0F F0          .BYTE   $F8,$1F,$F0,$0F,$F0,$00,$F0,$00
1552   00 F0 00
1555   FF F8 FF FC FF          .BYTE   $FF,$F8,$FF,$FC,$FF,$FE,$FF,$FF
155A   FE FF FF
155D   F8 1F F0 0F F0          .BYTE   $F8,$1F,$F0,$0F,$F0,$0F,$F8,$1F
1562   0F F0 1F
1565   FF FF 7F FE 3F          .BYTE   $FF,$FF,$7F,$FE,$3F,$FC,$1F,$F8
156A   FC 1F F8
156D   00 00 00 00 00          .BYTE   $00,$00,$00,$00,$00,$00,$00,$00
1572   00 00 00

1575   FF FF FF FF FF   FONT7  .BYTE   $FF,$FF,$FF,$FF,$FF,$FF,$FF,$FF   * DIGIT 7
157A   FF FF FF
157D   00 0F 00 0F 00          .BYTE   $00,$0F,$00,$0F,$00,$1F,$00,$3F
1582   1F 00 3F
1585   00 7E 00 FC 01          .BYTE   $00,$7E,$00,$FC,$01,$F8,$03,$F0
158A   F8 03 F0
158D   07 E0 0F C0 0F          .BYTE   $07,$E0,$0F,$C0,$0F,$80,$0F,$00
```

```
        1592   80 0F 00
4450    1595   0F 00 0F 00 0F              .BYTE    $0F,$00,$0F,$00,$0F,$00,$0F,$00
        159A   00 0F 00
4451    159D   00 00 00 00 00              .BYTE    $00,$00,$00,$00,$00,$00,$00,$00
        15A2   00 00 00
4452
4453    15A5   1F F8 3F FC 7F   FONT8      .BYTE    $1F,$F8,$3F,$FC,$7F,$FE,$FF,$FF      * DIGIT 8
        15AA   FE FF FF
4454    15AD   F8 1F F0 0F F0              .BYTE    $F8,$1F,$F0,$0F,$F0,$0F,$F8,$1F
        15B2   0F F8 1F
4455    15B5   7F FE 3F FC 3F              .BYTE    $7F,$FE,$3F,$FC,$3F,$FC,$7F,$FE
        15BA   FC 7F FE
4456    15BD   F8 1F F0 0F F0              .BYTE    $F8,$1F,$F0,$0F,$F0,$0F,$F8,$1F
        15C2   0F F8 1F
4457    15C5   FF FF 7F FE 3F              .BYTE    $FF,$FF,$7F,$FE,$3F,$FC,$1F,$F0
        15CA   FC 1F F8
4458    15CD   00 00 00 00 00              .BYTE    $00,$00,$00,$00,$00,$00,$00,$00
        15D2   00 00 00
4459
4460    15D5   1F F8 3F FC 7F   FONT9      .BYTE    $1F,$F8,$3F,$FC,$7F,$FE,$FF,$FF      * DIGIT 9
        15DA   FE FF FF
4461    15DD   F8 1F F0 0F F0              .BYTE    $F8,$1F,$F0,$0F,$F0,$0F,$F8,$1F
        15E2   0F F8 1F
4462    15E5   FF FF 7F FF 3F              .BYTE    $FF,$FF,$7F,$FF,$3F,$FF,$1F,$FF
        15EA   FF 1F FF
4463    15ED   00 0F 00 0F F0              .BYTE    $00,$0F,$00,$0F,$F0,$0F,$F8,$1F
        15F2   0F F8 1F
4464    15F5   FF FF 7F FE 3F              .BYTE    $FF,$FF,$7F,$FE,$3F,$FC,$1F,$F8
        15FA   FC 1F F8
4465    15FD   00 00 00 00 00              .BYTE    $00,$00,$00,$00,$00,$00,$00,$00
        1602   00 00 00
4466
4467    1605   00 C0 01 C0 03   FONTL      .BYTE    $00,$C0,$01,$C0,$03,$C0,$07,$C0      * LEFT ARROW
        160A   C0 07 C0
4468    160D   0F C0 1F FF 3F              .BYTE    $0F,$C0,$1F,$FF,$3F,$FF,$7F,$FF
        1612   FF 7F FF
4469    1615   FF FF 7F FF 3F              .BYTE    $FF,$FF,$7F,$FF,$3F,$FF,$1F,$FF
        161A   FF 1F FF
4470    161D   0F C0 07 C0 03              .BYTE    $0F,$C0,$07,$C0,$03,$C0,$01,$C0
        1622   C0 01 C0
4471    1625   00 C0 00 00 00              .BYTE    $00,$C0,$00,$00,$00,$00,$00,$00
        162A   00 00 00
4472    162D   00 00 00 00 00              .BYTE    $00,$00,$00,$00,$00,$00,$00,$00
        1632   00 00 00
4473
4474
4475    1635   03 00 03 80 03   FONTR      .BYTE    $03,$00,$03,$80,$03,$C0,$03,$E0      * RIGHT ARROW
        163A   C0 03 E0
4476    163D   03 F0 FF F8 FF              .BYTE    $03,$F0,$FF,$F8,$FF,$FC,$FF,$FF
        1642   FC FF FE
4477    1645   FF FF FF FE FF              .BYTE    $FF,$FF,$FF,$FE,$FF,$FC,$FF,$F8
        164A   FC FF F8
4478    164D   03 F0 03 E0 03              .BYTE    $03,$F0,$03,$E0,$03,$C0,$03,$C0
        1652   C0 03 80
4479    1655   03 00 00 00 00              .BYTE    $03,$00,$00,$00,$00,$00,$00,$00
        165A   00 00 00
4480    165D   00 00 00 00 00              .BYTE    $00,$00,$00,$00,$00,$00,$00,$00
```

```
GO

        1662   00 00 00
4481
4482    1665   FF FF FF FF 7F   FONTT    .BYTE    $FF,$FF,$FF,$FF,$7F,$FE,$3F,$FC        * TEE ICON
        166A   FE 3F FC
4483    166D   1F F8 0F F0 07            .BYTE    $1F,$F8,$0F,$F0,$07,$E0,$03,$C0
        1672   E0 03 C0
4484    1675   03 C0 03 C0 03            .BYTE    $03,$C0,$03,$C0,$03,$C0,$03,$C0
        167A   C0 03 C0
4485    167D   03 C0 03 C0 03            .BYTE    $03,$C0,$03,$C0,$03,$C0,$03,$C0
        1682   C0 03 C0
4486    1685   03 C0 00 00 00            .BYTE    $03,$C0,$00,$00,$00,$00,$00,$00
        168A   00 00 00
4487    168D   00 00 00 00 00            .BYTE    $00,$00,$00,$00,$00,$00,$00,$00
        1692   00 00 00
4488
4489    1695   00 00 00 00 00   FONTB    .BYTE    $00,$00,$00,$00,$00,$00,$00,$00        * BLANK SPACE
        169A   00 00 00
4490    169D   00 00 00 00 00            .BYTE    $00,$00,$00,$00,$00,$00,$00,$00
        16A2   00 00 00
4491    16A5   00 00 00 00 00            .BYTE    $00,$00,$00,$00,$00,$00,$00,$00
        16AA   00 00 00
4492    16AD   00 00 00 00 00            .BYTE    $00,$00,$00,$00,$00,$00,$00,$00
        16B2   00 00 00
4493    16B5   00 00 00 00 00            .BYTE    $00,$00,$00,$00,$00,$00,$00,$00
        16BA   00 00 00
4494    16BD   00 00 00 00 00            .BYTE    $00,$00,$00,$00,$00,$00,$00,$00
        16C2   00 00 00
4495
4496    16C5   00 7F 00 FF 01   FONTD    .BYTE    $00,$7F,$00,$FF,$01,$C0,$03,$80        * BULLSEYE LEFT
        16CA   C0 03 80
4497    16CD   07 1F 0E 3F 0C            .BYTE    $07,$1F,$0E,$3F,$0C,$70,$0E,$F0
        16D2   70 0C E0
4498    16D5   0C C7 0C CF 0C            .BYTE    $0C,$C7,$0C,$CF,$0C,$CC,$0C,$CC
        16DA   CC 0C CC
4499    16DD   0C CC 0C CC 0C            .BYTE    $0C,$CC,$0C,$CC,$0C,$CF,$0C,$C7
        16E2   CF 0C C7
4500    16E5   0C E0 0C 70 0E            .BYTE    $0C,$E0,$0C,$70,$0E,$3F,$07,$1F
        16EA   3F 07 1F
4501    16ED   03 80 01 C0 00            .BYTE    $03,$80,$01,$C0,$00,$FF,$00,$7F
        16F2   FF 00 7F
4502
4503    16F5   FE 00 FF 00 03   FONTE    .BYTE    $FE,$00,$FF,$00,$03,$80,$01,$C0        * BULLSEYE RIGHT
        16FA   80 01 C0
4504    16FD   F8 E0 FC 70 0E            .BYTE    $F8,$E0,$FC,$70,$0E,$30,$07,$30
        1702   30 07 30
4505    1705   E3 30 F3 30 33            .BYTE    $E3,$30,$F3,$30,$33,$30,$33,$30
        170A   30 33 30
4506    170D   33 30 33 30 F3            .BYTE    $33,$30,$33,$30,$F3,$30,$E3,$30
        1712   30 E3 30
4507    1715   07 30 0E 30 FC            .BYTE    $07,$30,$0E,$30,$FC,$70,$F0,$E0
        171A   70 F8 E0
4508    171D   01 C0 03 80 FF            .BYTE    $01,$C0,$03,$80,$FF,$00,$FE,$00
        1722   00 FE 00
4509
4510
4511
4512                            ********************************
```

```
                                  *                                *
                                  *                                *
                                  *            FEET                *
                                  *                                *
                                  *                                *
                                  ***********************************

                                  * LEFT FOOT OUTLINE TABLE

1725   1FFC 2002 4001             FOOTL    FDB      $1FFC,$2002,$4001
172B                                       BLKW     11,$8001
1741   8002 8004 8004                      FDB      $8002,$8004,$8004
1747   8004 8004 7FF8                      FDB      $8004,$8004,$7FF8,0,0,$7FF8,$8004
174D   0000 0000 7FF8
1753   8004
1755                                       BLKW     16,$8004
1775   4008 3FF0                           FDB      $4008,$3FF0

                                  * LEFT FOOT FILL TABLE, OFFSET FROM 'FOOTL' BY 84 BYTES

1779   0000 1FFC 3FFC                      FDB      0,$1FFC,$3FFC
177F                                       BLKW     14,$7FFC
179B   7FF8 7FF8 0000                      FDB      $7FF8,$7FF8,0,0,0,0,$7FF8,$7FF8
17A1   0000 0000 0000
17A7   7FF8 7FF8
17AB                                       BLKW     15,$7FFC
17C9   3FF8 0000                           FDB      $3FF8,0

                                  * RIGHT FOOT OUTLINE TABLE

17CD   3FF8 4004 8002             FOOTR    FDB      $3FF8,$4004,$8002
17D3                                       BLKW     11,$8001
17E9   4001 2001 2001                      FDB      $4001,$2001,$2001
17EF   2001 2001 1FFE                      FDB      $2001,$2001,$1FFE,0,0,$1FFE,$2001
17F5   0000 0000 1FFE
17FB   2001
17FD                                       BLKW     16,$2001
181D   1002 0FFC                           FDB      $1002,$0FFC

                                  * RIGHT FOOT FILL TABLE, OFFSET FROM 'FOOTR' BY 84 BYTES

1821   0000 3FF8 3FFC                      FDB      0,$3FF8,$3FFC
1827                                       BLKW     14,$3FFF
1843   1FFE 1FFE 0000                      FDB      $1FFE,$1FFE,0,0,0,0,$1FFE,$1FFE
1849   0000 0000 0000
184F   1FFE 1FFE
1853                                       BLKW     15,$3FFC
1871   1FFC 0000                           FDB      $1FFC,0


                                  * ADDRESS TABLE FOR CHARACTER FONTS AND FEET

1875   1425                       DTAB     FDB      FONT0                    * 0
1877   1455                                FDB      FONT1                    * 1
```

```
1879   14B5          FDB     FONT2        * 2
187B   14B5          FDB     FONT3        * 3
187D   14E5          FDB     FONT4        * 4
187F   1515          FDB     FONT5        * 5
18B1   1545          FDB     FONT6        * 6
18B3   1575          FDB     FONT7        * 7
18B5   15A5          FDB     FONT8        * 8
18B7   15D5          FDB     FONT9        * 9
18B9   1605          FDB     FONTL        * LEFT ARROW
18BB   1635          FDB     FONTR        * RIGHT ARROW
18BD   1665          FDB     FONTT        * TEE ICON
18BF   1695          FDB     FONTB        * BLANK SPACE
1891   16C5          FDB     FONTD        * BULLSEYE LEFT
1893   16F5          FDB     FONTF        * BULLSEYE RIGHT
1895   1725          FDB     FOOTL        * LEFT FOOT
1897   17CD          FDB     FOOTR        * RIGHT FOOT

                 * CURSOR ARROW TABLE

18B9   10        BIRD    FCB     $10      *   *
18BA   10                FCB     $10      *   *
18BB   10                FCB     $10      *   *
18BC   78                FCB     $78      * ****
18BD   7C                FCB     $7C      * *****
18BE   78                FCB     $78      * ****
18BF   30                FCB     $30      *  ***
18A0   30                FCB     $30      *  ***

                 ********************************
                 *                              *
                 *                              *
                 *     TEXT STRING TABLES       *
                 *                              *
                 *                              *
                 ********************************

18A1   18CF      STRTAB  FDB     NLSTR
18A3   190D              FDB     NLSSTR
18A5   1921              FDB     SHSTR
18A7   194B              FDB     PHSTR
18A9   1989              FDB     CMSTR
18AB   1A05              FDB     BLSTR
18AD   1A19              FDB     BLSSTR
18AF   19B3              FDB     ERSTR
18B1   1A2D              FDB     BNSTR
18B3   1A93              FDB     BDSTR
18B5   1AD1              FDB     NASTR
18B7   1B0F              FDB     MVFSTR
18B9   1B4D              FDB     MVESTR1
18BB   1B8B              FDB     BSPSTR
18BD   1BC9              FDB     BSMSTR1
18BF   1C07              FDB     IMPSTR
```

00

```
18C1   1C45                          FDB     IMPSTR1
18C3   1C83                          FDB     ESPSTR
18C5   1CC1                          FDB     ESPSTR1
18C7   1CFF                          FDB     DELSTR
18C9   1D65                          FDB     SUPSTR
18CB   1E1D                          FDB     LFTSTR
18CD   1E31                          FDB     RTFSTR

                          *                   ....X....X....X....X
18CF   20 20 20 20 20     NLSTR      FCC     '
18D4   20 20 20 20 20
18D9   20 20 20 20 20
18DE   20 20 20 20 20
18E3   20 20 20 20 20                FCC     '
18E8   20 20 20 20 20
18ED   20 20 20 20 20
18F2   20 20 20 20 20
18F7   00                            FCB     0
18FB   20 20 20 20 20                FCC     '                    '
18FD   20 20 20 20 20
1902   20 20 20 20 20
1907   20 20 20 20 20
190C   00                            FCB     0

                          *                   ....X....X....X....
190D   20 20 20 20 20     NLSSTR     FCC     '              DONE->'
1912   20 20 20 20 20
1917   20 20 20 44 4F
191C   4E 45 2D 3E
1920   00                            FCB     0

                          *                   ....X....X....X....X
1921   2B 4C 45 46 54     SMSTR      FCC     '+LEFT          +RIGHT'
1926   20 20 20 20 20
192B   20 20 20 20 2B
1930   52 49 47 48 54
1935   00                            FCB     0
1936   53 45 54 20 54                FCC     'SET TAKEAWAY WEIGHT '
193B   41 4B 45 41 57
1940   41 59 20 57 45
1945   49 47 48 54 20
194A   00                            FCB     0

                          *                   ....X....X....X....X
194B   20 20 20 20 20     FMSTR      FCC     '        READY       '
1950   20 20 52 45 41
1955   44 59 20 20 20
195A   20 20 20 20 20
195F   20 20 20 20 20                FCC     '                    '
1964   20 20 20 20 20
1969   20 20 20 20 20
196E   20 20 20 20 20
1973   00                            FCB     0
1974   20 20 20 20 20     '          FCC     '
```

```
        60

        1979   20 20 20 20 20
        197E   20 20 20 20 20
        1983   20 20 20 20 20
4652    1988   00                          FCB     0
4653
4654
4655                                *                   ....X....X....X....X
4656    1989   4C 49 47 48 54      CNSTR   FCC     'LIGHTER        DARKER'
        198E   45 52 20 20 20
        1993   20 20 20 20 44
        1998   41 52 4B 45 52
4657    199D   00                          FCB     0
4658    199E   53 45 54 20 44              FCC     'SET DISPLAY CONTRAST'
        19A3   49 53 50 4C 41
        19A8   59 20 43 4F 4E
        19AD   54 52 41 53 54
4659    19B2   00                          FCB     0
4660
4661
4662
4663                                *                   ....X....X....X....X
4664    19B3   20 20 20 20 20      ERSTR   FCC     '        RESET        '
        19B8   20 20 52 45 53
        19BD   45 54 20 20 20
        19C2   20 20 20 20 20
4665    19C7   20 20 20 20 20              FCC     '                     '
        19CC   20 20 20 20 20
        19D1   20 20 20 20 20
        19D6   20 20 20 20 20
4666    19DB   20 20 20 20 53              FCC     '    SYSTEM ERROR     '
        19E0   59 53 54 45 4D
        19E5   20 45 52 52 4F
        19EA   52 20 20 20 20
4667    19EF   00                          FCB     0
4668    19F0   20 20 20 20 20              FCC     '                     '
        19F5   20 20 20 20 20
        19FA   20 20 20 20 20
        19FF   20 20 20 20 20
4669    1A04   00                          FCB     0
4670
4671
4672                                *                   ....X....X....X....
4673    1A05   42 41 54 54 45      BLSTR   FCC     'BATTERY LOW          '
        1A0A   52 59 20 4C 4F
        1A0F   57 20 20 20 20
        1A14   20 20 20 20
4674    1A18   00                          FCB     0
4675
4676
4677                                *                   ....X....X....X....
4678    1A19   42 41 54 54 45      BLSSTR  FCC     'BATTERY LOW  DONE->'
        1A1E   52 59 20 4C 4F
        1A23   57 20 20 44 4F
        1A28   4E 45 2D 3F
4679    1A2C   00                          FCB     0
4680
4681
```

```
GO

4682                                  *                    ....X....X....X....X
4683   1A2D   20 20 53 26 42   BNSTR     FCC        '  S&B ELECTRONICS   '
       1A32   20 45 4C 45 43
       1A37   54 52 4F 4E 49
       1A3C   43 53 20 20 20
4684   1A41   20 20 20 20 20             FCC        '                    '
       1A46   20 20 20 20 20
       1A4B   20 20 20 20 20
       1A50   20 20 20 20 20
4685   1A55   20 20 57 45 49             FCC        '  WEIGHT SHIFTER    '
       1A5A   47 48 54 20 53
       1A5F   48 49 46 54 45
       1A64   52 20 20 20 20
4686   1A69   00                         FCB        0
4687   1A6A   20 20 20 20 28             FCC        '    (C.) 1990       '
       1A6F   43 2E 29 20 31
       1A74   39 39 30 20 20
       1A79   20 20 20 20 20
4688   1A7E   20 20 20 20 20             FCC        '     VER 1.3        '
       1A83   56 45 52 20 31
       1A88   2E 33 20 20 20
       1A8D   20 20 20 20 20
4689   1A92   00                         FCB        0
4690
4691
4692                                  *                    ....X....X....X....X
4693   1A93   20 20 20 20 20   BDSTR     FCC        '       REGIONAL  SWING'
       1A98   20 52 45 53 54
       1A9D   41 52 54 20 20
       1AA2   53 57 49 4E 47
4694   1AA7   20 20 20 20 20             FCC        '                 MOVIE'
       1AAC   20 20 20 20 20
       1AB1   20 20 20 20 20
       1AB6   4D 4F 56 49 45
4695   1ABB   00                         FCB        0
4696   1ABC   20 20 20 20 20             FCC        '                    '
       1AC1   20 20 20 20 20
       1AC6   20 20 20 20 20
       1ACB   20 20 20 20 20
4697   1AD0   00                         FCB        0
4698
4699
4700                                  *                    ....X....X....X....X
4701   1AD1   20 20 20 20 20   MASTR     FCC        '        WHITE   SWING'
       1AD6   20 20 41 55 54
       1ADB   4F 20 20 20 20
       1AE0   53 57 49 4E 47
4702   1AE5   20 20 20 20 20             FCC        '                 MOVIE'
       1AEA   20 20 20 20 20
       1AEF   20 20 20 20 20
       1AF4   4D 4F 56 49 45
4703   1AF9   00                         FCB        0
4704   1AFA   20 20 20 20 20             FCC        '                    '
       1AFF   20 20 20 20 20
       1B04   20 20 20 20 20
       1B09   20 20 20 20 20
4705   1B0E   00                         FCB        0
```

```
        GO

4706
4707                                    *                   ....X....X....X....X
4708    1B0F    20 20 20 20 20          MVESTR   FCC        '          STOP'
        1B14    20 20 20 53 54
        1B19    4F 50 20 20 20
        1B1E    20 20 20 20 20
4709    1B23    20 20 20 20 20                   FCC        '                    '
        1B28    20 20 20 20 20
        1B2D    20 20 20 20 20
        1B32    20 20 20 20 20
4710    1B37    00                               FCB        0
4711    1B38    20 2B 2D 2D 2D                   FCC        ' +----+----**----+----+ '
        1B3D    2B 2D 2D 2D 2A
        1B42    2A 2D 2D 2D 2B
        1B47    2D 2D 2D 2B 20
4712    1B4C    00                               FCB        0
4713
4714                                    *                   ....X....X....X....X
4715    1B4D    3C 2D 20 20 20          MVESTR1  FCC        '<-        GO        ->'
        1B52    20 20 20 20 47
        1B57    4F 20 20 20 20
        1B5C    20 20 20 2D 3E
4716    1B61    20 20 20 20 20                   FCC        '                    '
        1B66    20 20 20 20 20
        1B6B    20 20 20 20 20
        1B70    20 20 20 20 20
4717    1B75    00                               FCB        0
4718    1B76    20 2B 2D 2D 2D                   FCC        ' +----+----**----+----+ '
        1B7B    2B 2D 2D 2D 2A
        1B80    2A 2D 2D 2D 2B
        1B85    2D 2D 2D 2B 20
4719    1B8A    00                               FCB        0
4720
4721                                    *                   ....X....X....X....X
4722    1B8B    20 20 20 20 20          BSPSTR   FCC        '          STOP'
        1B90    20 20 20 53 54
        1B95    4F 50 20 20 20
        1B9A    20 20 20 20 20
4723    1B9F    20 20 20 42 41                   FCC        '   BACKSWING PEAK   '
        1BA4    43 4B 53 57 49
        1BA9    4E 47 20 50 45
        1BAE    41 4B 20 20 20
4724    1BB3    00                               FCB        0
4725    1BB4    20 2B 2D 2D 2D                   FCC        ' +----+----**----+----+ '
        1BB9    2B 2D 2D 2D 2A
        1BBE    2A 2D 2D 2D 2B
        1BC3    2D 2D 2D 2B 20
4726    1BC8    00                               FCB        0
4727
4728                                    *                   ....X....X....X....X
4729    1BC9    3C 2D 20 20 20          BSPSTR1  FCC        '<-        GO        ->'
        1BCE    20 20 20 20 47
        1BD3    4F 20 20 20 20
        1BD8    20 20 20 2D 3E
4730    1BDD    20 20 20 42 41                   FCC        '   BACKSWING PEAK   '
        1BE2    43 4B 53 57 49
        1BE7    4E 47 20 50 45
```

```
GO

        1BEC   41 4B 20 20 20
4731    1BF1   00                          FCB      0
4732    1BF2   20 2B 2D 2D 2D              FCC      ' +---+---**---+---+ '
        1BF7   2B 2D 2D 2D 2A
        1BFC   2A 2D 2D 2D 2B
        1C01   2D 2D 2D 2B 20
4733    1C06   00                          FCB      0
4734
4735                                  *               ....X....X....X....X
4736    1C07   20 20 20 20 20   IMPSTR     FCC      '         STOP         '
        1C0C   20 20 20 53 54
        1C11   4F 50 20 20 20
        1C16   20 20 20 20 20
4737    1C1B   20 20 20 20 20              FCC      '        IMPACT        '
        1C20   20 20 49 4D 50
        1C25   41 43 54 20 20
        1C2A   20 20 20 20 20
4738    1C2F   00                          FCB      0
4739    1C30   20 2B 2D 2D 2D              FCC      ' +---+---**---+---+ '
        1C35   2B 2D 2D 2D 2A
        1C3A   2A 2D 2D 2D 2B
        1C3F   2D 2D 2D 2B 20
4740    1C44   00                          FCB      0
4741
4742                                  *               ....X....X....X....X
4743    1C45   3C 2D 20 20 20   IMPSTR1    FCC      '<-        GO        ->'
        1C4A   20 20 20 20 47
        1C4F   4F 20 20 20 20
        1C54   20 20 20 2D 3E
4744    1C59   20 20 20 20 20              FCC      '        IMPACT        '
        1C5E   20 20 49 4D 50
        1C63   41 43 54 20 20
        1C68   20 20 20 20 20
4745    1C6D   00                          FCB      0
4746    1C6E   20 2B 2D 2D 2D              FCC      ' +---+---**---+---+ '
        1C73   2B 2D 2D 2D 2A
        1C78   2A 2D 2D 2D 2B
        1C7D   2D 2D 2D 2B 20
4747    1C82   00                          FCB      0
4748
4749                                  *               ....X....X....X....X
4750    1C83   20 20 20 20 20   FSPSTR     FCC      '         STOP         '
        1C88   20 20 20 53 54
        1C8D   4F 50 20 20 20
        1C92   20 20 20 20 20
4751    1C97   20 20 20 46 4F              FCC      '   FORESHING PEAK     '
        1C9C   52 45 53 57 49
        1CA1   4E 47 20 50 45
        1CA6   41 4B 20 20 20
4752    1CAB   00                          FCB      0
4753    1CAC   20 2B 2D 2D 2D              FCC      ' +---+---**---+---+ '
        1CB1   2B 2D 2D 2D 2A
        1CB6   2A 2D 2D 2D 2B
        1CBB   2D 2D 2D 2B 20
4754    1CC0   00                          FCB      0
4755
4756                                  *               ....X....X....X....X
```

```
        00

4757    1CC1    3C 2D 20 20 20   FSPSTR1  FCC      '<-        [4]        ->'
        1CC6    20 20 20 20 47
        1CCB    4F 20 20 20 20
        1CD0    20 20 20 2D 3E
4758    1CD5    20 20 20 46 4F            FCC      '   FORESWING PEAK   '
        1CDA    52 45 53 57 49
        1CDF    4E 47 20 50 45
        1CE4    41 4B 20 20 20
4759    1CE9    00                        FCB      0
4760    1CEA    20 2B 2D 2D 2D            FCC      '  |----+----*X----+----+ '
        1CEF    2B 2D 2D 2D 2A
        1CF4    2A 2D 2D 2D 2B
        1CF9    2D 2D 2D 2B 20
4761    1CFE    00                        FCB      0
4762
4763                             *                  ....X....X....X....X
4764    1CFF    53 48 4F 52 54   DELSTR   FCC      'SHORTER        LONGER'
        1D04    45 52 20 20 20
        1D09    20 20 20 20 4C
        1D0E    4F 4E 47 45 52
4765    1D13    00                        FCB      0
4766    1D14    20 53 45 54 20            FCC      ' SET RESTART DELAY  '
        1D19    52 45 53 54 41
        1D1E    52 54 20 44 45
        1D23    4C 41 59 20 20
4767    1D28    20 20 20 20 20            FCC      '                    '
        1D2D    20 20 20 20 20
        1D32    20 20 20 20 20
        1D37    20 20 20 20 20
4768    1D3C    20 20 20 20 20            FCC      '                    '
        1D41    20 20 20 20 20
        1D46    20 20 20 20 20
        1D4B    20 20 20 20 20
4769    1D50    44 45 4C 41 59            FCC      'DELAY=        SECONDS'
        1D55    3D 20 20 20 20
        1D5A    20 20 20 53 45
        1D5F    43 4F 4E 44 53
4770    1D64    00                        FCB      0
4771
4772                             *                  ....X....X....X....X
4773    1D65    54 41 4B 45 41   SUPSTR   FCC      'TAKEAWAY       RESTART'
        1D6A    57 41 59 20 20
        1D6F    20 20 20 52 45
        1D74    53 54 41 52 54
4774    1D79    57 45 49 47 48            FCC      'WEIGHT         DELAY'
        1D7E    54 20 20 20 20
        1D83    20 20 20 20 20
        1D88    44 45 4C 41 59
4775    1D8D    20 20 20 20 20            FCC      '                    '
        1D92    20 20 20 20 20
        1D97    20 20 20 20 20
        1D9C    20 20 20 20 20
4776    1DA1    20 20 20 20 20            FCC      '       COUNTDOWN    '
        1DA6    20 43 4F 4E 54
        1DAB    52 41 53 54 20
        1DB0    20 20 20 20 20
4777    1DB5    20 20 20 20 20            FCC      '
```

```
80

      1DB0   20 20 20 20 20
      1DB5   20 20 20 20 20
      1DC4   20 20 20 20 20
4778  1DC9   20 20 20 20 20          FCC      '                    '
      1DCE   20 20 20 20 20
      1DD3   20 20 20 20 20
      1DD8   20 20 20 20 20
4779  1DDD   20 20 20 20 20          FCC      '                    '
      1DE2   20 20 20 20 20
      1DE7   20 20 20 20 20
      1DEC   20 20 20 20 20
4780  1DF1   50 52 45 53 53          FCC      'PRESS TOP BUTTON TO '
      1DF6   20 54 4F 50 20
      1DFB   42 55 54 54 4F
      1E00   4E 20 54 4F 20
4781  1E05   00                      FCB      0
4782  1E06   20 53 45 4C 45          FCC      ' SELECT SETUP ITEM  '
      1E0B   43 54 20 53 45
      1E10   54 55 50 20 49
      1E15   54 45 4D 20 20
4783  1E1A   00                      FCB      0
4784
4785
4786                          *                 ....X....X....X....X
4787  1E1B   00               LFTSTR   FCB      0
4788  1E1C   20 20 20 20 20          FCC      '     LEFT FOOT      '
      1E21   4C 45 46 54 20
      1E26   46 4F 4F 54 20
      1E2B   20 20 20 20 20
4789  1E30   00                      FCB      0
4790
4791
4792                          *                 ...!X....X....X....X
4793  1E31   00               RTFSTR   FCB      0
4794  1E32   20 20 20 20 20          FCC      '     RIGHT FOOT     '
      1E37   52 49 47 48 54
      1E3C   20 46 4F 4F 54
      1E41   20 20 20 20 20
4795  1E46   00                      FCB      0
4796
4797
4798                          ********************************
4799                          *                              *
4800                          *                              *
4801                          *     COPYRIGHT STRING         *
4802                          *                              *
4803                          *                              *
4804                          ********************************
4805
4806
4807  1E47   0D 0A             COPY     FCB      $0D,$0A
4808  1E49   53 20 26 20 42          FCC      "S & B ELECTRONICS' WEIGHT SHIFTER"
      1E4E   20 45 4C 45 43
      1E53   54 52 4F 4E 49
      1E58   43 53 27 20 57
      1E5D   45 49 47 48 54
      1E62   20 53 48 49 46
```

```
GO

        1E67   54 45 52
4809    1E6A   0D 0A 0A                FCB     $D,$A,$A
4810    1E6D   43 4F 50 59 52          FCC     'COPYRIGHT (C) 1990 BY THE MICRO WORKS
        1E72   49 47 48 54 29
        1E77   28 43 2E 29 20
        1E7C   31 39 39 30 20
        1E81   42 59 20 54 48
        1E86   45 20 4D 49 43
        1E8B   52 4F 20 57 4F
        1E90   52 4B 53
4811    1E93   0D 0A                   FCB     $D,$A
4812    1E95   41 4E 44 20 53          FCC     'AND S & V ELECTRONICS.'
        1E9A   20 26 20 42 20
        1E9F   45 4C 45 43 54
        1EA4   52 4F 4E 49 43
        1EA9   53 2E
4813    1EAB   0D 0A 0A 00             FCB     $D,$A,$A,0
4814
4815
4816                          ********************************
4817                          *                              *
4818                          *                              *
4819                          *     INTERRUPT VECTORS        *
4820                          *                              *
4821                          *                              *
4822                          ********************************
4823
4824
4825    1FF4                           ORG     RSV
4826
4827    1FF4   10AE                    FDB     ANRTI           * SPI VECTOR
4828    1FF6   10AE                    FDB     ANRTI           * SCI VECTOR - RS232 PORT
4829    1FF8   0DFF                    FDB     TINT            * TIMER VECTOR - 10 mSEC. TIMER
4830    1FFA   10AE                    FDB     ANRTI           * IRQ VECTOR - NOT USED
4831    1FFC   10AE                    FDB     ANRTI           * SWI VECTOR - OUTPUT CHARACTER
4832
4833    1FFE   0180                    FDB     RESET           * RESET VECTOR
4834
4835    2000                           END

        Lines Assembled :  4835          Assembly Errors :  0
```

We claim:

1. A golf swing balance analyzer which comprises:

a pair of individually positionable pads adapted to be positioned on the ground and to support a golfer in a normal golf stance during a golf swing with one foot on each pad;

each of the pads being sized to support an entire shoe with a first portion adapted to receive the toe of a shoe and a second portion adapted to receive the heel of a shoe;

weight measuring means in each pad to measure relative weight on each pad and to separately measure relative weight on said first portion and on said second portion;

control means adapted to receive weight indicating signals from said weight measuring means and adapted to generate display signals corresponding to those weight indicating signals;

electrical cable connecting said weight measuring means to said control means;

display means adapted to receive said display signals and display indicia indicative of weight distribution between said pads and between the first and second portions of said pads at selected points during a golf swing and to combine and display indicia summarizing weight distribution changes during said swing.

2. The golf swing balance analyzer according to claim 1 including means for displaying the percentage of a golfer's total weight on a selected foot at a plurality of points through a swing.

3. The golf swing balance analyzer according to claim 2 including means for detecting three points through a swing, said three points comprising the peak back swing, moment of impact with a normally positioned golf ball and peak foreswing and wherein said display displays the percentage of a golfer's total weight on the selected foot at said peak backswing, impact with said golf ball and at said peak foreswing.

4. The golf swing balance analyzer according to claim 3 wherein said means for detecting said peak backswing includes means for detecting the moment of maximum weight shift to a selected one of a golfer's feet.

5. The golf swing balance analyzer according to claim 3 wherein said means for detecting said moment of impact includes a sensor for sensing the sound of impact of golf club against said golf ball.

6. The golf swing balance analyzer according to claim 3 wherein said means for detecting said peak foreswing includes means for detecting the moment of maximum weight shift to a selected one of a golfer's feet.

7. The golf swing balance analyzer according to claim 3 wherein said display includes means for displaying weight shift between the feet of the golfer at each of the three points in sequence.

8. The golf swing balance analyzer according to claim 3 wherein said display includes means or simultaneously displaying said weight shift at each of said three points.

9. The golf swing balance analyzer according to claim 3 wherein said display includes means for simultaneously displaying separately said weight on the heel and toe at each of said three points.

10. The golf swing balance analyzer according to claim 1 wherein said display means includes means for separately graphically indicating the ratio of weight on the heel and toe of each foot at peak backswing, moment of impact with a golf ball and peak foreswing.

11. The golf swing balance analyzer according to claim 10 wherein said separately display includes means for displaying said weight on the heel and toe of each foot at each of the three points in sequence.

12. The golf swing balance analyzer according to claim 1 including means for selectively varying display contrast.

13. The golf swing balance analyzer according to claim 1 including means for selectively varying the weight balance between the pads with a golfer standing on said pads prior to initiating a golf swing.

14. The golf swing balance analyzer according to claim 1 including means or storing and replaying a previous swing and providing data on that swing on a continuous basis.

15. The golf swing balance analyzer according to claim 1 including means of selecting an automatic or manual reset of the analyzer after a golf swing and further including means for selectively varying reset delay in the automatic reset mode.

16. The golf swing balance analyzer according to claim 1 including means or selecting between a swing to the left where the right foot is the rear foot and a swing to the right where the left foot is the rear foot.

17. The golf swing balance analyzer according to claim 1 wherein each of said pads includes a base, a flexible weight sensing means on said base, a solid sheet to prevent golf shoe spikes from directly contacting said weight sensing means and a carpet-like top sheet.

18. The golf swing balance analyzer according to claim 17 wherein said pads further includes a plurality of tabs extending laterally from said pads having holes parallel to the ground whereby pegs can be inserted through said holes into the ground to aid in preventing slipping of said pads on the ground during use.

19. A golf swing analyzer which comprises:

a pair of pads adapted to be positioned on the ground and to support a golfer in a normal stance during a golf swing with one foot on each pad;

each of said pads being sized to support an entire shoe with a first pad portion adapted to receive the toe of a shoe with a second pad portion adapted to receive the heel of a shoe;

weight measuring means in each pad adapted to measure total weight on each pad and to measure weight on said first portion and said second portion;

control means adapted to receive weight indicating signals from said weight measuring means and adapted to generate display signals corresponding to weight indicating signals detected at peak backswing, point of impact with a golf ball and peak foreswing;

electrical cable connecting said weight measuring means to said control means;

display means adapted to receive display signals and display indicia indicative of the percentage of a golfer's weight on each of said pads and the percentage distribution of a golfer's weight between said first and second portions of said pads at peak backswing, said point of impact and said peak foreswing during said swing;

said display means including means for selectively displaying weight shift indicia for said peak backswing, said point of impact and said peak foreswing sequentially in a simultaneous combined display.

20. The golf swing balance analyzer according to claim 19 wherein said means for detecting said peak backswing includes means for detecting the moment of maximum weight shift from one pad to the other.

21. The golf swing balance analyzer according to claim 19 wherein said means for detecting said moment of impact includes a sensor for sensing the sound of impact of golf club against said golf ball.

22. The golf swing balance analyzer according to claim 19 wherein said means for detecting said peak foreswing includes means for detecting the moment of maximum weight shift from one pad to the other.

23. The golf swing balance analyzer according to claim 19 wherein said display means includes means for graphically indicating the percentage of weight on the heel and toe of each foot at peak backswing, moment of impact with a golf ball and peak foreswing.

24. The golf swing balance analyzer according to claim 19 wherein said display includes means for displaying said weight on the heel and toe of each foot at each of the three points in sequence.

25. The golf swing balance analyzer according to claim 19 including means for selectively varying display contrast.

26. The golf swing balance analyzer according to claim 19 including means for selectively varying the weight balance between the pads with a golfer standing on said pads prior to initiating a golf swing.

27. The golf swing balance analyzer according to claim 19 including means of selecting an automatic or manual reset of the analyzer between golf swings and further including means for selectively varying reset delay in the automatic reset mode.

28. The golf swing balance analyzer according to claim 19 including means for selecting between a swing to the left where the right foot is the back foot and a swing to the right where the left foot is the back foot.

29. The golf swing balance analyzer according to claim 19 wherein each of said pads includes a base, a flexible weight sensing means on said base, a solid sheet to prevent golf shoe spikes from directly contacting said weight sensing means and a carpet-like top sheet.

30. The golf swing balance analyzer according to claim 29 wherein said pads further includes a plurality of tabs extending laterally from said pads having holes parallel to the ground whereby pegs can be inserted through said holes into the ground to aid in preventing slipping of said pads on the ground during use.

31. A food pad assembly for use in a golf swing balance analyzer which comprises:

a base;

flexible weight sensing sheet means on said base, said flexible weight sensing sheet means comprises means for separately sensing weight on at least two separate locations on said food pad;

a solid sheet above said weight sensing means adapted to distribute pressure and prevent spikes from a golf shoe in engagement with said pad from directly contacting said weight sensing means; and a thick fibrous top sheet.

32. The foot pad assembly according to claim 31 wherein said solid sheet includes a sheet of resilient foam between said base and said solid sheet to maintain a selected space therebetween when no force is applied to said solid sheet.

33. The foot pad assembly according to claim 31 wherein said solid sheet comprises a solid aluminum plate.

34. The golf foot pad assembly according to claim 31 wherein said pads further include a plurality of spaced nubs extending downwardly from said base to grip a surface beneath the pads and reduce slippage on that surface.

35. The golf foot pad assembly according to claim 31 wherein said base comprises a molded plastic or rubber frame covering the lower surface of said pad and extending up around the sides of solid sheet and fibrous sheet and an aluminum plate within said frame which directly supports said sensor sheet.

36. The golf foot pad assembly according to claim 31 wherein said sensor sheet means is rectangular and includes a force to electrical energy transducer at each corner.

* * * * *